US006945776B2

(12) United States Patent
Choi et al.

(10) Patent No.: US 6,945,776 B2
(45) Date of Patent: Sep. 20, 2005

(54) METHOD AND A SKID MEMBER FOR REDUCING TEMPERATURE DIFFERENCE IN A HEATING SUBJECT AND A SKID APPARATUS USING THEM

(75) Inventors: Seoung-Duk Choi, Kyungsangbook-do (KR); Hae-Kwun Chang, Kyungsangbook-do (KR); Kyung-Zoon Min, Kyungsangbook-do (KR); See-Woo Yim, Kyungsangbook-do (KR)

(73) Assignee: Posco (KR)

( * ) Notice: Subject to any disclaimer, the term of this patent is extended or adjusted under 35 U.S.C. 154(b) by 0 days.

(21) Appl. No.: 10/494,986

(22) PCT Filed: Jul. 23, 2003

(86) PCT No.: PCT/KR03/01472

§ 371 (c)(1),
(2), (4) Date: May 6, 2004

(87) PCT Pub. No.: WO2004/011684

PCT Pub. Date: Feb. 5, 2004

(65) Prior Publication Data

US 2004/0253561 A1 Dec. 16, 2004

(30) Foreign Application Priority Data

Jul. 25, 2002 (KR) ..... 10-2002-0043813

(51) Int. Cl.[7] ..... F27D 3/02
(52) U.S. Cl. ..... 432/234; 432/127
(58) Field of Search ..... 432/123, 122, 432/126, 127, 234

(56) References Cited

U.S. PATENT DOCUMENTS 3,642,261 A * 2/1972 Laws ..... 432/234
4,609,347 A * 9/1986 Yamashita et al. ..... 432/234
4,906,525 A * 3/1990 Seguchi et al. ..... 428/469
5,271,610 A * 12/1993 Klotz ..... 266/274
5,897,310 A * 4/1999 Trueman et al. ..... 432/234
5,921,772 A * 7/1999 Hopson et al. ..... 432/234

FOREIGN PATENT DOCUMENTS

JP 59-162219 A 9/1984
JP 60-026615 A 2/1985

(Continued)

OTHER PUBLICATIONS

Pilkey, Walter D., Table 6–1 Stress Concentration Factors: Holes, from "Formulas For Stress, Strain, and Structural Matrices", 1994, (2 pp.), published by John Wiley & Sons, Inc., USA.

*Primary Examiner*—Gregory A. Wilson
(74) *Attorney, Agent, or Firm*—The Webb Law Firm, P.C.

(57) ABSTRACT

An improved method and a skid member for minimizing the temperature difference between a skid-contacting region and other regions in a hot material to be heated such as a slab or billet within a reheating furnace and a skid apparatus using the same. The skid member has at least one ventilation channel for restraining heat transfer toward a lower portion of the skid member for supporting or carrying the hot material in the reheating furnace and allowing passage of hot gas through the same to reduce the temperature difference between a contact region and a non-contact region of the hot material. The invention restrains heat transfer from the hot material to a skid coolant pipe and introduces hot gas within the reheating furnace into the skid member to compensate heat loss in an upper portion of the skid member, thereby preventing temperature drop in a contact region between a top face of the skid member and an underside of the hot material so that the rolling threading ability and quality of the hot material can be improved in subsequent processes.

40 Claims, 68 Drawing Sheets

U.S. PATENT DOCUMENTS

| | | | |
|---|---|---|---|
| JP | 62-070509 | B2 | 4/1987 |
| JP | 2-085322 | A | 3/1990 |
| JP | 3-047913 | A | 2/1991 |
| JP | 3-207808 | A | 9/1991 |
| JP | 4-131318 | A | 5/1992 |
| JP | 5-179339 | A | 7/1993 |
| JP | 6-306453 | A | 11/1994 |
| JP | 7-011324 | A | 1/1995 |
| JP | 9-268314 | A | 10/1997 |
| JP | 10-140246 | A | 5/1998 |
| JP | 10-140247 | A | 5/1998 |
| JP | 10-306313 | A | 11/1998 |
| JP | 2000-61503 | A | 2/2000 |
| KR | 2003-0008119 | A | 1/2003 |

* cited by examiner $$M = \sigma_b \cdot Z$$

$$Z = \frac{h_1 (h_2^3 - d^3)}{6h_2}$$

$$M' = \sigma_b \cdot Z'$$
$$Z' = \frac{h_1 (h_2 - d)^2}{6}$$

METHOD AND A SKID MEMBER FOR REDUCING TEMPERATURE DIFFERENCE IN A HEATING SUBJECT AND A SKID APPARATUS USING THEM

TECHNICAL FIELD

The present invention relates to an improved method and a skid member for minimizing the temperature difference between a skid-contacting region and other regions in a hot material to be heated such as a slab or billet within a reheating furnace and a skid apparatus using the same, more particularly, which restrains heat transfer from the hot material to a skid coolant pipe and introduces hot gas within the reheating furnace into the skid member to compensate heat loss in an upper portion of the skid member, thereby preventing temperature drop in a contact region between a top portion of the skid member and an underside of the hot material so that the rolling threading ability and quality of the hot material can be improved in subsequent processes.

BACKGROUND ART

In general, hot materials 110 such as slabs and billets are heated up to a predetermined temperature while being carried in a reheating furnace 100 before they are hot rolled. As shown in FIG. 1, the reheating furnace 100 contains a skid apparatus 120 for supporting and carrying the hot materials 110 within the reheating furnace 100, a plurality of burners 122 functioning as heat sources and an exhaust duct unit 130 for exhausting atmospheric gas out of the reheating furnace 100.

The skid apparatus 120 includes stationary beam skids 124 and movable beam skids 126 for moving the hot materials 110, in which the movable beam skids 126 carry out a transport cycle including elevation, advancement, descent and retreat to carry the hot materials 110 within the reheating furnace 100 toward an exit while the stationary beam skids 124 support the hot materials 110.

The skid apparatus 120 has coolant pipes 140 which are placed on top portions of the skid beams, as shown in FIGS. 2 and 3, each surrounded by a heat insulation layer 142 for allowing passage of coolant through the same. On the coolant pipes 140, there are mounted a plurality of skid members 150 made of ceramic composite or special refractory steel for supporting the hot materials 110.

Each of the skid members 150 may be in the form of a column having a polygonal cross-sectional configuration, such as a hexagonal section as shown in FIG. 4*a*, a circular cross-sectional configuration as shown in FIG. 4*c* or a quadrangular cross-sectional configuration as shown in FIG. 4*d*. Also, as shown in FIG. 4*b*, the skid member 150 may be shaped as a circular column having heat-absorbing fins 150*a* mounted on the top thereof.

As shown in FIG. 5*a*, the skid member 150 may have a stationary rail structure extended longitudinally along the coolant pipe 140, which is suitable for pushing the hot materials into the furnace through an entrance so that the hot materials are slid on the stationary rail.

Also as shown in FIGS. 5*b* and 5*c*, the skid member 150 comprises assembling structures 143 projected from the coolant pipe 140 and a rider 144 coupled with the assembling structures 143 along the length of the coolant pipe 140.

In the skid apparatus 120 of the conventional reheating furnace 100, the skid members 150 are cooled down with coolants such as cold water or steam, etc., while they support the hot materials 110. As a result, when a top portion 161 (FIG. 6B) of each skid member 150 supports an underside region of each hot material 110, the underside region is cooled down with coolant to form a skid mark 160 having a temperature lower than other regions of the hot material 110. That is, the skid mark 160 is formed in the underside region of the hot material 110 contacted with the top portion 161 of the skid member 150, in which the contacted underside region of the hot material 110 has a temperature lower than other regions of the hot material, thereby creating temperature difference to the hot material.

Therefore, the prior art maintains the temperature difference of about at least 20 to 30° C. between the skid mark 160 and other regions of the hot material. Since the skid mark 160 has such a large value of temperature difference, this causes difference of elongation to the hot material 110 in a subsequent hot rolling process thereby degrading precision of rolling thickness and width.

Such degraded precision of rolling thickness creates a localized thick portion to the hot material in a finishing mill process which is requiring a precise rolling control of thickness, this is caused by the increase of deformation resistance at the skid mark of low temperature while the hot material is rolled under tension between hot rolling stands.

On the contrary, when the hot finishing mill process is performed to a steel strip or plate of ultra low carbon content in a temperature range (860 to 890° C.) below the transformation point ($Ar_3$: about 910° C.) where a skid mark region undergoes phase-transformation (e.g., from austenite to ferrite), deformation resistance decreases rapidly in the longitudinal direction of rolled steel to worsen rolling threading ability or to reduce strip or plate thickness radically thereby tearing them off.

If the temperature of the hot rolled strip or plate is raised to avoid the foregoing problems, energy is consumed excessively. Also, the surface of the hot rolled strip or plate may be scaled and rolls suffer from heavy thermal fatigue.

Therefore, in the prior art, heating time is prolonged or the temperature of the reheating furnace 100 is raised excessively in order to decrease the temperature difference associated with the skid mark 160. However, temperature rise in the reheating furnace 100 consumes fuel by a large quantity thereby raising the production cost of steel products with the reheating furnace 100. Also, the hot material is overheated thereby increasing scales as well as lowering the yield of steel products. Further, even though the scales formed on the surface of the hot material are removed via impact of high-pressure water, some of scales remain on the surface causing surface defects to the rolled hot material.

In order to prevent problems related with hot rolling and subsequent processes, it is required to maintain the temperature difference associated with the skid mark 160 within about 20° C., preferably, about 18° C.

Several improvements have been proposed in the prior art, to solve the problems related with subsequent processes caused by the skid mark.

Japanese Laid-Open Patent Publication Serial No. H2-85322 discloses a laser apparatus capable of detecting the temperature of a skid mark in a rolled slab and emitting a laser beam to the skid mark from the exit side of a reheating furnace to further heat the skid mark so that the temperature of the skid mark rises equal to that of the slab. Since the laser apparatus is provided in addition to the reheating furnace, this technique requires additional cost for the laser apparatus.

Japanese Laid-Open Patent Publication Ser. Nos. H3-207808 and H5-179339 propose techniques for mounting a skid mark burner in the exit side of a reheating furnace to heat a corresponding region of a slab to remove any skid mark from the slab and to provide the skid mark burner with excellent endurance. According to these techniques, the burner is installed within the reheating furnace to be used exclusively for the skid mark, and the burner also increases installation cost.

Japanese Laid-Open Patent Publication Serial Nos. H3-47913 and H4-131318 disclose a skid button. This skid button has an internal space and is partitioned into two or three vertical sections, in which an upper section is made of a material excellent in heat conductivity and a lower section is made of material excellent in endurance and structural strength. However, such partitioned skid button is structurally unstable, and causes high fabrication price thereby raising cost.

Also, Japanese Patent Publication Serial No. H4-57727 discloses a cylindrical skid member within a skid member holder on a skid coolant pipe, in which the skid member is made of heat insulation material such as non-oxide ceramic and has a hollow space or an upward opening. However, this skid member also has a partitioned structure and thus disadvantageously increases installation cost. Further, scales are deposited in the opening to fill the same, resultantly giving an effect of filling the opening with insulation material.

Japanese Laid-Open Patent Publication Serial No. H6-306453 discloses an apparatus comprising a burner installed in a lower portion of the exit side of a reheating furnace, a local heating controller for controlling the burner and a time predicting controller in order to minimize the temperature difference between a skid mark and other regions of a slab based upon the temperature of the skid mark. This apparatus also requires extension of equipment installation.

Another Japanese Laid-Open Patent Publication Serial No. H9-268314 discloses skid button having a cylindrical short pipe installed on a skid member holder extended from a skid pipe, in which refractory castable is filled into the pipe remaining a gap in an upper portion thereof. However, since the short pipe reduced in sectional area only supports the contact region of a slab, a large quantity of surface pressure is applied to the contact region of the slab potentially leaving a mark on the contact region of the slab. In this skid button, while the gap and the refractory castable block heat generated from the slab to prevent creation of a skid mark in an initial stage, as the time goes by, scales are deposited in the gap filling the same thereby disabling the effect of the gap to a certain degree.

Japanese Laid-Open Patent Publication Serial No. H10-140246 proposes an apparatus which comprises a water cooling pipe arranged inside a skid beam under a tempering zone of a reheating furnace and an auxiliary heating gas line incorporating a gas supplying pipe extended upwardly through a refractory layer and having a nozzle placed right below a slab for heating a skid mark of the slab. This apparatus can remove the skid mark through localized heating to the slab, but needs extension of installations thereby causing rise in equipment price and running cost.

Another Japanese Laid-Open Patent Publication Serial No. H10-140247 installs a plurality of regenerative burners above a tempering zone in a reheating furnace to further heat a skid mark on a slab thereby reducing the temperature difference between the skid mark and other regions of the slab. However, this technique requires additional regenerative burners thereby raising installation cost by a large quantity as well as manufacturing cost through additional heating.

Japanese Laid-Open Patent Publication Serial No. H10-306313 discloses a technique for heating skid beams with fuel supplying pipes installed in one of the skid beams thereby to prevent a skid mark in an underside region of a slab supported by the skid beams. Since this technique of the prior art also requires the fuel supplying pipes on the skid bear, there are problems that extension of installations consumes a large amount of cost as well as complicates a system design.

Furthermore, Japanese Laid-Open Patent Publication Serial No. 2000-61503 provides a solenoid-induced heating apparatus between a prime rolling mill and a finishing mill to heat a low temperature region of a slab over other regions thereof. This conventional technique also needs additional heating units.

The present invention has been made to solve the foregoing problems of the prior art and it is therefore an object of the invention to provide an improved method and a skid member for reducing temperature difference in a hot material to be heated and a skid apparatus using the same, more particularly, which reduces the heat transfer area from the hot material toward a lower portion of the skid member and forms a ventilation channel enlarging an area in contact with hot gas to increase the quantity of heat introduced into the skid member, thereby reducing heat loss from an upper portion of the skid member to the lower portion thereof with the ventilation channel and thus imparting compensatory heating to the upper portion of the skid member.

It is another object of the invention to provide an improved method and a skid member for reducing temperature difference in a hot material to be heated and a skid apparatus using the same, more particularly, which reduces the temperature difference between a skid mark and other regions of a hot material to be heated through simple structural improvement so that the hot material can be heated at a uniform temperature to improve the hot rolling threading ability and quality of the hot material in subsequent processes.

It is yet another object of the invention to provide an improved method and a skid member for reducing temperature difference in a hot material to be heated and a skid apparatus using the same, more particularly, which introduces hot gas within a reheating furnace into the skid member while maintaining the contour of the skid member to reduce temperature difference associated with a skid mark, thereby improving percentile thickness and width within tolerances and restraining creation of scales to minimize descaling operation, improve rolling yield and save manufacturing cost.

SUMMARY OF THE INVENTION

According to an aspect of the invention for realizing the foregoing objects, there is provided a method for reducing temperature difference in a hot material to be heated which is supported and/or carried by a skid member within a reheating furnace, the method comprising the following steps of:

circulating hot gas for heating the hot material into a space formed within the skid member; and compensating heat loss of an upper portion of the skid member with a portion of heat transferred from the hot gas which is introduced into the space and transferring a residual of the transferred heat to a coolant pipe, whereby the temperature of the upper portion of the skid member is maintained higher than a temperature inevitably creating a skid mark in the hot material.

According to another aspect of the invention for realizing the foregoing objects, there is provided a skid member for supporting and/or carrying a hot material to be heated within a reheating furnace, comprising: a top face contacting an underside region of the hot material; and at least one ventilation channel formed in the skid member for introducing hot gas through the same to reduce temperature difference between the underside region of the hot material in contact with the top face of the skid member and a non-contact region of the hot material.

According to further another aspect of the invention for realizing the foregoing objects, there is provided a skid member for supporting and/or carrying a hot material to be heated within a reheating furnace comprising: a top face for supporting the hot material; a lateral hollow space of a predetermined size formed within the skid member; and a lateral vent hole formed in the skid member, whereby the quantity of heat transferred from the hot material to a coolant pipe is reduced and the quantity of heat introduced from hot gas is increased to reduce temperature difference between an underside region of the hot material in contact with the top portion of the skid member and a non-contact region thereof.

According to further another aspect of the invention for realizing the foregoing objects, there is provided a skid member for supporting and/or carrying a hot material to be heated within a reheating furnace comprising: a top face for supporting the hot material; a blind lateral vent hole formed within the skid member at a predetermined size; and a stopper blocking an opening of the vent hole to define a hollow space within the skid member, whereby the quantity of heat transferred from the hot material to a coolant pipe is reduced to decrease temperature difference between an underside region of the hot material in contact with the top portion of the skid member and a non-contact region of thereof.

According to yet another aspect of the invention for realizing the foregoing objects, there is provided a skid apparatus for supporting and/or carrying a hot material to be heated within a reheating furnace comprising: a coolant pipe for allowing passage of coolant through the same; a heat insulation layer surrounding an exterior of the coolant pipe; and at least one skid member having a bottom connected with the coolant pipe, a top face for supporting the hot material and at least one ventilation channel for allowing passage of hot gas within the reheating furnace into the skid member, whereby temperature difference between an underside region of the hot material in contact with the top face of the skid member and a non-contact region thereof is reduced.

BRIEF DESCRIPTION OF THE DRAWINGS

FIGS. 4*a* through 4*d* illustrate several types of skid members of the skid apparatus of the prior art, in which FIG. 4*a* illustrates a polygonal cross-sectional configuration, FIG. 4*b* illustrates a structure with heat-absorbing fins mounted on a top portion thereof, FIG. 4*c* illustrates a circular column-shaped configuration, and FIG. 4*d* illustrates a quadrangular cross-sectional configuration;

FIGS. 5*a* through 5*c* illustrate several types of skid apparatus sections mounted with rail-type skid members of the prior art, in which FIG. 5*a* illustrates a quadrangular rail structure, FIG. 5*b* illustrates a rail structure mounted with a rider, and FIG. 5*c* is a cross-sectional view taken along a line A—A in FIG. 5*b;*

FIGS. 6*a* through 6*d* are detailed views of a skid member having a ventilation channel and a skid apparatus mounted with the skid member according to the invention, in which FIG. 6*a* is an exterior perspective view of the skid apparatus, FIG. 6*b* is a sectional view taken along a line A—A in FIG. 6*a*, FIG. 6*c* is a sectional view taken along a line A'—A' in FIG. 6*b*, and FIG. 6*d* is an exterior perspective view of the skid member;

FIGS. 7*a* through 7*c* are detailed views of a skid apparatus mounted with a skid member having a neck of the prior art, in which FIG. 7*a* is an exterior perspective view of the skid apparatus, FIG. 7*b* is a sectional view taken along a line B—B in FIG. 7*a*, and FIG. 7*c* is a sectional view taken along a line B'—B' in FIG. 7*b;*

FIGS. 8*a* and 8*b* are detailed views of a skid apparatus mounted with a stationary rail-type skid member having vent holes therein according to the invention, in which FIG. 8*a* is an exterior perspective view of the skid apparatus, and FIG. 8*b* is a sectional view taken along a line A—A in FIG. 8*a;*

FIGS. 9*a* through 9*c* are detailed views of a skid apparatus mounted with a rider-type skid member having vent holes therein according to the invention, in which FIG. 9*a* is an exterior perspective view of the skid apparatus, FIG. 9*b* is a sectional view taken along a line A—A in FIG. 9*b*, and FIG. 9*c* is a sectional view taken along a line A'—A' in FIG. 9*b;*

FIGS. 10*a* through 10*c* are detailed views of a skid apparatus mounted with a skid member having one inclined ventilation channel formed therein according to the invention, in which FIG. 10*a* is an exterior perspective view of the skid apparatus, FIG. 10*b* is a sectional view taken along a line C—C in FIG. 10*a*, and FIG. 10*c* is a sectional view taken along a line C'—C' in FIG. 10*b;*

FIGS. 11*a* and 11*b* are detailed views of a skid apparatus mounted with a stationary rail-type skid member having a plurality of inclined ventilation channels formed therein according to the invention, in which FIG. 11*a* is an exterior perspective view of the skid apparatus, and FIG. 11*b* is a sectional view taken along a line C—C in FIG. 11*a;*

FIGS. 12*a* through 12*c* are detailed views of a skid apparatus mounted with a skid member having a plurality of horizontal ventilation channels formed therein according to the invention, in which FIG. 12*a* is an exterior perspective view of the skid apparatus, FIG. 12*b* is a sectional view taken along a line D—D in FIG. 12*a*, and FIG. 12*c* is a sectional view taken along a line D'—D' in FIG. 12*b;*

FIGS. 13*a* through 13*c* are detailed views of a skid apparatus mounted with a skid member having a plurality of inclined ventilation channels formed therein according to an alternative embodiment of the invention, in which FIG. 13*a* is an exterior perspective view of the skid apparatus, FIG. 13*b* is a sectional view taken along a line E—E in FIG. 13*a*, and FIG. 13*c* is a sectional view taken along a line E'—E' in FIG. 13*b;*

FIGS. 14*a* through 14*c* are detailed views of a skid apparatus mounted with a skid member having a plurality of intersected ventilation channels formed therein according to another alternative embodiment of the invention, in which FIG. 14*a* is an exterior perspective view of the skid apparatus, FIG. 14*b* is a sectional view taken along a line F—F in FIG. 14*a*, and FIG. 14*c* is a sectional view taken along a line F'—F' in FIG. 14*b;*

FIGS. 15*a* and 15*b* are detailed views of a skid apparatus mounted with a stationary rail-type skid member having a plurality of ventilation channels diagonally inclined therein according to yet another alternative embodiment of the invention, in which FIG. 15*a* is an exterior perspective view of the skid apparatus, and FIG. 15*b* is a sectional view taken along a line F—F in FIG. 15*a;*

FIGS. 16*a* through 16*c* are detailed views of a skid apparatus mounted with a skid member having a plurality of ventilation channels inclined diagonally and intersected with each other according to another alternative embodiment of the invention, in which FIG. 16*a* is an exterior perspective view of the skid apparatus, FIG. 16*b* is a sectional view taken along a line G—G in FIG. 16*a*, and FIG. 16*c* is a sectional view taken along a line G'—G' in FIG. 16*b;*

FIGS. 17*a* through 17*c* are detailed views of a skid apparatus mounted with a skid member including a plurality of vent holes having different heights and communicating with each other according to another alternative embodiment of the invention, in which FIG. 17*a* is an exterior perspective view of the skid apparatus, FIG. 17*b* is a sectional view taken along a line H—H in FIG. 17*a*, and FIG. 17*c* is a sectional view taken along a line H'—H' in FIG. 17*b;*

FIGS. 18*a* through 18*c* are detailed views of a skid apparatus mounted with a skid member according to yet another alternative embodiment of the invention, in which FIG. 18*a* is an exterior perspective view of the skid apparatus, FIG. 18*b* is a sectional view taken along a line I—I in FIG. 18*a*, and FIG. 18*c* is a sectional view taken along a line I'—I' in FIG. 18*b;*

FIGS. 19*a* and 19*b* are detailed views of a skid apparatus mounted with a skid member having a plurality of vent holes intersected with each other at a same height according to an alternative embodiment of the invention, in which FIG. 19*a* is an exterior perspective view of the skid apparatus, and FIG. 19*b* is a sectional view taken along a line J—J in FIG. 19*a;*

FIGS. 20*a* and 20*b* are detailed views of a skid apparatus mounted with a stationary rail-type skid member having a longitudinal vent hole and a plurality of lateral vent holes formed at a same height therein according to another alternative embodiment of the invention, in which FIG. 20*a* is an exterior perspective view of the skid apparatus, and FIG. 20*b* is a sectional view taken along a line J—J in FIG. 20*a;*

FIGS. 21*a* and 21*b* are detailed views of a skid apparatus mounted with a skid member having a plurality of vent holes inclined laterally and intersected with each other according to another alternative embodiment of the invention, in which FIG. 21*a* is an exterior perspective view of the skid apparatus, and FIG. 21*b* is a sectional view taken along a line K—K in FIG. 21*a;*

FIGS. 22*a* and 22*b* are detailed views of a skid apparatus mounted with a skid member having a lateral vent hole and a vertical vent hole extended from the lateral vent hole to a top face of the skid member according to another alternative embodiment of the invention, in which FIG. 22*a* is an exterior perspective view of the skid apparatus, and FIG. 22*b* is a sectional view taken along a line L—L in FIG. 22*a;*

FIGS. 23*a* and 23*b* are detailed views of a skid apparatus mounted with a stationary rail-type skid member having a longitudinal vent hole and a plurality of vertical vent holes extended from the longitudinal vent hole to a top face of the skid member according to another alternative embodiment of the invention, in which FIG. 23*a* is an exterior perspective view of the skid apparatus, and FIG. 23*b* is a sectional view taken along a line L—L in FIG. 23*a;*

FIGS. 24*a* and 24*b* are detailed views of a skid apparatus mounted with a stationary rail-type skid member having lateral vent holes and vertical vent holes extended from the lateral vent holes to a top face of the skid member according to another alternative embodiment of the invention, in which FIG. 24*a* is an exterior perspective view of the skid apparatus, and FIG. 24*b* is a sectional view taken along a line L—L in FIG. 24*a;*

FIGS. 25*a* and 25*b* are detailed views of a skid apparatus mounted with a skid member having an inclined vent hole extended through the skid member and a vertical vent hole extended from the inclined vent hole to a top face of the skid member according to another alternative embodiment of the invention, in which FIG. 25*a* is an exterior perspective view of the skid apparatus, and FIG. 25*b* is a sectional view taken along a line M—M in FIG. 25*a;*

FIGS. 26*a* and 26*b* are detailed views of a skid apparatus mounted with a skid member having a plurality of vent holes diagonally intersected with each other and a vertical vent hole extended from the diagonal vent holes to a top face of the skid member according to another alternative embodiment of the invention, in which FIG. 26*a* is an exterior perspective view of the skid apparatus, and FIG. 26*b* is a sectional view taken along a line N—N in FIG. 26*a;*

FIGS. 27*a* and 27*b* are detailed views of a skid apparatus mounted with a skid member having a plurality of vent holes inclined diagonally and intersected with each other and a vertical vent hole extended from the diagonal vent holes to a top face of the skid member according to another alternative embodiment of the invention, in which FIG. 27*a* is an exterior perspective view of the skid apparatus, and FIG. 27*b* is a sectional view taken along a line O—O in FIG. 27*a;*

FIGS. 28*a* and 28*b* are detailed views of a skid apparatus mounted with a skid member having a plurality of lateral vent holes formed at different heights and a vertical vent hole extended from the vent holes to a top face of the skid member according to another alternative embodiment of the invention, in which FIG. 28*a* is an exterior perspective view of the skid apparatus, and FIG. 28*b* is a sectional view taken along a line P—P in FIG. 28*a;*

FIGS. 29*a* and 29*b* are detailed views of a skid apparatus according to another alternative embodiment of the invention, the skid apparatus mounted with a skid member having a first group of vent holes extended diagonally one above another alternating with one another in the skid member, a second group of upper vent holes extended to lateral faces of the skid member and a vertical vent hole extended to a top face of the skid member, in which FIG. 29*a* is an exterior perspective view of the skid apparatus, and FIG. 29*b* is a sectional view taken along a line Q—Q in FIG. 29*a;*

FIGS. 30*a* and 30*b* are detailed views of a skid apparatus according to another alternative embodiment of the invention, the skid apparatus mounted with a skid member having a lateral vent hole extended through the skid member, a vertical vent hole extended from the lateral vent hole to a top face of the skid member and a scale exit hole extended downward from the holes, in which FIG. 30*a* is an exterior perspective view of the skid apparatus, and FIG. 30*b* is a sectional view taken along a line R—R in FIG. 30*a;*

FIGS. 31*a* and 31*b* are detailed views of a skid apparatus according to another alternative embodiment of the invention, the skid apparatus having a stationary rail-type skid member comprising a longitudinal vent hole extended through the skid member, a plurality of vertical vent holes extended from the longitudinal vent hole to a top face of the skid member and a scale exit hole extended downward from the holes, in which FIG. 31*a* is an exterior perspective view of the skid apparatus, and FIG. 31*b* is a sectional view taken along a line R—R in FIG. 31*a;*

FIGS. 32*a* and 32*b* are detailed views of a skid apparatus according to another alternative embodiment of the invention, the skid apparatus having a stationary rail-type skid member comprising a plurality of longitudinal vent holes extended through the skid member, a plurality of vertical vent holes extended from the longitudinal vent holes to a top face of the skid member and scale exit holes extended downward from the holes to a side, in which FIG. 32*a* is an exterior perspective view of the skid apparatus, and FIG. 32*b* is a sectional view taken along a line R—R in FIG. 32*a;*

FIGS. 33*a* and 33*b* are detailed views of a skid apparatus according to another alternative embodiment of the invention, the skid apparatus having a skid member comprising an inclined vent hole extended through the skid member, a plurality of vertical vent holes extended from the vent hole to a top face of the skid member and a scale exit hole extended downward from the holes to a side, in which FIG. 33*a* is an exterior perspective view of the skid apparatus, and FIG. 33*b* is a sectional view taken along a line S—S in FIG. 33*a;*

FIGS. 34*a* and 34*b* are detailed views of a skid apparatus according to another alternative embodiment of the invention, the skid apparatus having a skid member comprising a plurality of vent holes extended diagonally crossing one another at a same height in the skid member, a vertical vent hole extended from the vent holes to a top face of the skid member and a scale exit hole extended downward from the holes, in which FIG. 34*a* is an exterior perspective view of the skid apparatus, and FIG. 34*b* is a sectional view taken along a line T—T in FIG. 34*a;*

FIGS. 35*a* and 35*b* are detailed views of a skid apparatus according to another alternative embodiment of the invention, the skid apparatus having a skid member comprising a plurality of vent holes extended at different heights, a vertical vent hole extended from the vent holes to a top face of the skid member and a scale exit hole extended downward from the holes, in which FIG. 35*a* is an exterior perspective view of the skid apparatus, and FIG. 35*b* is a sectional view taken along a line U—U in FIG. 35*a;*

FIGS. 36*a* and 36*b* are detailed views of a skid apparatus according to another alternative embodiment of the invention, the skid apparatus having a skid member comprising a vertical vent hole extended upward and a scale exit hole extended downward from the hole to a side of the skid member communicating with the vertical vent hole, in which FIG. 36*a* is an exterior perspective view of the skid apparatus, and FIG. 36*b* is a sectional view taken along a line AB—AB in FIG. 36*a;*

FIGS. 37*a* and 37*b* are detailed views of a skid apparatus according to another alternative embodiment of the invention, the skid apparatus having a stationary rail-type skid member comprising a plurality of vertical vent holes extended upward and a plurality of scale exit holes extended downward from the holes to both sides of the skid member in a communicating type, in which FIG. 37*a* is an exterior perspective view of the skid apparatus, and FIG. 37*b* is a sectional view taken along a line AB—AB in FIG. 37*a;*

FIGS. 38*a* and 38*b* are detailed views of a skid apparatus according to another alternative embodiment of the invention, the skid apparatus having a skid member comprising an oval hollow space and a vent hole extended from the hollow space to a side of the skid member, in which FIG. 38*a* is an exterior perspective view of the skid apparatus, and FIG. 38*b* is a sectional view taken along a line W—W in FIG. 38*a;*

FIGS. 39*a* and 39*b* are detailed views of a skid apparatus according to another alternative embodiment of the invention, the skid apparatus having a skid member comprising an oval hollow space and a plurality of vent holes extended at inclinations from the hollow space to front and rear sides of the skid member, in which FIG. 39*a* is an exterior perspective view of the skid apparatus, and FIG. 39*b* is a sectional view taken along a line X—X in FIG. 39*a;*

FIGS. 40*a* and 40*b* are detailed views of a skid apparatus according to another alternative embodiment of the invention, the skid apparatus having a skid member comprising an oval hollow space, a plurality of vent holes extended at inclinations from the hollow space to a top face of the skid member and a scale exit hole extended to a lateral side of the skid member, in which FIG. 40*a* is an exterior perspective view of the skid apparatus, and FIG. 40*b* is a sectional view taken along a line Y—Y in FIG. 40*a;*

FIGS. 41*a* and 41*b* are detailed views of a skid apparatus according to another alternative embodiment of the invention, the skid apparatus having a skid member comprising an oval hollow space, a vent hole extended from the hollow space to front and rear faces of the skid member, a plurality of vent holes extended at inclinations from the hollow space to a top face of the skid member and a scale exit hole extended to a lateral side of the skid member, in which FIG. 41*a* is an exterior perspective view of the skid apparatus, and FIG. 41*b* is a sectional view taken along a line Z—Z in FIG. 41*a;*

FIGS. 42*a* and 42*b* are detailed views of a skid apparatus according to another alternative embodiment of the invention, the skid apparatus having a skid member comprising a lateral vent hole, a vertical vent hole extended from the lateral vent hole to a top face of the skid member and a scale exit hole extended downward to a side of the skid member so that holes communicate together, in which FIG. 42*a* is an exterior perspective view of the skid apparatus, and FIG. 42*b* is a sectional view taken along a line AA—AA in FIG. 42*a;*

FIGS. 43*a* and 43*b* are detailed views of a skid apparatus according to another alternative embodiment of the invention, the skid apparatus having a stationary rail-type skid member comprising a plurality of lateral vent holes, vertical vent holes extended from the lateral vent holes to a top face of the skid member and scale exit holes each communicating with corresponding lateral and vertical vent holes and extended downward to a side of the skid member, in which FIG. 43*a* is an exterior perspective view of the skid-apparatus, and FIG. 43*b* is a sectional view taken along a line AA—AA in FIG. 43*a;*

FIGS. 44*a* and 44*b* are detailed views of a skid apparatus according to another alternative embodiment of the invention, the skid apparatus having a skid member comprising a horizontal blind vent hole formed within the skid member and a stopper blocking an opening of the vent hole to define a hollow space within the skid member, in which FIG. 44*a* is an exterior perspective view of the skid apparatus, and FIG. 44*b* is a sectional view taken along a line V—V in FIG. 44*a;*

FIGS. 45*a* through 45*d* are detailed views of a skid apparatus according to another alternative embodiment of the invention having ventilation channels of discrete vent holes, in which FIG. 45*a* is an exterior perspective view of the skid apparatus, FIG. 45*b* is a sectional view taken along a line A2'—A2' in FIG. 45*a*, FIG. 45*c* is a detailed view of a ventilation channel with a closed upper end and an opening inclined downward to a side, and FIG. 45*d* is a sectional view taken along a line AB'—AB' in FIG. 45*c;*

FIGS. 46*a* and 46*b* are detailed views of a skid apparatus according to another alternative embodiment of the invention, the skid apparatus having a skid member comprising an inclined vent hole extended through the skid member and a combustion gas pipe with a leading end extended into the vent hole, in which FIG. 46*a* is an exterior perspective view of the skid apparatus, FIG. 46*b* is a sectional view taken along a line AC—AC in FIG. 46*a;*

FIGS. 47*a* and 47*b* are detailed views of a skid apparatus according to another alternative embodiment of the invention, the skid apparatus having a skid member comprising an inclined vent hole extended through the skid member, a vertical vent hole extended from the inclined vent hole to a top face of the skid member and a scale exit hole extended downward from the holes and a combustion gas pipe with a leading end extended into the vent hole, in which FIG. 47*a* is an exterior perspective view of the skid apparatus, FIG. 47*b* is a sectional view taken along a line AD—AD in FIG. 47*a;*

FIGS. 48*a* and 48*b* are detailed views of a skid apparatus according to another alternative embodiment of the invention, the skid apparatus having a skid member comprising a hollow space, an inclined vent hole extended from the hollow space to front and rear faces of the skid member, a vertical vent hole extended from the hollow space to a top face of the skid member and a scale exit hole extended downward from the holes to a side of the skid member and a combustion gas pipe with a leading end extended into the vent hole, in which FIG. 48*a* is an exterior perspective view of the skid apparatus, FIG. 48*b* is a sectional view taken along a line AE—AE in FIG. 48*a;*

FIGS. 49*a* and 49*b* are detailed views of a skid apparatus according to another alternative embodiment of the invention, the skid apparatus having a skid member comprising a hollow space, a lateral vent hole extended from the hollow space to front and rear faces of the skid member, a plurality of vertical vent holes extended from the hollow space to a top face of the skid member and a combustion gas pipe with a leading end extended into the vent hole, in which FIG. 49*a* is an exterior perspective view of the skid apparatus, FIG. 49*b* is a sectional view taken along a line AE—AE in FIG. 49*a;*

DETAILED DESCRIPTION OF THE INVENTION

The following detailed description will present the present invention in conjunction with the accompanying drawings.

Figure 6A:
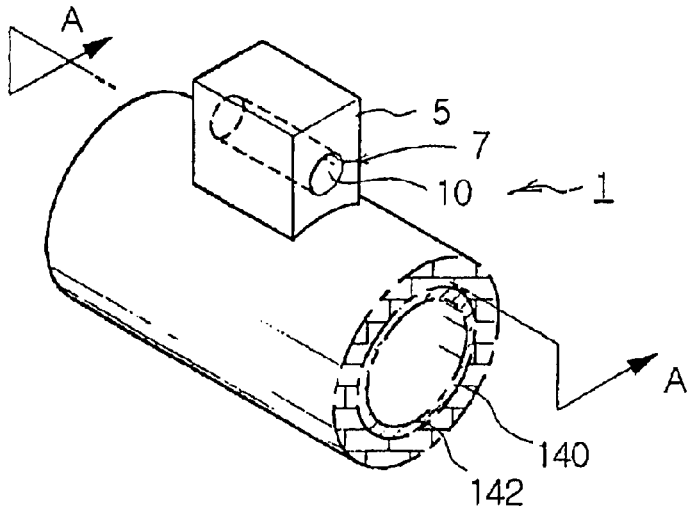
Figure 6B:
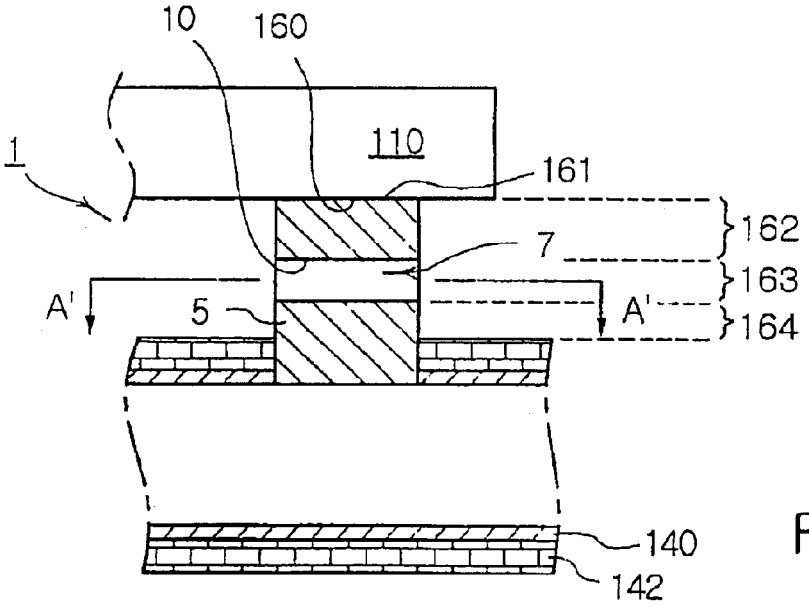
Figure 6C:
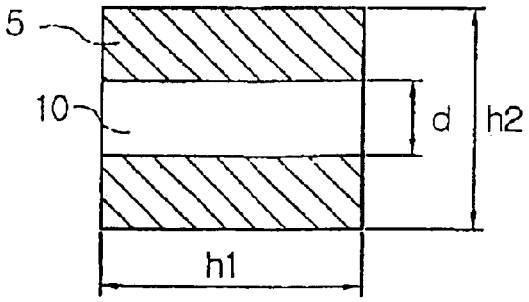
Figure 6D:
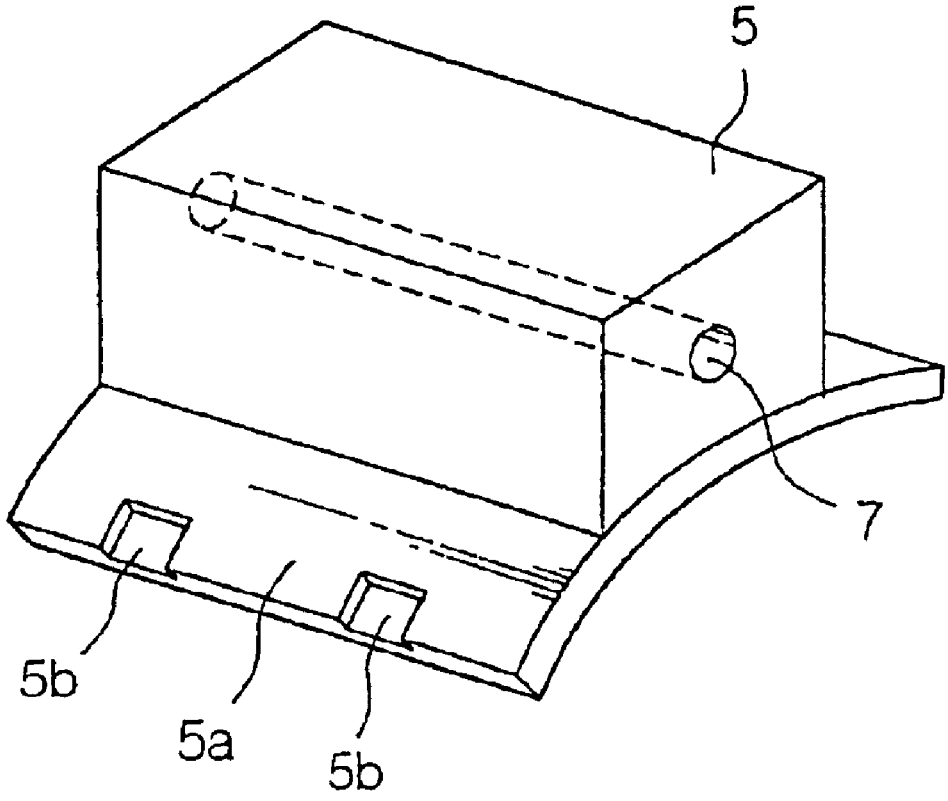

The present invention provides a method for reducing temperature difference in a hot material to be heated such as a slab and billet with a skid member 5 as shown in FIGS. 6*a* through 6*c*. The skid member 5 includes a ventilation channel 7 formed therein to reduce heat transfer from an upper portion to a lower portion of the skid member. The ventilation channel 7 allows passage of hot atmospheric gas from the reheating furnace which heats the hot material 110 so that heat absorbed via the ventilation channel can compensate heat loss in the upper portion 162 of the skid member, and be transferred toward a coolant pipe to further reduce heat transfer from the upper portion 162 of the skid member. As a result, the temperature of the skid member upper portion 162 is maintained over a predetermined temperature inevitably creating a skid mark 160 in the hot material 110.

The skid apparatus 1 of the invention adopted in the method of the invention is applicable to a stationary beam skid 124 and a movable beam skid 126, which in common comprise a coolant pipe 140 for allowing passage of coolant through the same. The coolant pipe 140 is surrounded by a heat insulation layer 142, and connected with a plurality of other skid members 5 which also have ventilation channels 7 formed therein.

Generally, as a structure for seating the skid member 5 on the coolant pipe, the skid member 5 comprises bosses 5*a* having an extended width at its bottom and a plurality of clip receiving portions 5*b* formed at both lateral upper sides of the bosses 5*a*. Alternatively, skid member holders may be provided to readily seat the skid member on the coolant pipe 140.

Figure 45A:
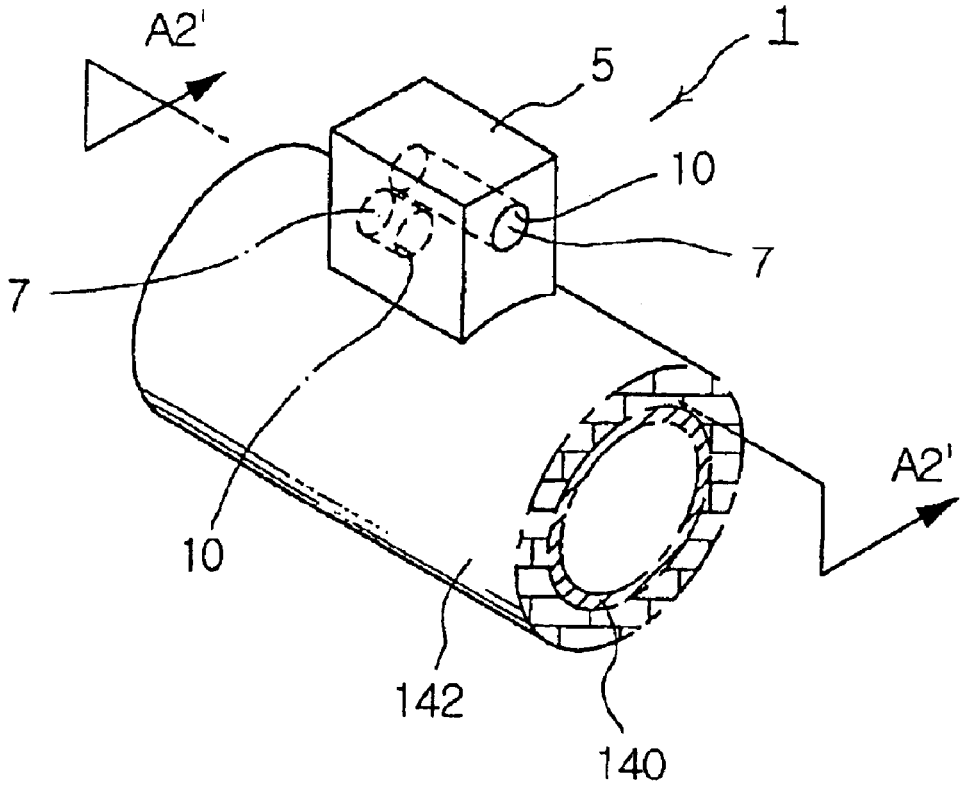
Figure 45B:
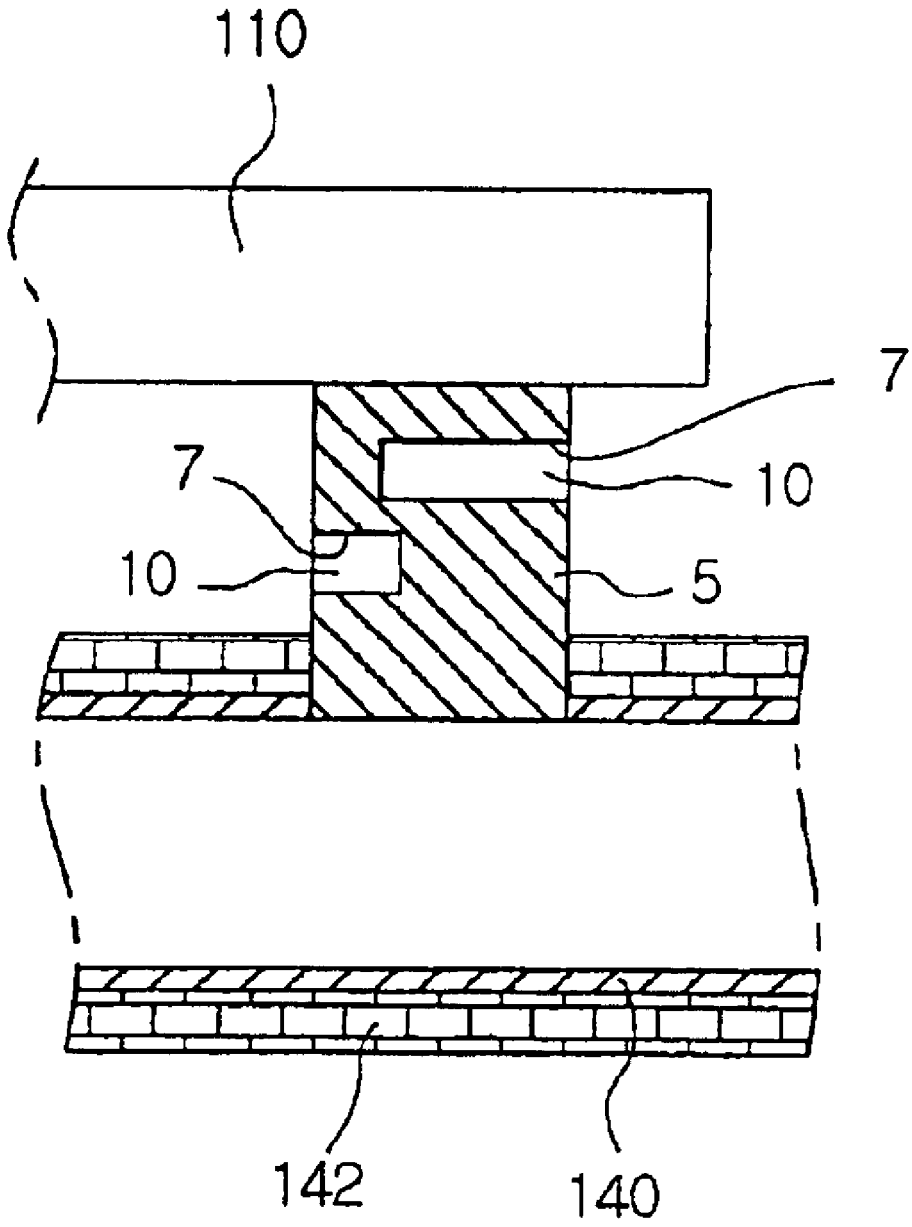

The ventilation channel 7 is extended longitudinally or laterally through the skid member 5 of the invention so that gas within the reheating furnace can be introduced into the ventilation channel 7. The ventilation channel 7 has a structure of a lateral vent hole 10 which is extended from one side of the skid member to one of the other sides thereof as shown in FIG. 6*b*. Alternatively, as shown in FIGS. 45*b* and 45*d*, the ventilation channel may have a structure of blind vent holes 10 and 10*a*, which are extended horizontally or at an inclination to a side of the skid member. Also, the ventilation channel, may be formed diagonally extending through corners.

The vent hole 10 has a circular cross section but is not limited to the same. For example, the cross section of the vent hole 10 may be in the form of any polygon such as a triangle, quadrangle, hexagon and octagon or an ellipse. Further, the number of the vent hole 10 may be varied, or radiator fins may be formed in the inner periphery of the vent hole to increase the surface area of the vent hole 10.

The upper portion of the skid member 5 rises in temperature as the diameter of the circular or elliptic ventilation channel 7 increases, thus it is more preferred that the ventilation channel is placed higher in the skid member.

The uppermost point of the ventilation channel 7 is preferably placed about at least 40 mm from the uppermost portion of the coolant pipe 140.

Figure 1:
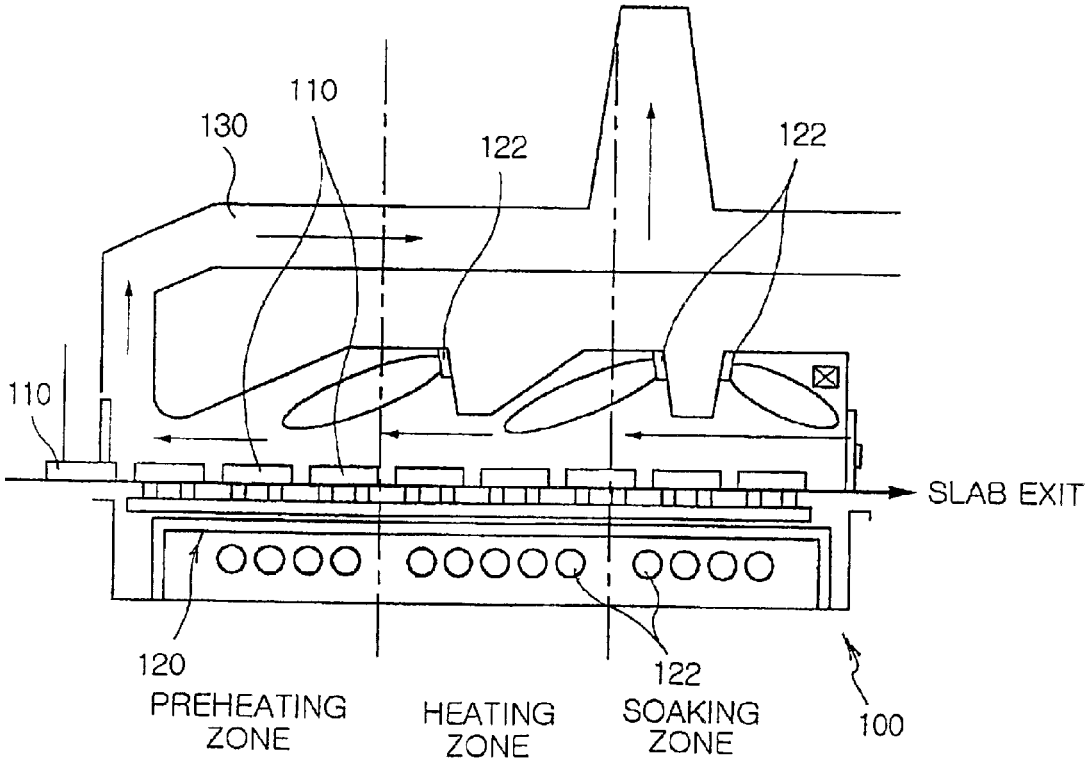
FIG. 1 Prior Art
FIG. 1 is a side sectional view for illustrating slabs carried in a general reheating furnace.
Figure 2:
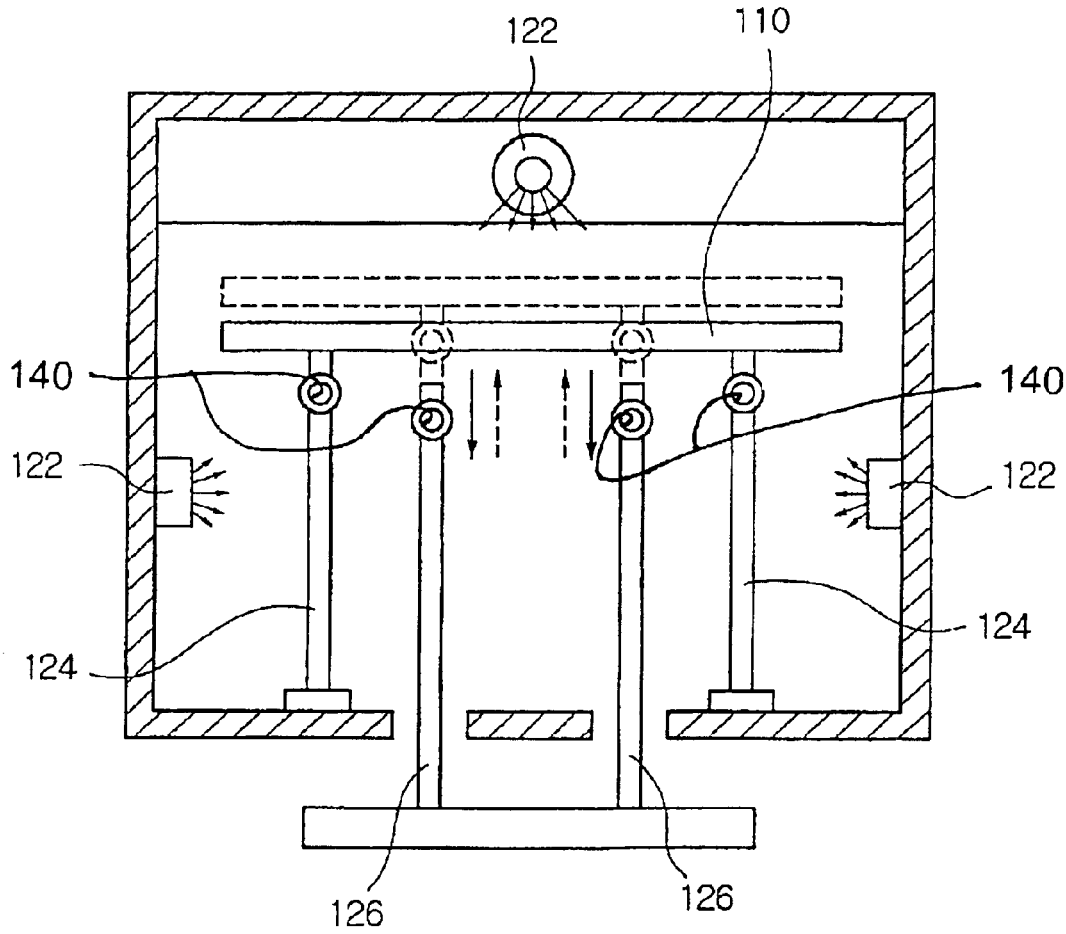
FIG. 2 Prior Art
FIG. 2 is a longitudinal sectional view for illustrating stationary beam skids and movable beam skids in the reheating furnace shown in FIG. 1, which support and carry heated objects.

The ventilation channel 7 is perforated in a direction that hot atmospheric gas flows within the reheating furnace, as in FIG. 6, it may follows the longitudinal direction of the coolant pipe 140. However, the ventilation-channel 7 may be oriented different from the longitudinal direction of the coolant pipe 140. Since flow of hot gas is directed toward a section of the reheating furnace 100 communicating with an exhaust duct unit 130 as shown in FIG. 1, it is preferred to make the ventilation channel 7 follow the direction of hot gas determined according to the arrangement of the reheating furnace 100.

Therefore, as shown in FIGS. 6*a* through 6*d*, the skid member 5 having the ventilation channel 7 can absorb heat from hot gas introduced within the same as well as reduce heat transfer from the upper portion 162 to the lower portion 164 based upon a ventilation channel portion 163 of the skid member 5 in order to raise the temperature of a contact region between the hot material 110 and the skid member 5.

Hot gas within the ventilation channel 7 compensates heat loss, which is transferred from the upper portion 161 at the skid member toward the coolant pipe 140 thereby to prevent over-cooling of the skid member upper portion 161. At the same time, heat transfer occurs from hot gas toward the lower portion 164 of the skid member 5 connected with the coolant pipe 140 via the ventilation channel 7 thereby to reduce the quantity of heat transferred from the upper portion 162 to the lower portion 164 of the skid member.

Such heat balance is expressed in following Equation 1:

$$Qs+Qe+Qe'-Qc=0\rightarrow Qs+Qe+Qe'=Qc \qquad \text{Equation 1,}$$

Wherein, Qs is the quantity of heat transferred from the skid mark of the hot material to the skid member, Qe is the quantity of heat introduced from hot gas within the reheating furnace outside a skid member, Qe' is the quantity of heat introduced into the skid member from hot gas within the ventilation channel, and Qc is the quantity of heat transferred from the skid member to the coolant pipe.

The above equation shows, that the quantity of heat introduced from the ventilation channel 7 formed in a central portion of the skid member 5 is advantageous to add heating to the skid member 5. In particular, where the ventilation channel 7 is constituted of the single lateral vent hole 10*as* shown in FIGS. 6*a* through 6*c*, the ventilation channel 7 is extended to both lateral sides of the skid member 5 so as to ensure more excellent heating effect at the same sectional area while imparting excellent structural strength to the skid member 5.

Figure 7A:
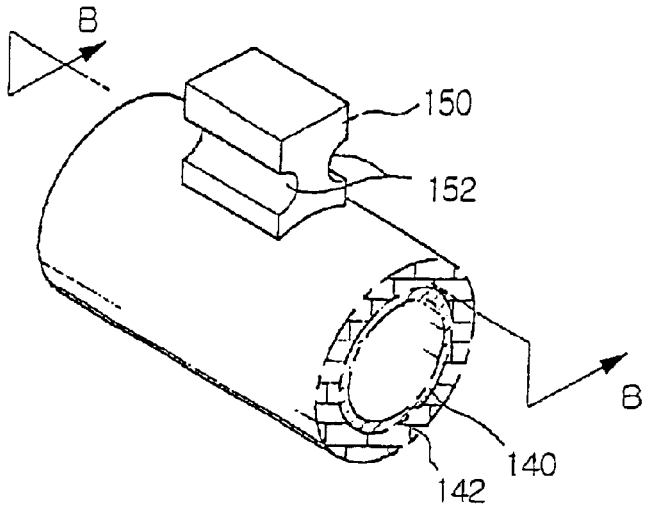
FIG. 7A PRIOR ART
Figure 7B:
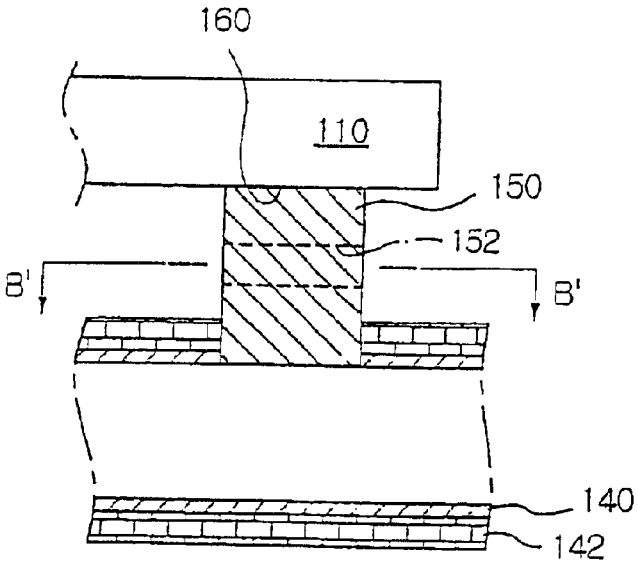
FIG. 7B PRIOR ART
Figure 7C:
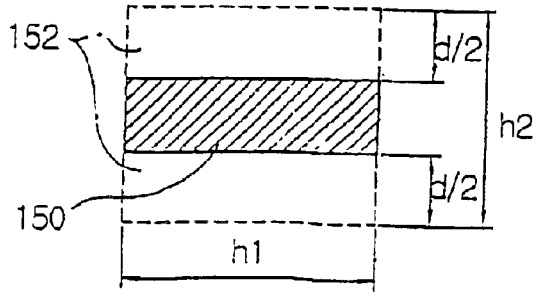
FIG. 7C PRIOR ART

FIGS. 7*a* through 7*c* illustrate a comparative example of a skid member 150, in which elongate grooves 152 having a semi-circular section are formed symmetrically at both lateral sides of the skid member 150 to form a neck. Assuming that the diameter of the lateral vent hole 10 shown in FIG. 6*a* is same as that of the grooves 152 shown in FIG. 7*a*, the elongate grooves 152 have Qe and Qe' which are remarkably different from those of the lateral vent hole 10 while the elongate grooves 152 form a dross sectional area equal to that of the lateral vent hole 10.

Herein the quantity of heat transfer Qe and/or the quantity of heat introduction Qe' can be expressed according to following Equation 2:

$$Qe \text{ or } Qe'=A\delta\times\epsilon(T^4-t^4) \qquad \text{Equation 2,}$$

wherein A is the surface area of heat transfer, $\epsilon$ is emissivity, $\delta$ is a proportional factor such as Stefan-Boltzmann constant, that is, $5.669\times10^{-8}$ $W/m^2K^4$, T is the temperature of hot gas, and t is the temperature of the skid member.

The quantity of heat transfer Qe and/or the quantity of heat introduction Qe' are proportional to the surface area of heat transfer, that is, the surface area A of the skid member 5 exposed to hot gas. In the structure shown in FIG. 6*a*, the surface area exposed to hot gas is constituted of lateral faces of the skid member 5 and the inner periphery of the lateral vent hole 10. However, in the structure shown in FIG. 7*a*, the surface area exposed to hot gas is defined by front and rear faces of the skid member 150, the inner periphery of the elongate grooves 152 and lateral faces of the skid member 150 excluding the grooves 152. Then, it can be seen that the surface area in FIG. 7*a* is reduced as much as those portions corresponding to the elongate grooves 152 compared to the surface area in FIG. 6*a*.

As a result, in the structure in FIG. 7*a* having the reduced surface area of heat transfer, the quantity of heat absorbed into the skid member 5 from hot gas within the reheating furnace is also reduced compared with the structure in FIG. 6*a*.

Further, the structure of the invention as shown in FIG. 6*a* has section modulus which is remarkably larger than the structure shown in FIG. 7*a* to have a more strong structure resisting against bending moment and torsional moment. Such section modulus indicates the capability of resisting against bending stress and torsional stress applied to the skid member 5 from the hot material 110. Even though the skid member 5 with the vent hole 10 in FIG. 6*c* and the skid member 150 having the elongate grooves 152 at sides in FIG. 7*c* have the same sectional area, at their weakest section, the structural strengths will be remarkably different according to the magnitude of their section moduli.

That is, since the skid member 5 of the invention shown in FIG. 6*c* has the lateral vent hole 10 formed through the front and rear faces, the maximum bending moment and the section modulus at the weakest section can be obtained as shown in FIG. 6*c* according to following Equations 3 and 4:

$$M=\delta_b \times Z \qquad \text{Equation 3,}$$

$$Z=h_1(h_2^3-d^3)/6h_2 \qquad \text{Equation 4,}$$

wherein M is maximum bending moment which can be resisted by the skid member, $\delta_b$ is maximum bending stress of the skid member, and Z is section modulus.

At the weakest section, the skid member 150 shown in FIG. 7*c* has a cross sectional area same as that of the skid member shown in FIG. 6*c* if the elongate grooves 152 of a semi-circular section have a diameter d same as a diameter d of the vent hole 10. However, the skid member 150 will have a section modulus at the weakest section, expressed in following Equation 5:

$$Z'=h_1\times(h_2-d)^2/6 \qquad \text{Equation 5.}$$

If $h_1$, $h_2$ and d in above Equations 4 and 5 are substituted by any arbitrary numbers, it can be seen that Z>Z'. Therefore, with the structure of the invention shown in FIGS. 6*a* through 6*c*, the structural strength against bending stress applied to the skid member 5 is much higher than that of the comparative example shown in FIGS. 7*a* through 7*c*. Therefore, The structure of the invention has a higher resistant ability against any external stress applied to the skid member 5 from the hot material 110, and thus is more stable structurally.

Such difference in section modulus is applied equal to bending stress as well as torsional stress applied to the skid member 5, and the structural strength of the skid member 5 is varied according to the position of the lateral vent hole 10, which is an important factor in the invention.

Therefore, the invention shown in FIGS. 6*a* through 6*d* has an ability of reducing the quantity of heat transfer from the upper portion to the lower portion of the skid member, which is more excellent than that of the comparative example shown in FIGS. 7*a* through 7*c*. Further, the structure of the invention has a very excellent structural strength.

Figure 8A:
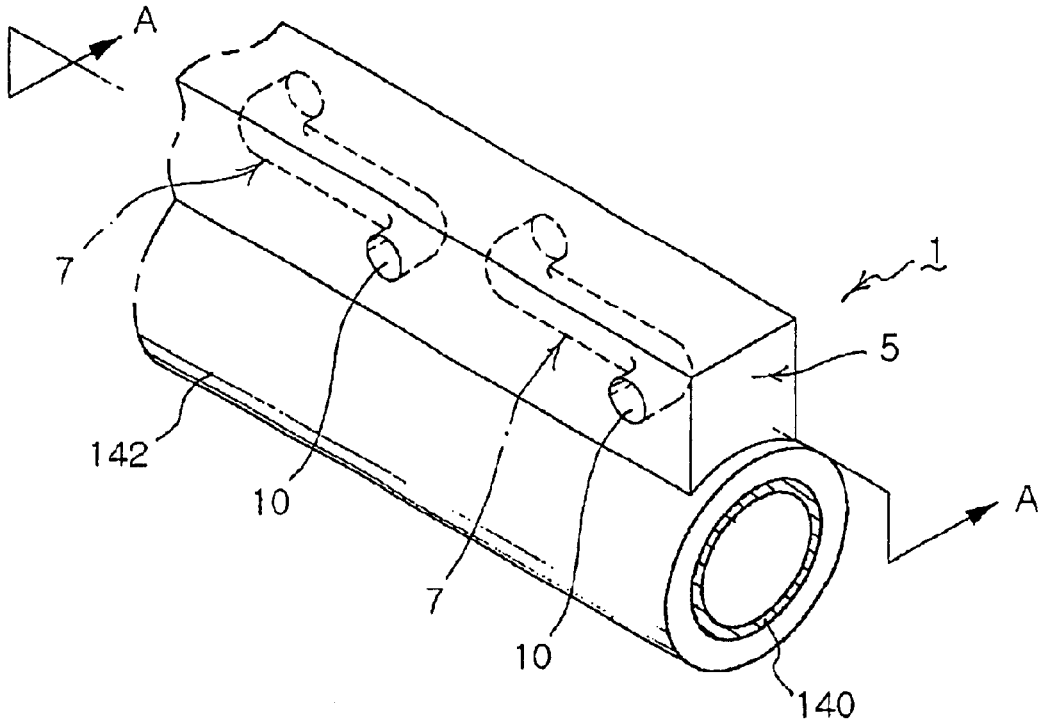
Figure 8B:
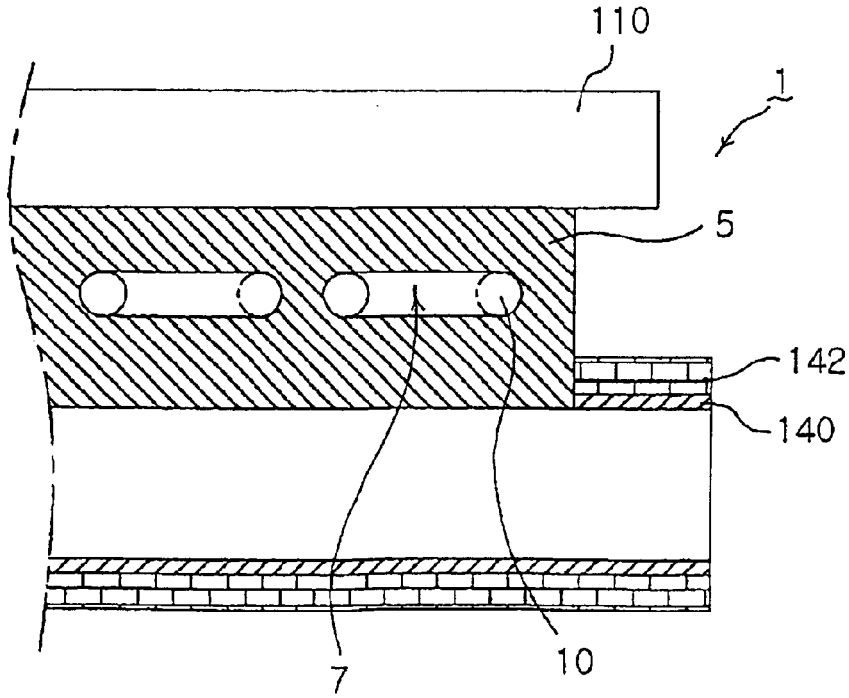
Figure 9A:
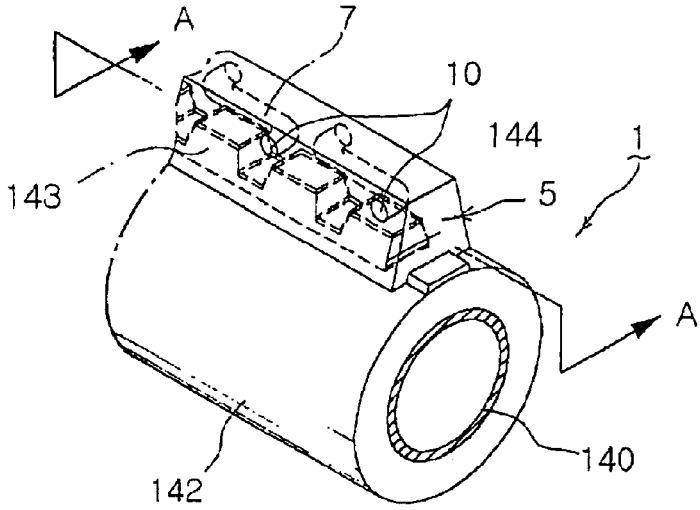
Figure 9B:
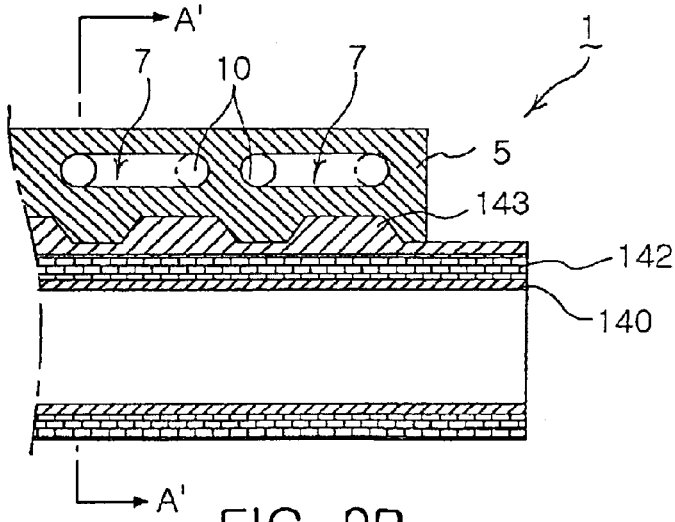
Figure 9C:
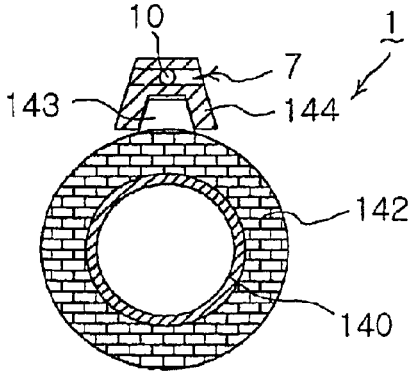

FIGS. 8 and 9 illustrate stationary rail-type and rider-type skid apparatus each adopting the structure shown in FIG. 6 of the invention. Each of these skid apparatus has a plurality of vent holes 10 formed longitudinally and opened at lateral sides in a skid member 5 to form ventilation channels 7. These skid members 5 are excellent in heat transfer capability as well as in structural stability as described in conjunction with FIG. 6.

Figure 10A:
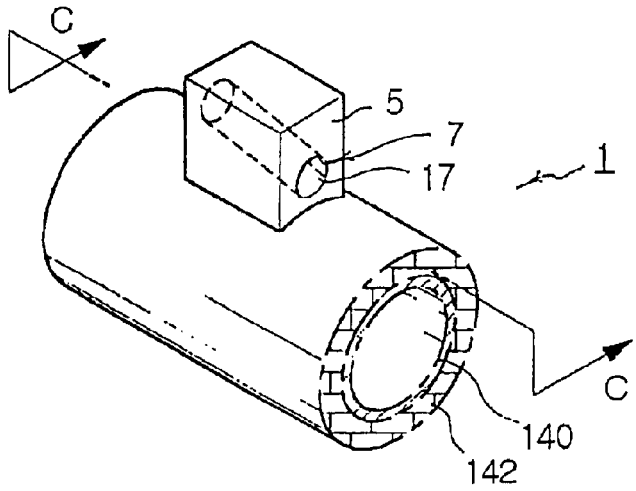
Figure 10B:
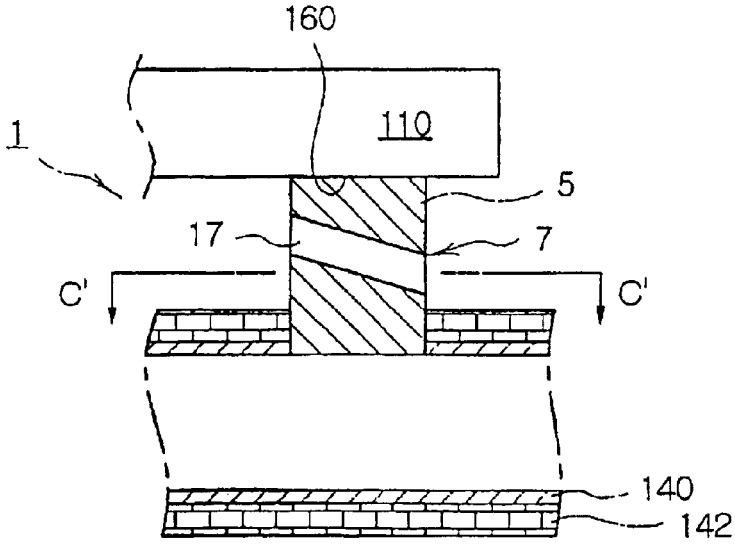
Figure 10C:
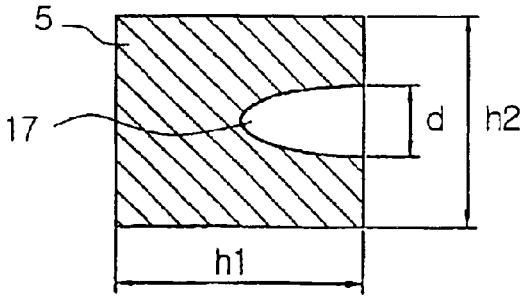

FIG. 10 illustrates an alternative structure of the invention which is modified from the structure of FIG. 6. In the alternative structure shown in FIG. 10, a ventilation channel 7 has an inclined lateral vent hole 17 formed from a front face to a rear face of a skid member 5. Where the diameter d of the lateral vent hole 17 is identical with a diameter d of the lateral vent hole 10 shown in FIG. 6, the inclined structure of the lateral vent hole 17 can provide a heat transfer area defined by the lateral vent hole 17 which is larger than that of the structure shown in FIG. 6. As shown in FIG. 10*c*, the area of the skid member 5 cut by the vent hole 17 is smaller than that in the structure shown in FIG. 6*c*, thereby obtaining larger section modulus. Therefore, the ventilation channel is strengthened structurally.

Figure 11A:
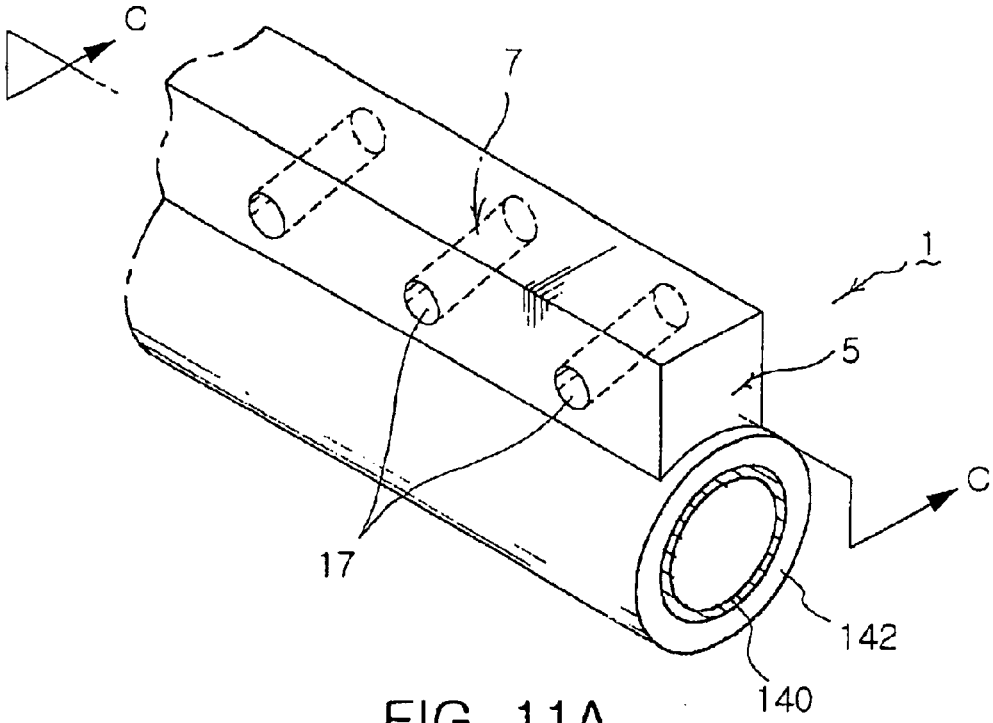
Figure 11B:
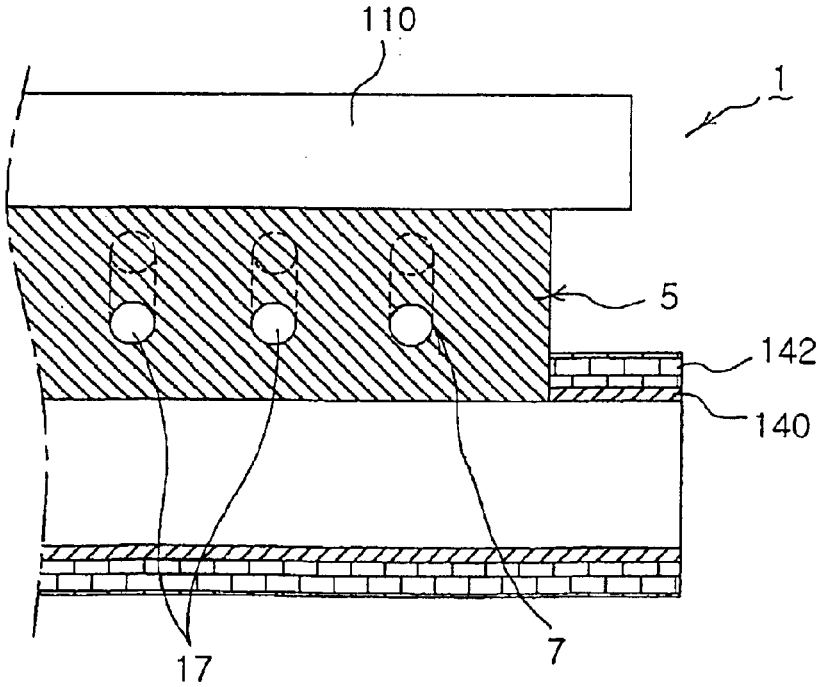

FIG. 11 illustrates a stationary rail-type skid apparatus adopting the structure shown in FIG. 10. The skid apparatus of this structure has a plurality of inclined vent holes 17 formed in a stationary rail-type skid member 5. It can be understood that the skid apparatus of this structure is also excellent in heat transfer ability and structural stability as described in conjunction with FIG. 10.

Figure 12A:
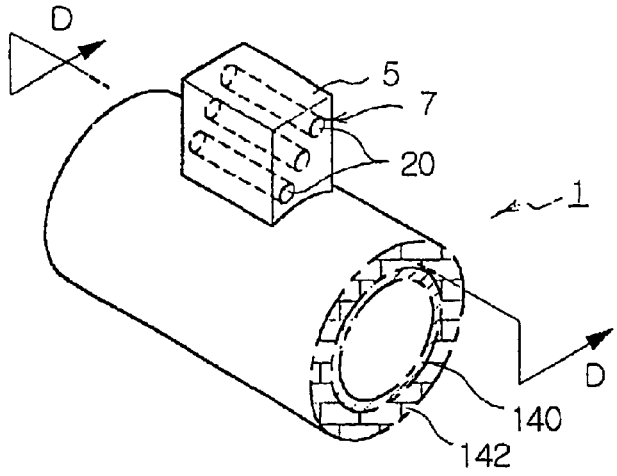
Figure 12B:
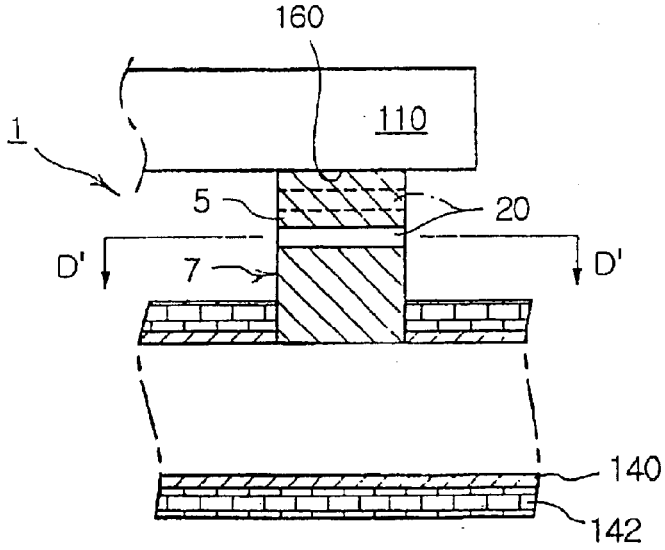

FIG. 12 also illustrates another alternative structure of the invention, in which a ventilation channel 7 includes a plurality of lateral vent holes 20 which are arranged parallel with one another from a lateral face to an opposite lateral face of a skid member 5. Where the plurality of or n number of lateral vent holes 20 are configured to have a total sectional area equal to that of the single lateral vent hole 10 as shown in FIG. 6, the quantity of hot gas within the reheating furnace passing through the lateral vent holes 20 is same as that of hot gas passing through the single lateral vent hole 10. However, the lateral vent holes 20 can achieve a heat-absorbing surface area larger than that of the single lateral vent hole 10.

That is, where n number of the lateral vent holes 20 have a diameter $d_1$ and have a total sectional area same as that of the single vent hole 10 shown in FIG. 6, they have a total heat transfer surface area which is expressed in following Equations 6 and 7:

$$n\times\pi d_1^2=\pi d^2 \rightarrow d_1=d/\sqrt{n}$$

$$A_d=\pi d\times 1$$

$$A_{d1}=n\times\pi_{d1}1=n\times\pi d\times 1/\sqrt{n} \qquad \text{Equation 6,}$$

and $$A_{d1}/A_d=n/\sqrt{n} \qquad \text{Equation 7,}$$

wherein n is the number of lateral vent holes, 1 is the length of each vent hole, $A_d$ is the inside surface area of the single lateral vent hole, and $A_{d1}$ is the total inside surface area of the plurality of lateral vent holes.

Therefore as can be seen from above Equations 6 and 7, the total inside surface area of the lateral vent holes is larger than the inside surface area of the single lateral vent hole 10 for n/√n times.

When total sectional area of the plurality of lateral vent holes 20 as shown in FIG. 12 is same as the sectional area of the single lateral hole 10 as shown in FIG. 6, the total inside surface area of the lateral vent holes 20 in contact with hot gas passing through the same is remarkably larger than the inside surface area of the single lateral hole 10. While the capability of the lateral vent holes 20 for allowing passage of hot gas is same as that of the single vent hole shown in FIG. 6, the surface area of the lateral vent holes 20 for absorbing heat from hot gas is remarkably larger than that of the single vent hole so that a large quantity of heat can be transferred from hot gas to the skid member 5 for a short time period.

Therefore, it can be understood that the structure in FIG. 12 has a heat absorbing ability more excellent than that of the structure in FIG. 6.

Figure 12C:
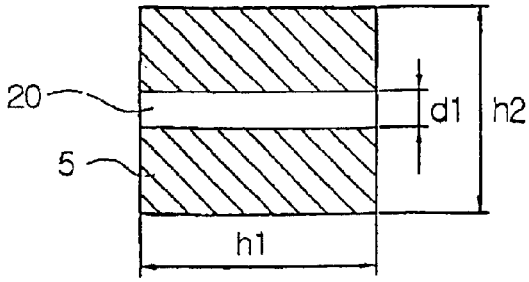

Moreover, as shown in FIG. 12*c*, the diameter of each lateral vent hole 20 defined in one planar section is smaller than that of the single lateral vent hole 10 shown in FIG. 6*c*, thus this structure can have a larger section modulus. As a result, this embodiment provides a more stable structure.

Figure 13A:
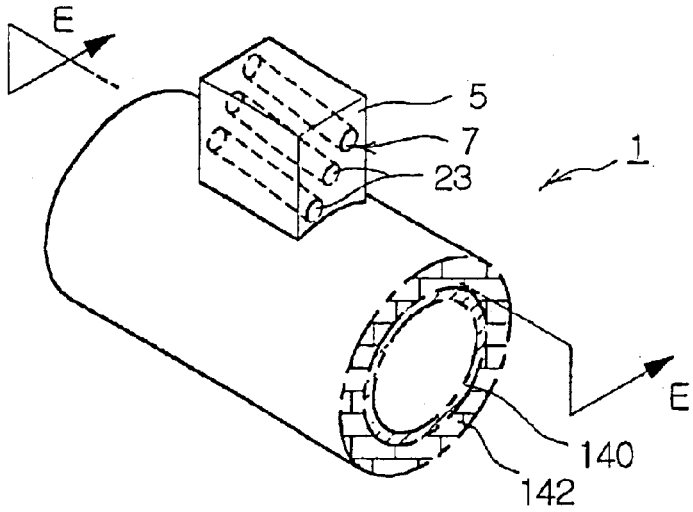
Figure 13B:
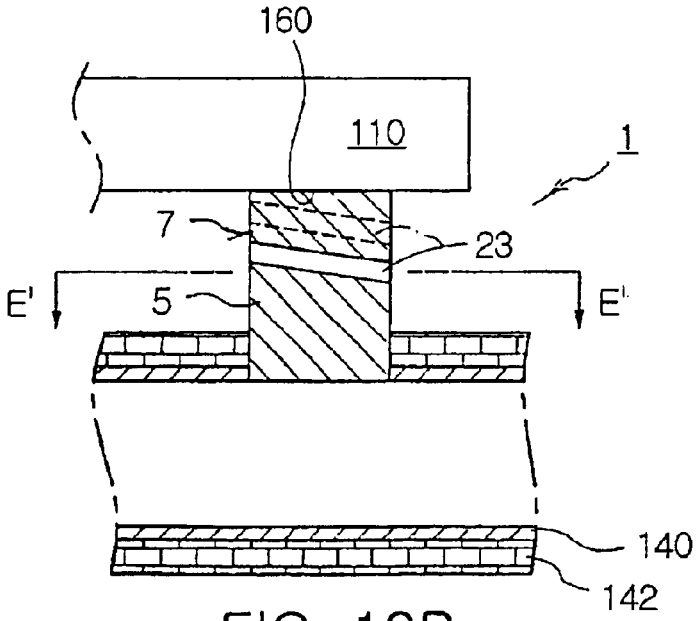
Figure 13C:
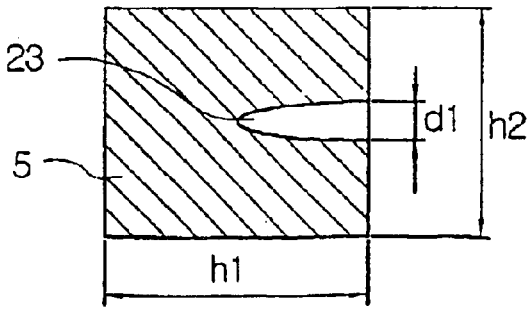

FIG. 13 illustrates another alternative structure of the invention which is also modified from the structure in FIG. 12. This alternative structure has ventilation channels 7 constituted of a plurality of lateral vent holes 23 which are inclined from a face to an opposite face, e.g., from a front face to a rear face of a skid member 5. In this inclined structure of the lateral vent holes 23, the heat transfer area defined by the lateral vent holes 23 is realized larger than that of FIG. 12. Also, as shown in FIG. 13*c*, this structure can obtain a section modulus larger than that shown in FIG. 10. As a result, this embodiment allows this structure to be more stable.

Figure 14A:
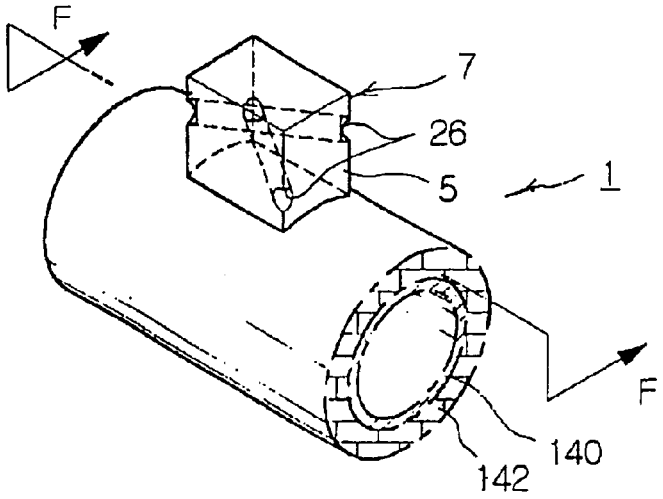
Figure 14B:
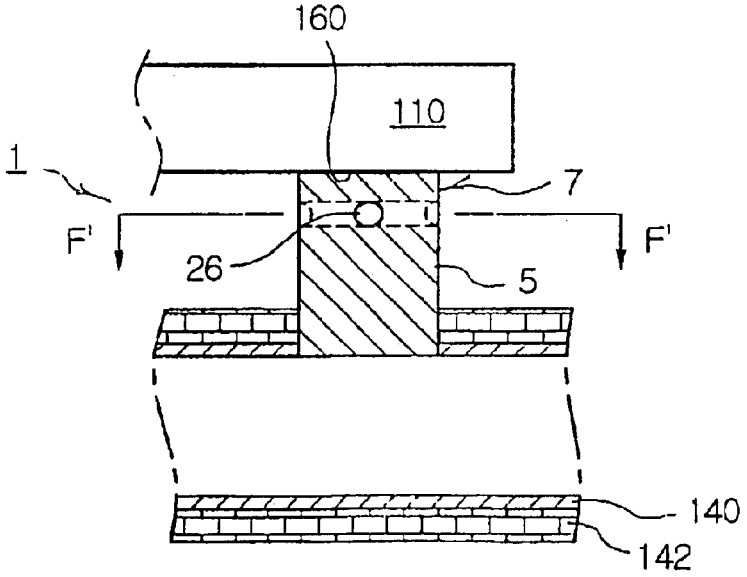

FIG. 14 illustrates another alternative structure of the invention, in which at least lateral vent holes 26 of ventilation channels 7 are oriented along diagonals of a skid member 5, crossing each other. In this embodiment, n number of the lateral vent holes 26 each having a diameter $d_2$ are formed to have a total sectional area which is equal to that of the single lateral vent hole 10 having a diameter d as shown in FIG. 6. The lateral vent holes 26 are crossed with each other rather than oriented in a same direction to allow more efficient passage or introduction of hot gas, in case that hot gas flows in various directions rather than one direction within the reheating furnace 100.

Figure 14C:
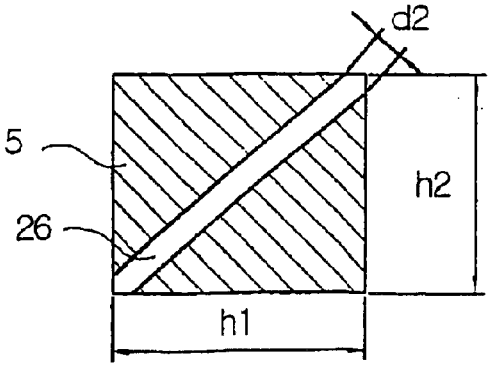

As shown in FIG. 14*c*, since the diameter $d_2$ of each lateral vent hole 26 is remarkably smaller than the diameter d of the single lateral vent hole 10, this structure has a larger section modulus and thus is more stable over the structure in FIG. 6.

Figure 15A:
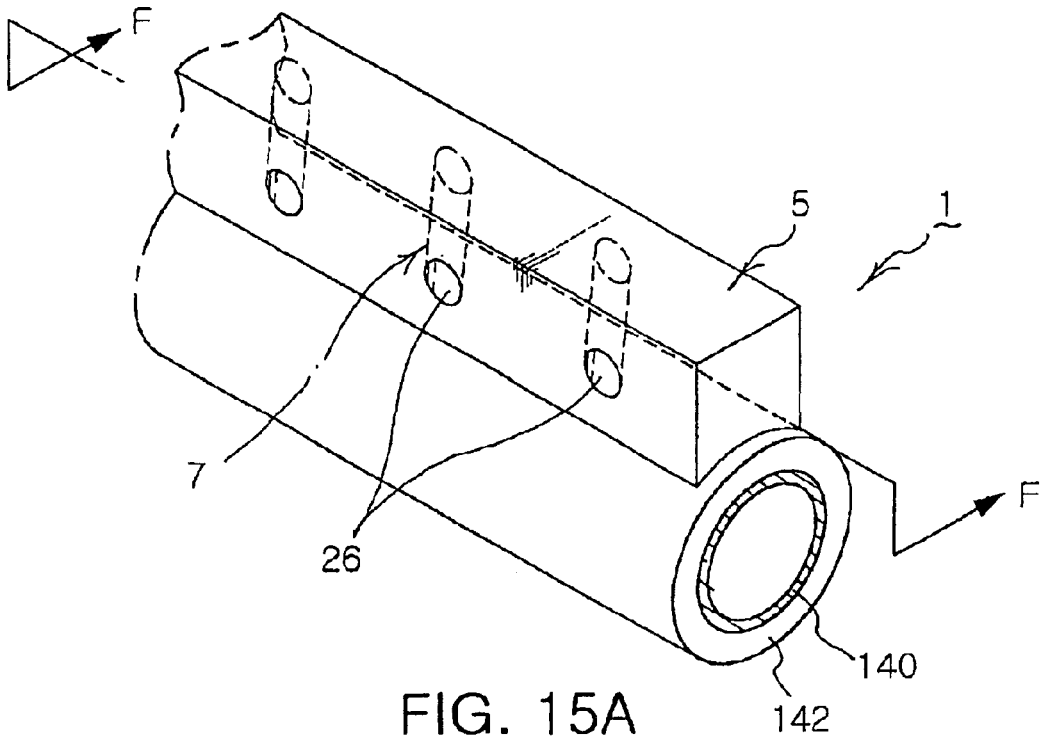
Figure 15B:
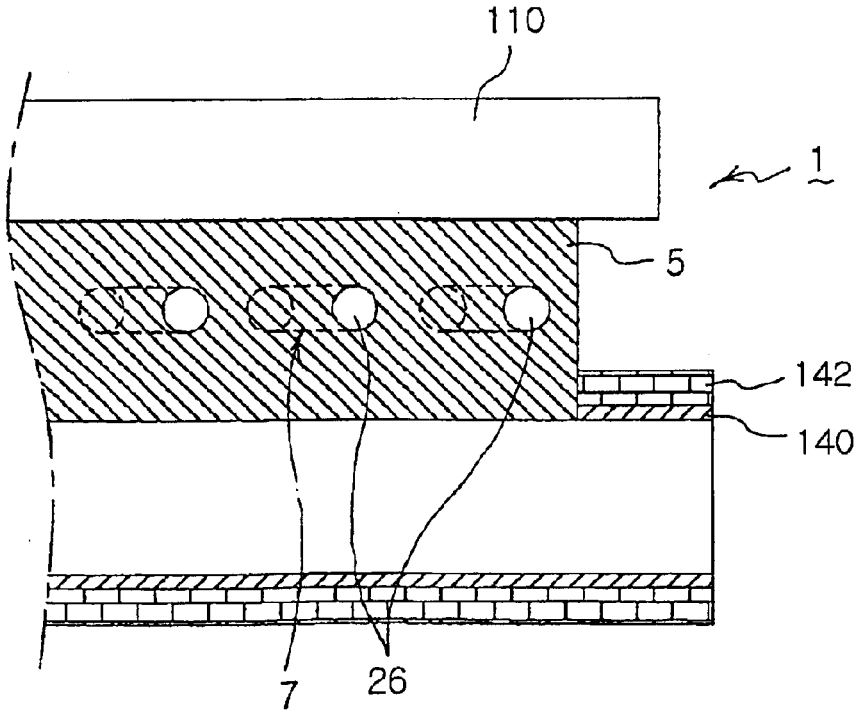

FIG. 15 illustrates a stationary rail-type skid apparatus adopting the structure shown in FIG. 14. This structure includes a ventilation channel 7 constituted of a plurality of inclined vent holes 26 formed diagonally in a stationary rail-type skid member 5. This embodiment is also excellent in heat transfer ability as well as structural stability as described in conjunction with FIG. 14.

Figure 16A:
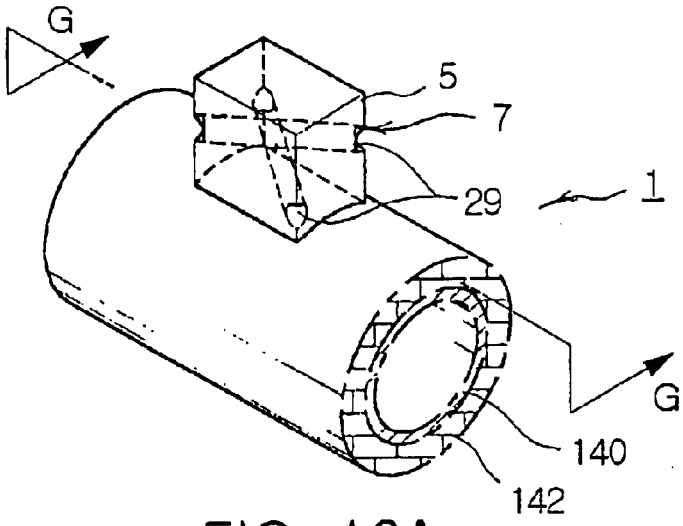
Figure 16B:
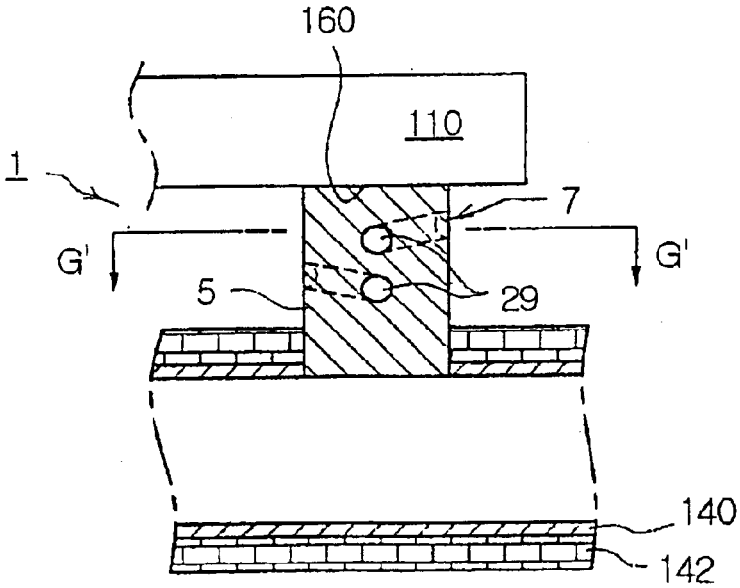
Figure 16C:
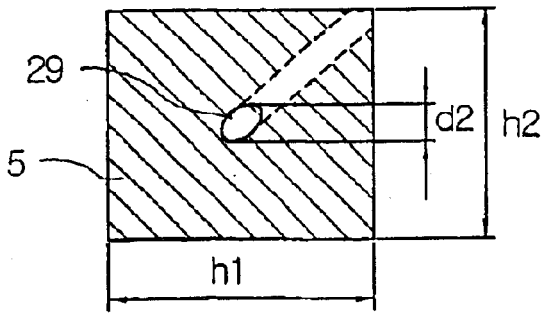

FIG. 16 illustrates a further another alternative structure of the invention in which lateral vent holes 29 of a ventilation channel 7 are arranged one above the other alternating with each other in addition to the structure shown in FIG. 14. This structure of the invention allows more efficient passage or introduction of hot gas where hot gas flows in various directions rather than one direction within the reheating furnace 100 as described in conjunction with FIG. 14. Also, this structure is increased in heat transfer area and strengthened in section over the structure in FIG. 14, and thus excellent in heat transfer ability as well as in stability.

Figure 17A:
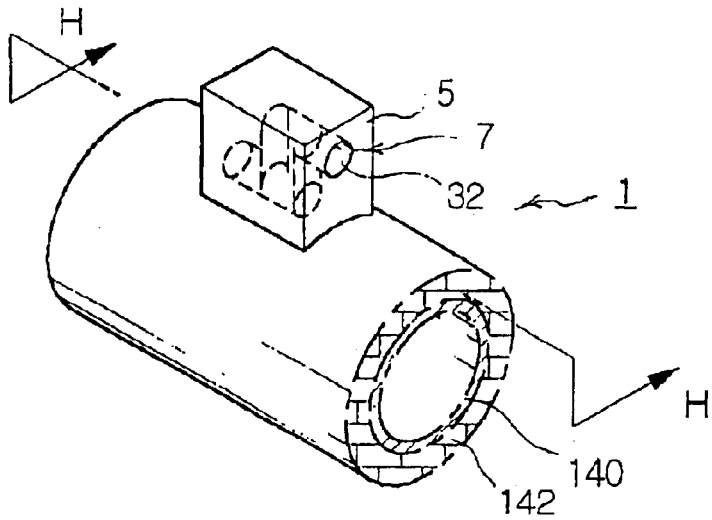
Figure 17B:
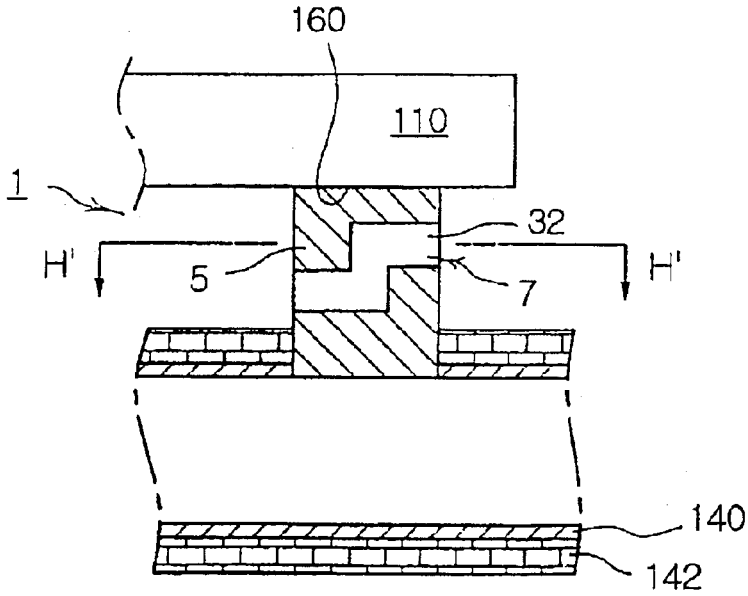
Figure 17C:
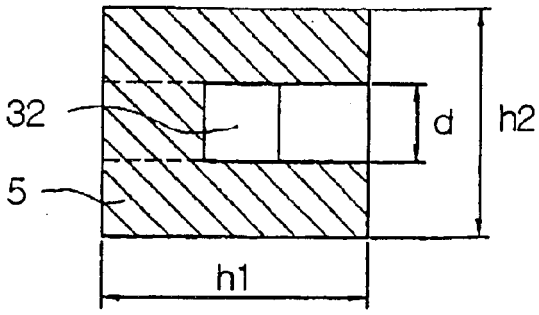

FIG. 17 illustrates another alternative structure of the invention in which lateral vent holes 32 are formed at various heights in front and rear faces of a skid member 5 communicating with each other in the skid member 5 to form a ventilation channel 7 between the front and rear faces of the skid member 5. Therefore, this structure can allow passage of hot gas at a rate equal to that of the structure in FIG. 6, and its heat transfer area is larger than that of the structure in FIG. 6. At the same time, as shown in FIG. 17*c*, this embodiment has a more enhanced section modulus and thus has a more stable structure.

Figure 18A:
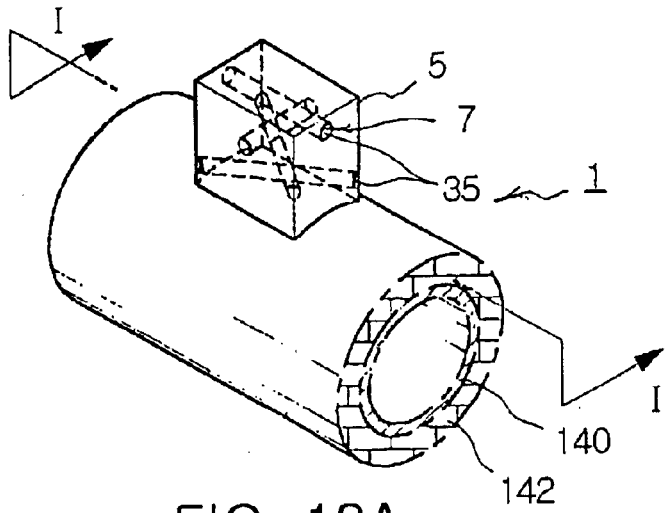
Figure 18B:
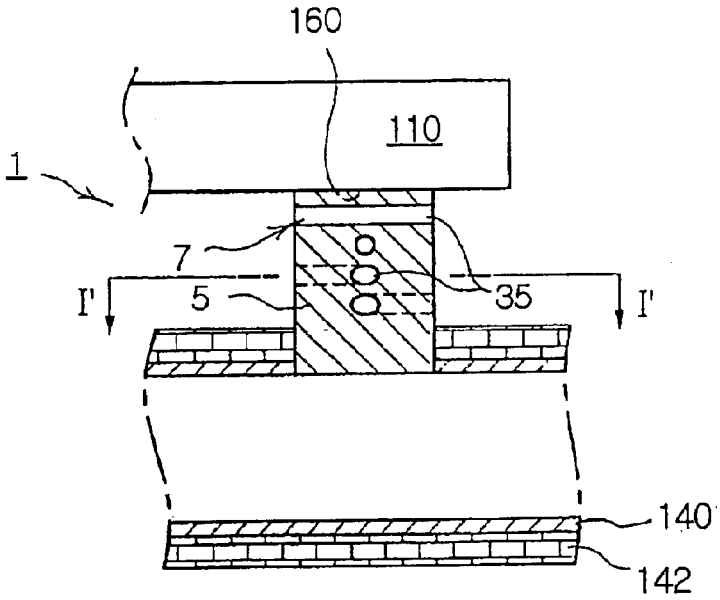

Further, FIG. 18 illustrates a further another alternative embodiment of the invention which is modified from the structure in FIG. 14. In this embodiment, a first set of lateral vent holes 35 are arranged diagonally one above another alternating with one another in a skid member 5, and a second set of lateral vent holes 35 are formed over the first set of lateral vent holes, arranged one above the other alternating with each other and extended toward opposed lateral faces of the skid member 5, in order to form ventilation channels 7. The plurality of lateral vent holes 35 are extended toward the lateral faces of the skid member 5 alternating with one another instead of being oriented in a same direction to allow more efficient passage or introduction of hot gas where hot gas forms turbulent flow in various directions rather than one direction within the reheating furnace 100.

Figure 18C:
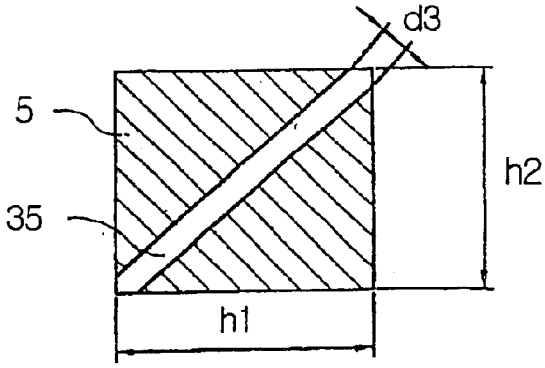

As shown in FIG. 18*c*, the diameter $d_3$ of each vent hole 35 is remarkably smaller than the diameter d of the structure in FIG. 6. This is useful since this structure can be structurally intensified.

Figure 19A:
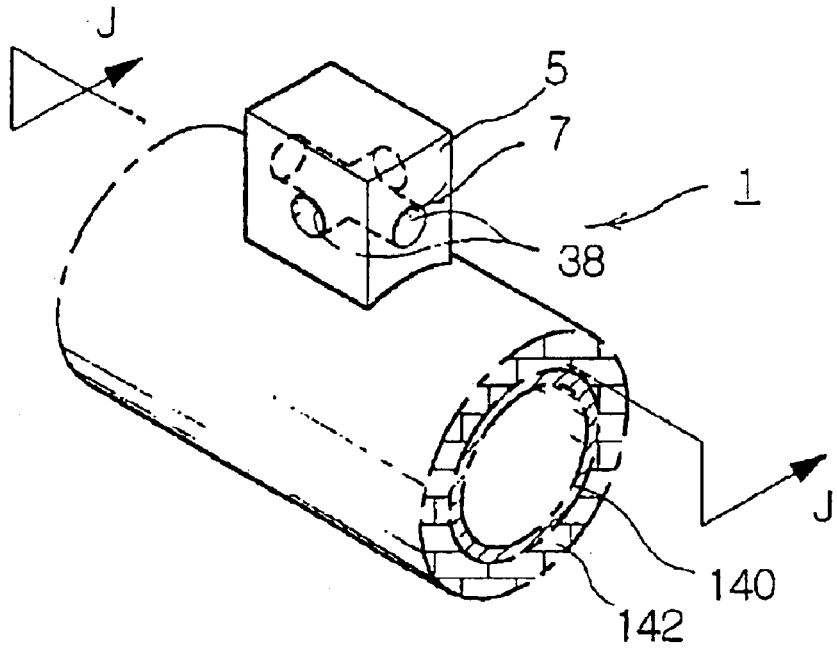
Figure 19B:
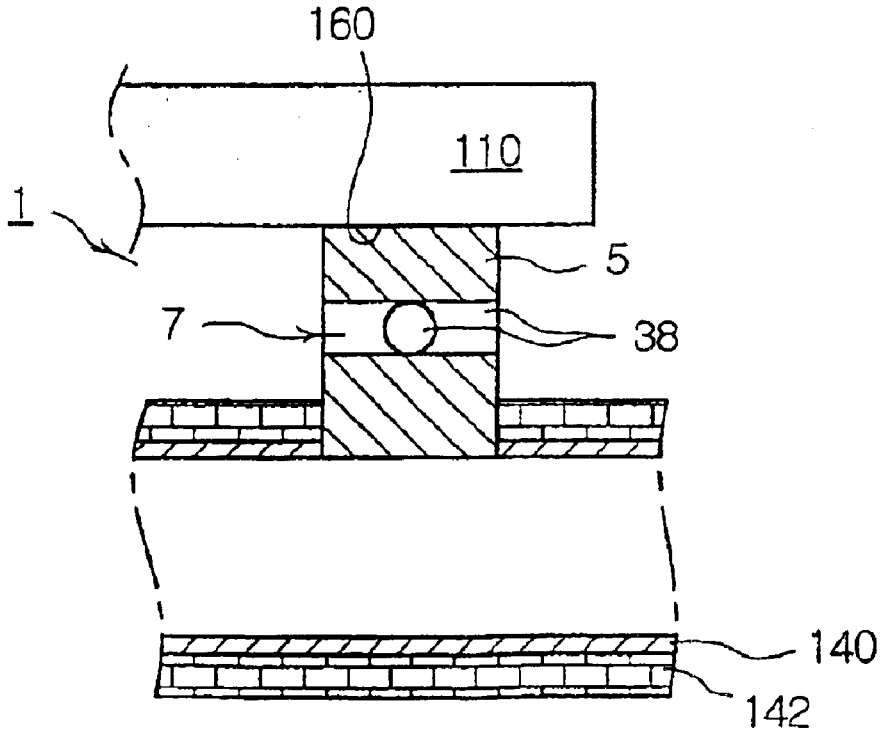

FIG. 19 illustrates another alternative embodiment of the invention, in which a plurality of crossed lateral vent holes 38 which are extended through opposed lateral faces to intersect each other at a same height in a skid member 5 to form a ventilation channel 7. There are advantages in that this structure also can allow more efficient passage or introduction of hot gas where hot gas forms turbulent flow in various directions within the reheating furnace 100 and its section modulus can be further intensified structurally.

Figure 20A:
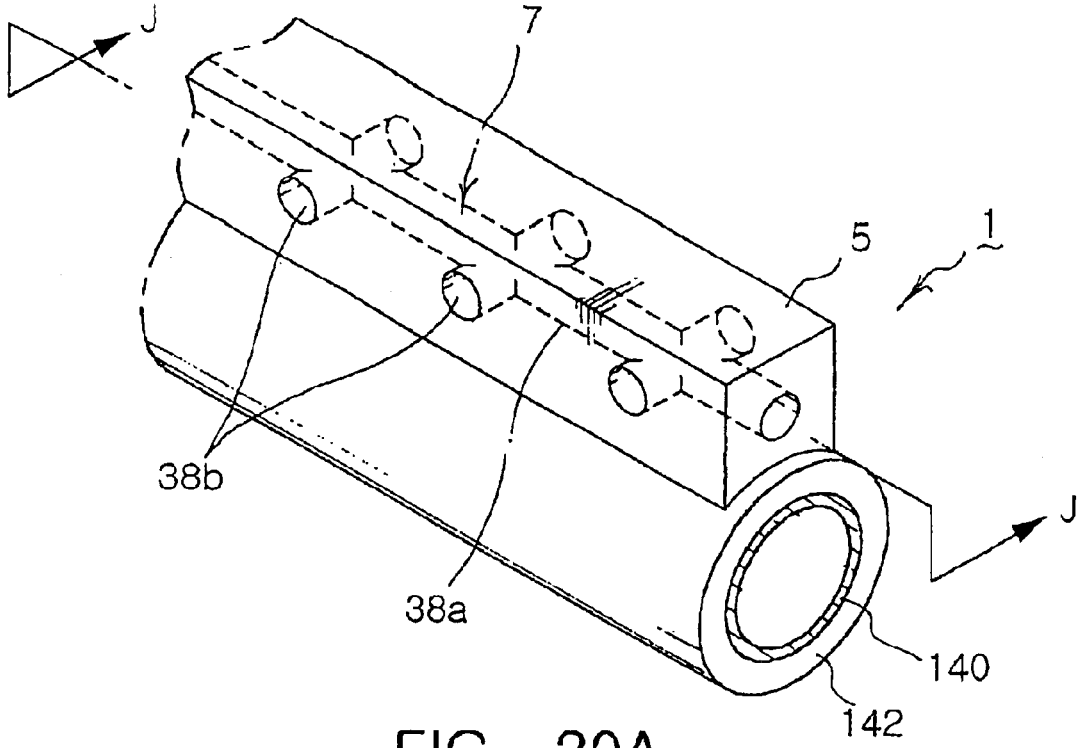
Figure 20B:
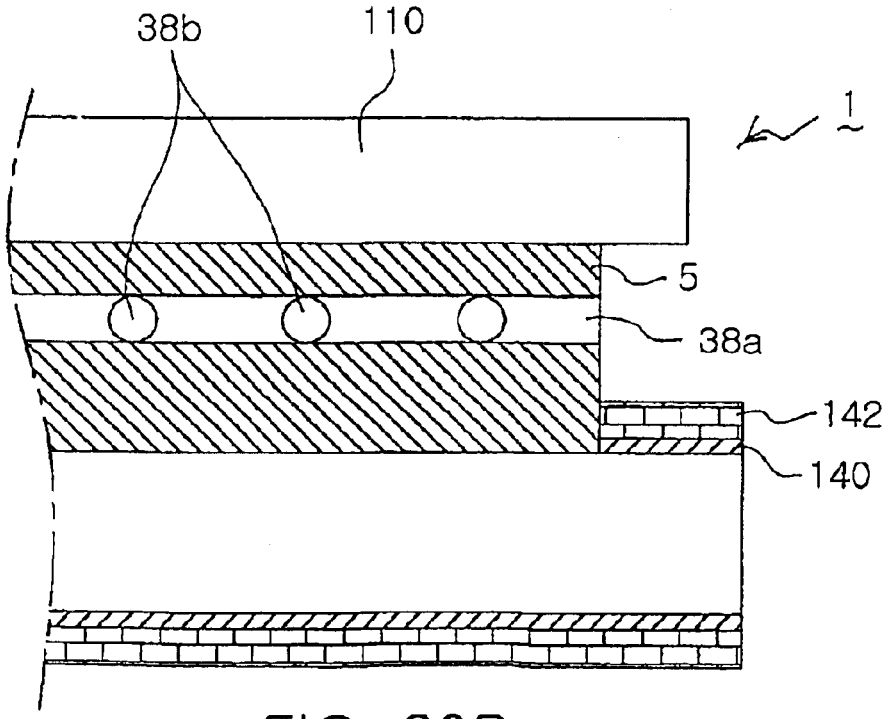

FIG. 20 illustrates a stationary rail-type skid apparatus adopting the structure shown in FIG. 19, in which a vent hole 38*a* is formed longitudinally and a plurality of vent holes 38*b* are formed laterally from the vent hole 38*a* in a stationary rail-type skid member 5. It can be understood that the skid apparatus of this structure also has excellent ability for reducing heat transfer and structural stability as described in conjunction with FIG. 19.

Figure 21A:
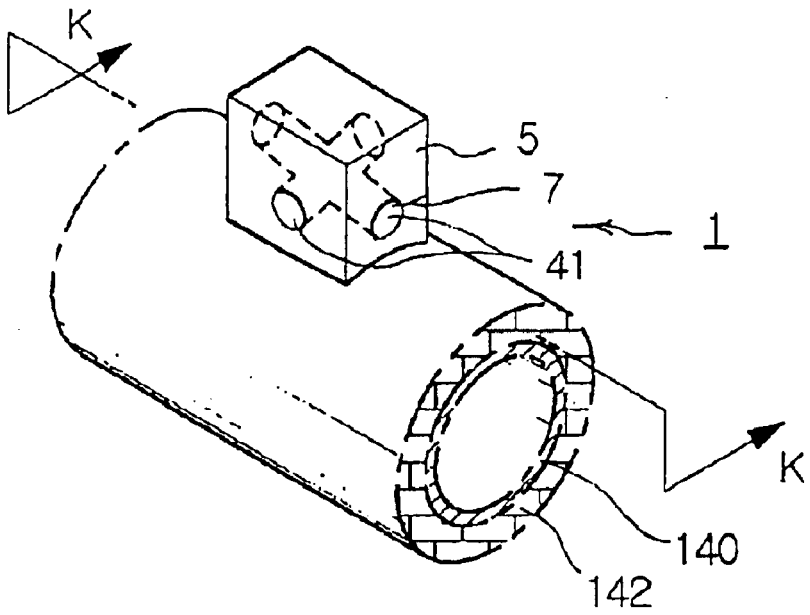
Figure 21B:
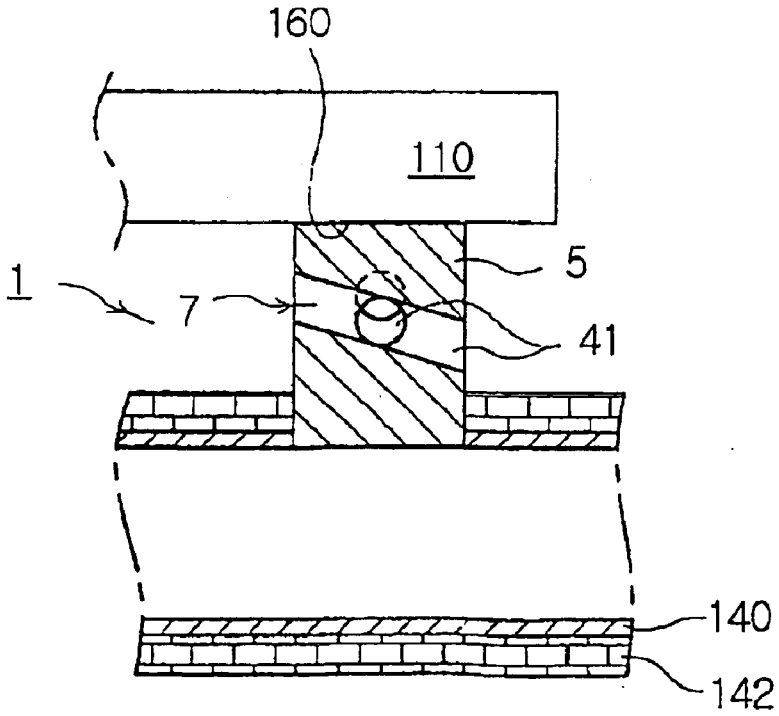

FIG. 21 illustrates another alternative embodiment of the invention, in which lateral vent holes 41 are formed in a skid member 5 to form a ventilation channel 7. The vent holes 41 each are inclined from one face to an opposite face, crossing each other. There are advantages in that this embodiment also can allow more efficient passage or introduction of hot gas where hot gas forms turbulent flow in various directions within the reheating furnace 100, and have a heat transfer area larger than that of FIG. 19. Also, the section modulus of this embodiment can be further intensified structurally.

Figure 22A:
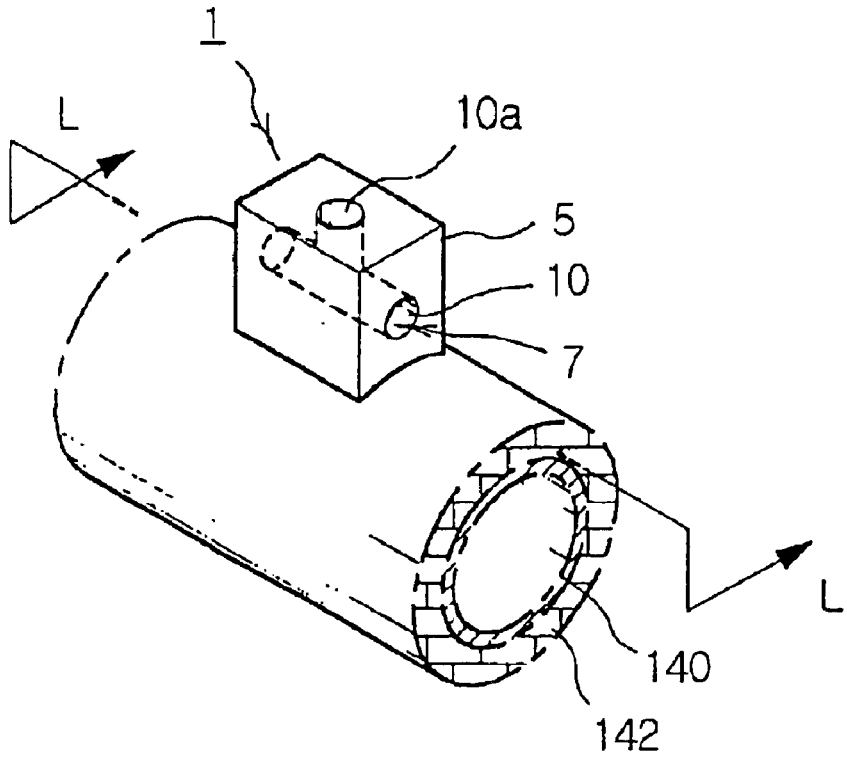
Figure 22B:
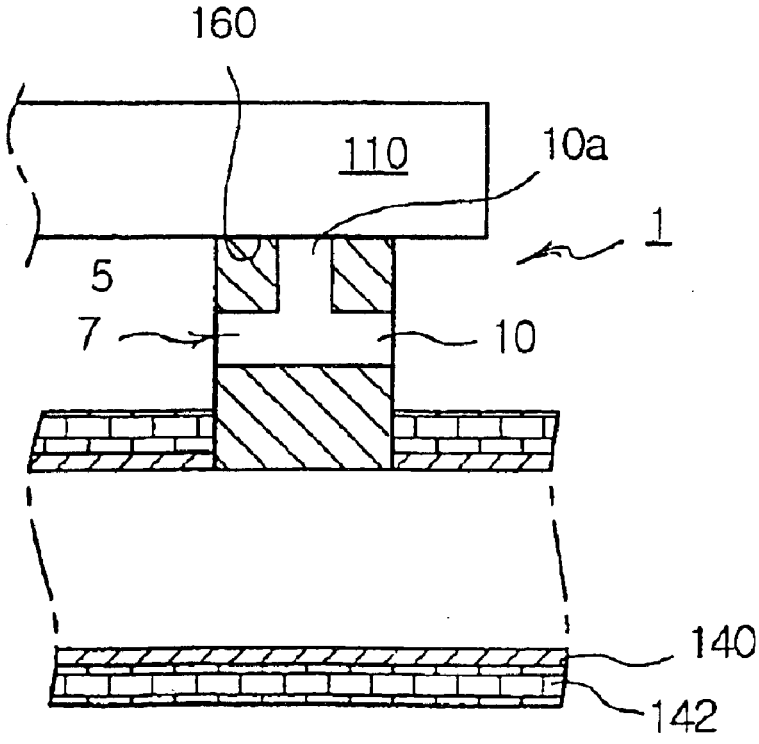

FIG. 22 illustrates a skid apparatus 1 according to another alternative embodiment of the invention. The skid apparatus 1 comprises a lateral vent hole 10, which is horizontally extended through a skid member and a vertical vent hole 10*a* extended from the horizontal lateral vent hole 10 to a top face of the skid member to form a ventilation channel 7.

The vertical vent hole 10*a* in this structure allows hot gas within the reheating furnace to directly contact a skid upper portion 162 and an underside contact region of the hot material 110. Therefore, unlike the structure shown in FIG. 6, this structure has excellent performance for directly heating the skid upper portion 162 and the contact region of the hot material 110 to further raise the temperature of the hot material thereby further reducing any temperature difference associated with the skid mark. Furthermore, this structure can remarkably reduce any vertical temperature variation in the hot material in contact with the skid member.

Figure 23A:
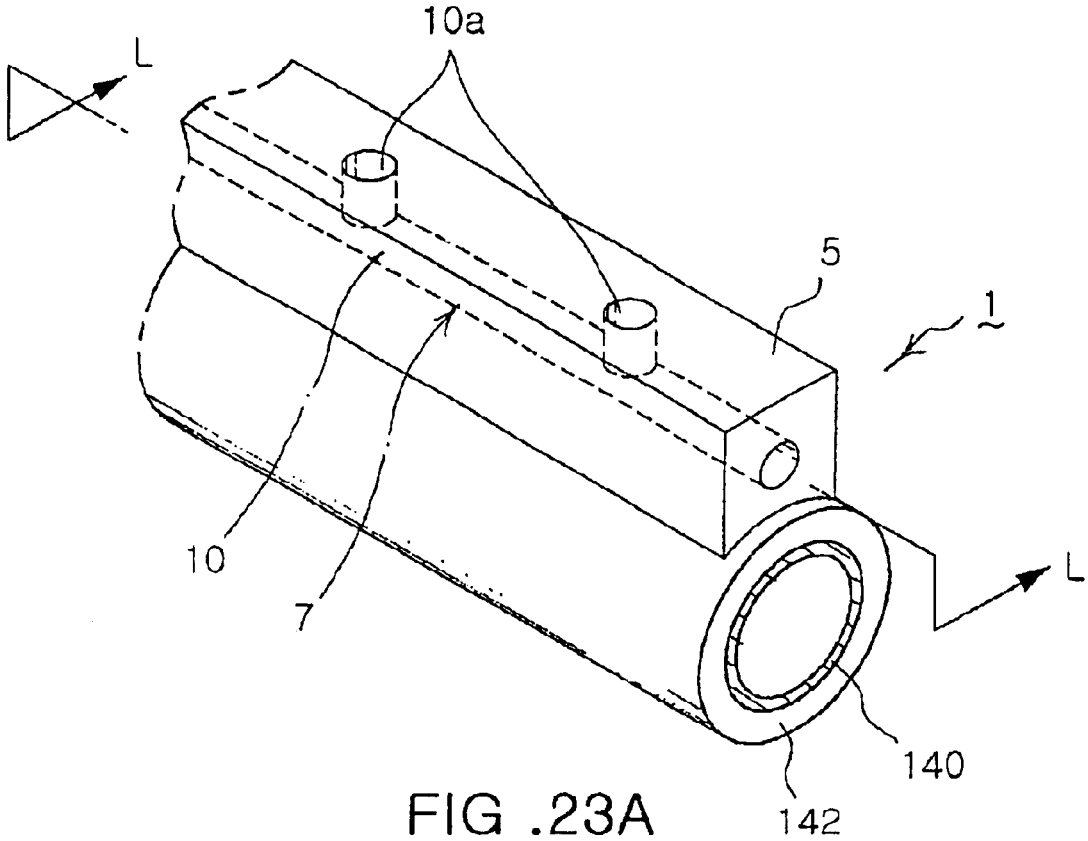
Figure 23B:
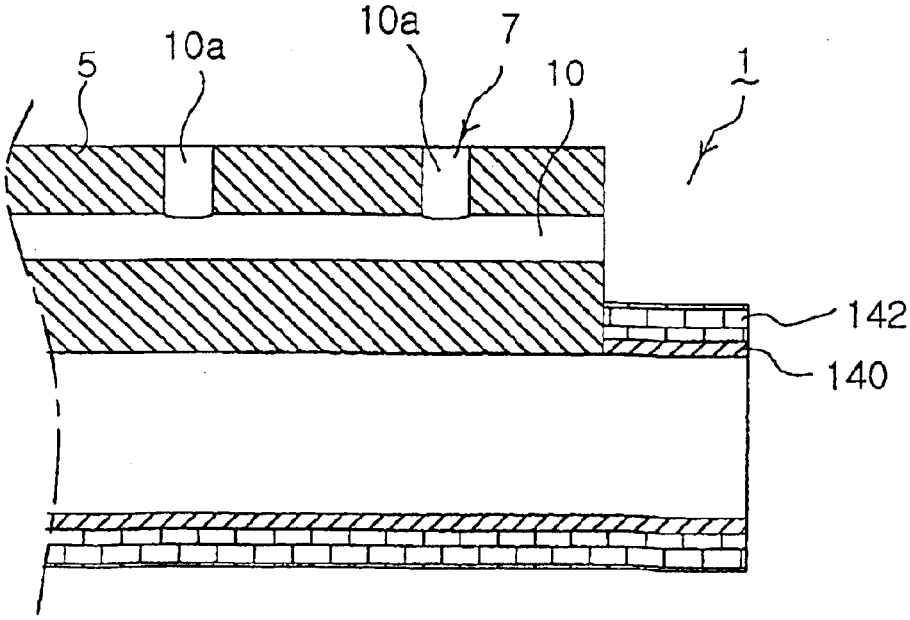

FIG. 23 illustrates a stationary rail-type skid apparatus as an alternative to the structure shown in FIG. 22. This stationary rail-type skid apparatus comprises a vent hole 10 extended longitudinally in a skid member 5 and a plurality of vertical vent holes 10*a* extended from the longitudinal vent hole 10 to a top face of the skid member 5. This embodiment is also excellent in heat transfer ability as well as structural stability as described in conjunction with FIG. 22.

Figure 24A:
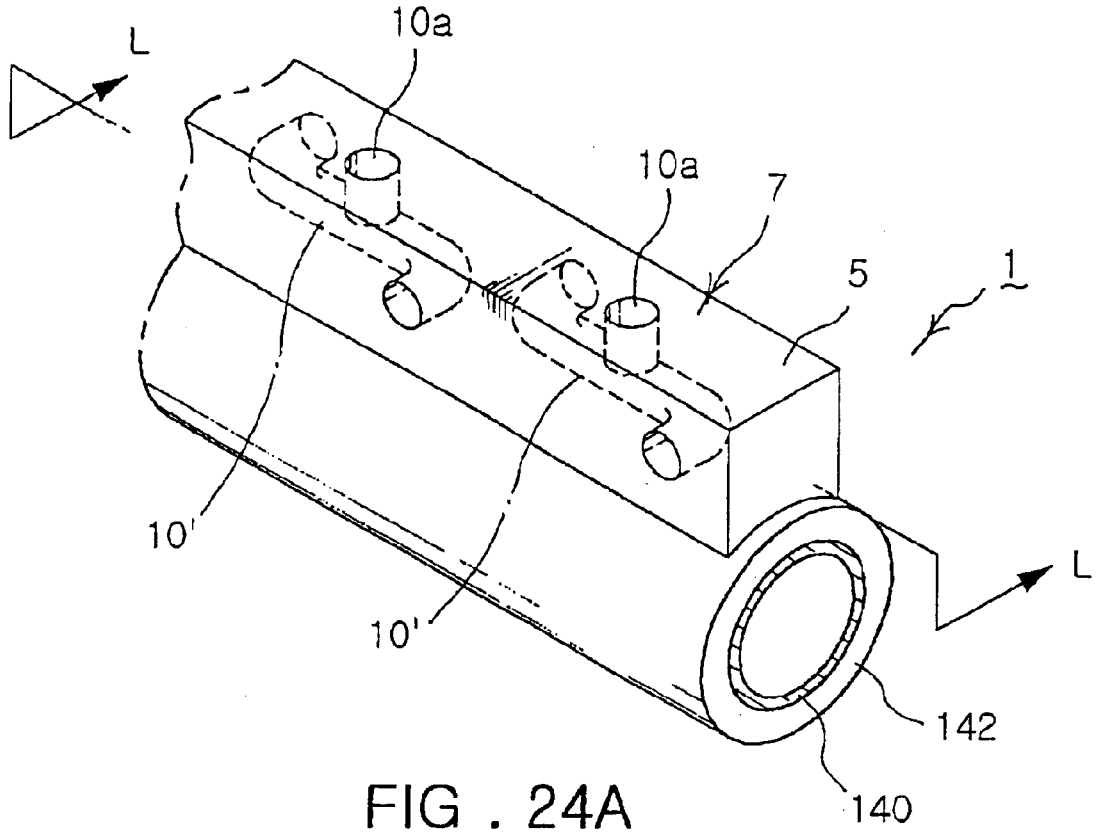
Figure 24B:
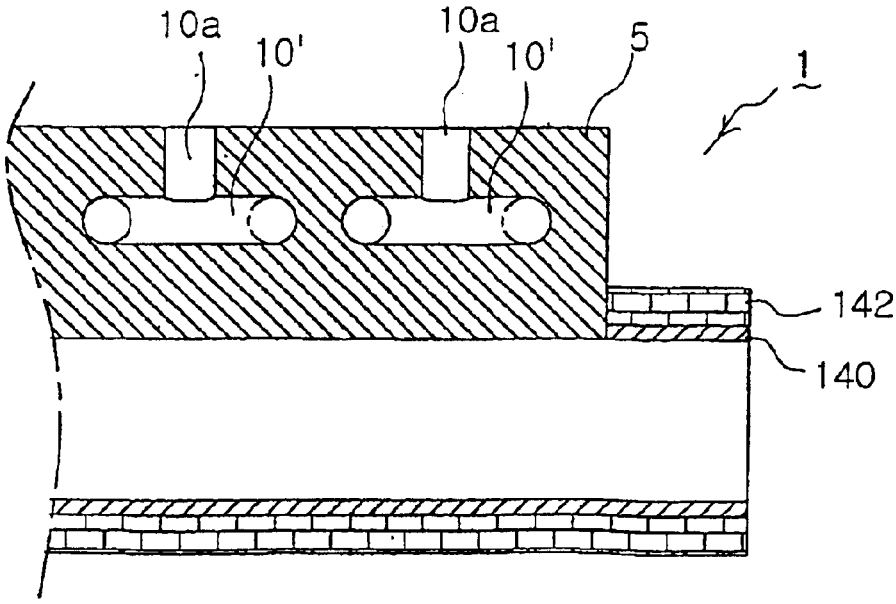

FIG. 24 illustrates a stationary rail-type skid apparatus as another alternative to the structure shown in FIG. 22. This stationary rail-type skid apparatus comprises a plurality of longitudinal vent holes 10' which are extended longitudinally in a skid member 5 with both ends opened to sides of the skid member 5 and vertical vent holes 10*a* extended from the longitudinal vent holes 10' to a top face of the skid member. This embodiment is also excellent in heat transfer ability as well as structural stability as described in conjunction with FIG. 22.

Figure 25A:
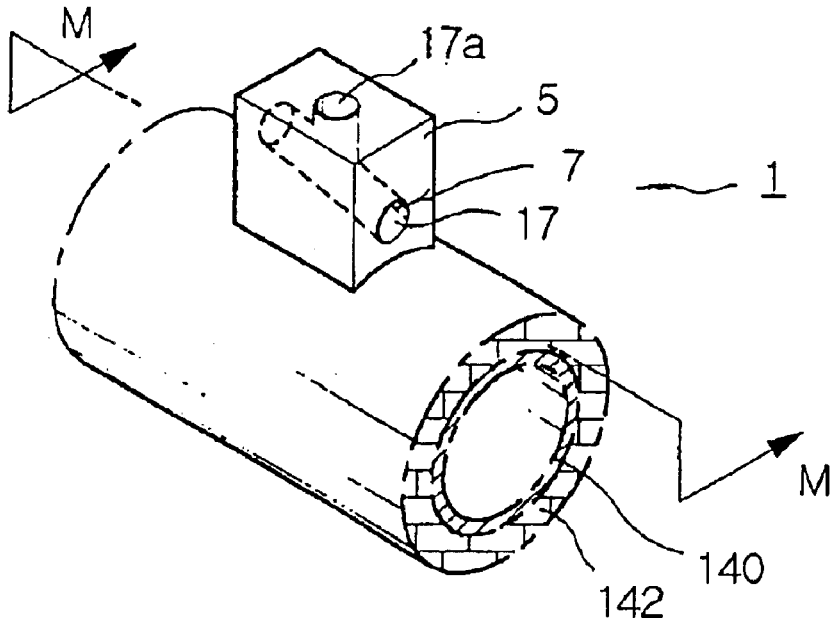
Figure 25B:
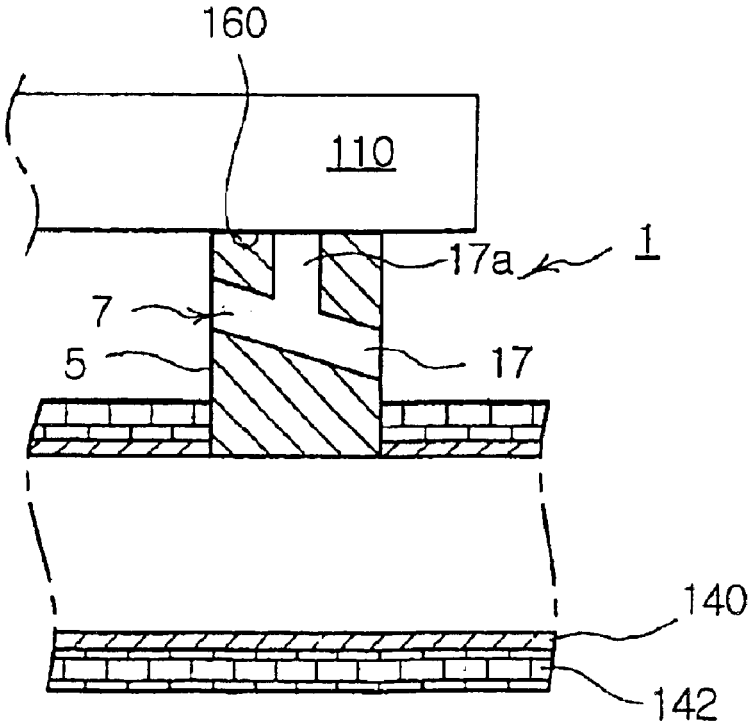

FIG. 25 illustrates a skid apparatus as further another alternative to the structure shown in FIG. 22. This skid apparatus comprises an inclined lateral vent hole 17 formed in a skid member 5 and a vertical vent hole 17*a* extended from the lateral vent hole 17 to a top face of the skid member 5. It can be understood that this embodiment is also excellent in heating ability similar to that of FIG. 22.

Figure 26A:
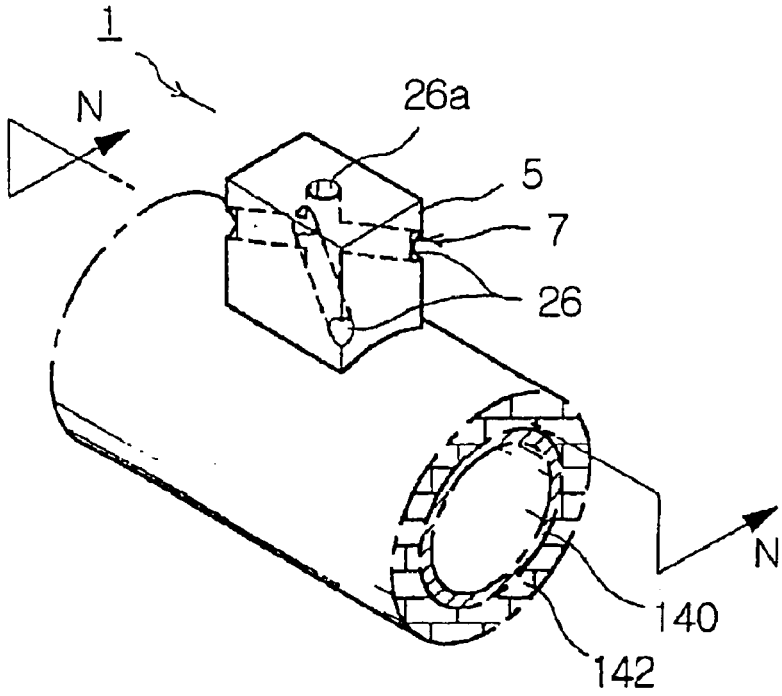
Figure 26B:
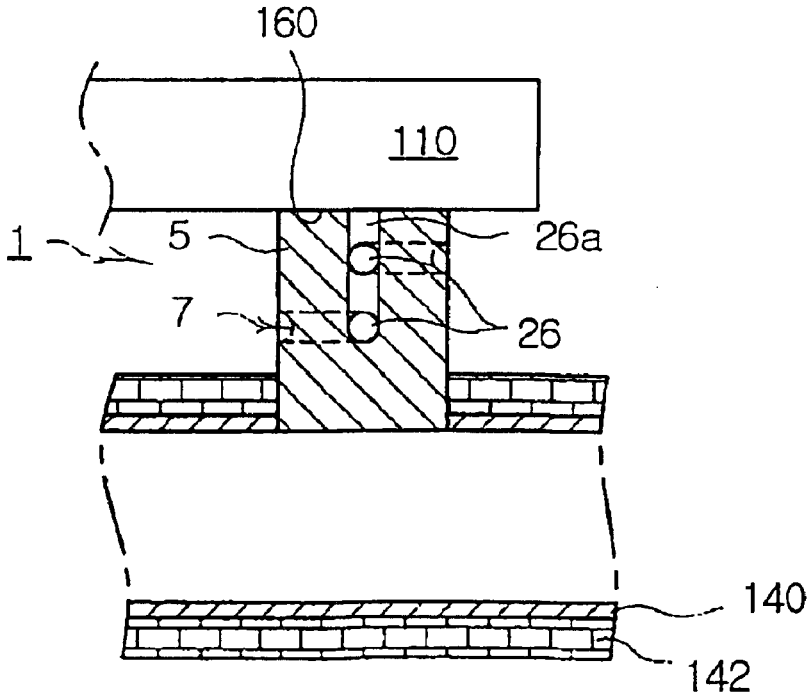

FIG. 26 illustrates an another alternative embodiment of the invention which comprises a plurality of lateral vent holes 26 which are formed diagonally at different heights in a skid member 5 and intersected with each other and a vertical vent hole 26*a* extended from the lateral vent holes 26 to a top face of the skid member 5 to form a ventilation channel 7. This embodiment is also excellent in heat transfer ability as well as structural stability as described in conjunction with FIG. 22.

Figure 27A:
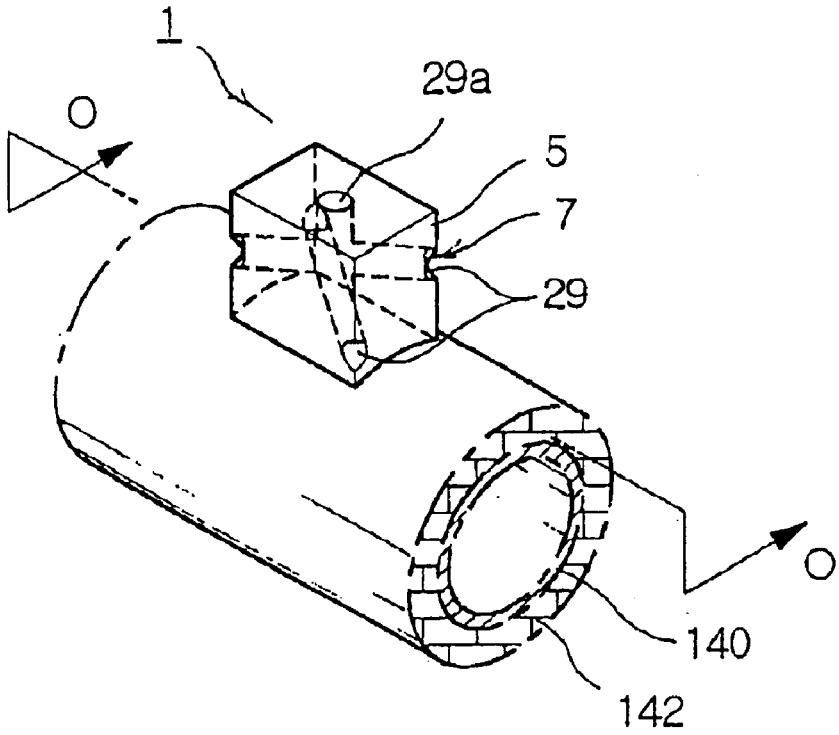
Figure 27B:
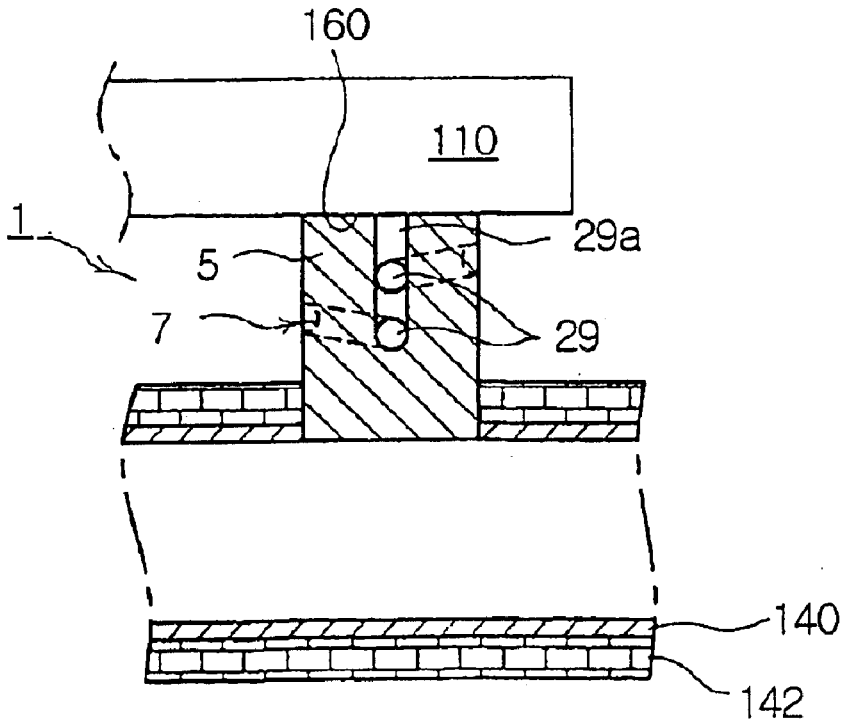

FIG. 27 illustrates an alternative to the skid apparatus shown in FIG. 26 according to the invention. This skid apparatus comprises a plurality of inclined lateral vent holes 29 which are formed diagonally at different heights in a skid member 5 and intersected with each other and a vertical vent hole 29*a* extended from the inclined vent holes 29 to a top face of the skid member 5 to form a ventilation channel 7. This structure is also excellent in heating ability and strength.

Figure 28A:
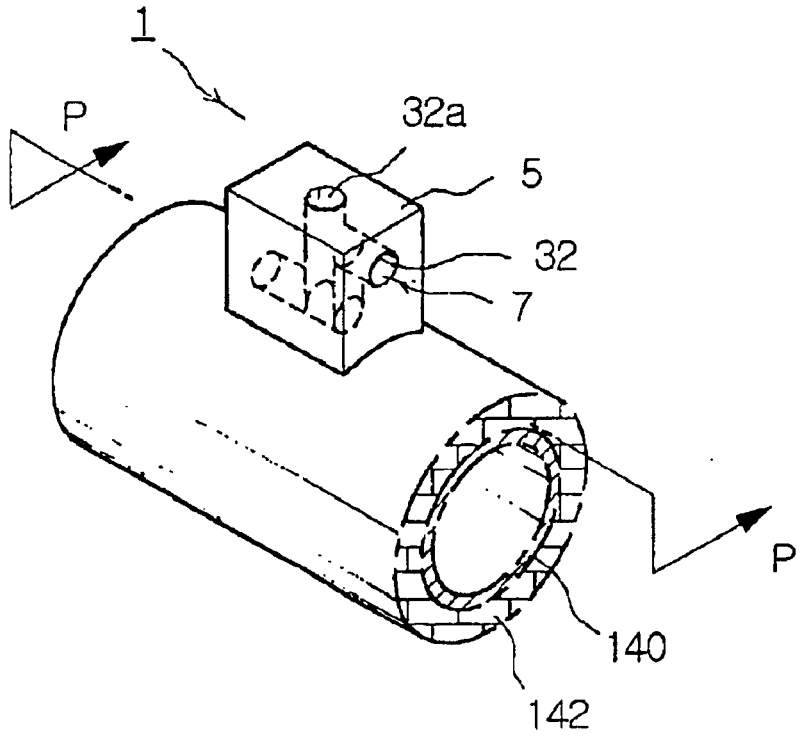
Figure 28B:
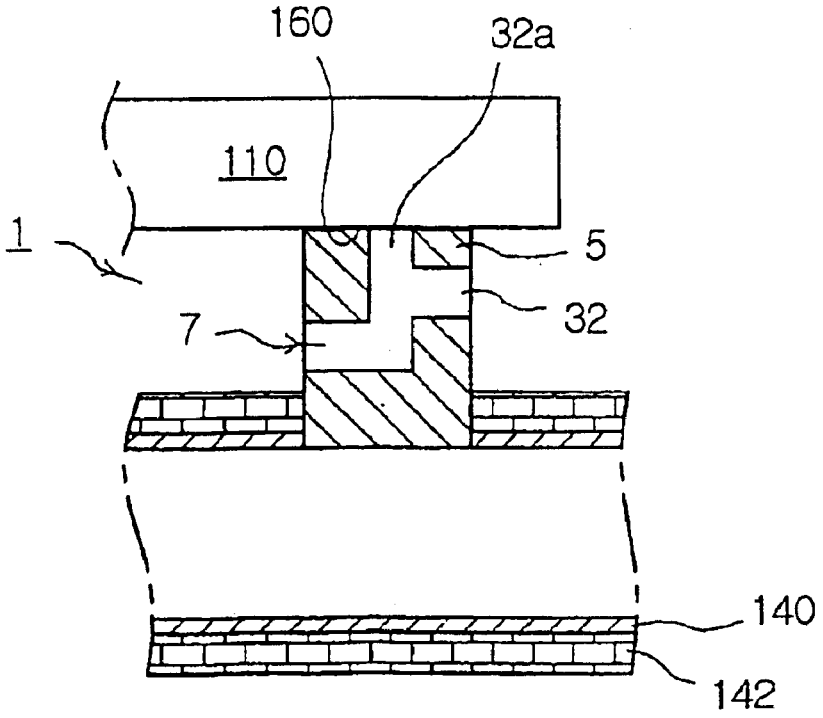

FIG. 28 illustrates an alternative to the skid apparatus shown in FIG. 17 according to the invention. This skid apparatus comprises a plurality of lateral vent holes 32 formed at different heights in a skid member 5 and a vertical vent hole 32*a* extended from the lateral vent holes 32 in a communicating type to a top face of the skid member 5 thereby forming a ventilation channel 7. This embodiment has an excellent heating ability over the embodiment shown in FIG. 17.

Figure 29A:
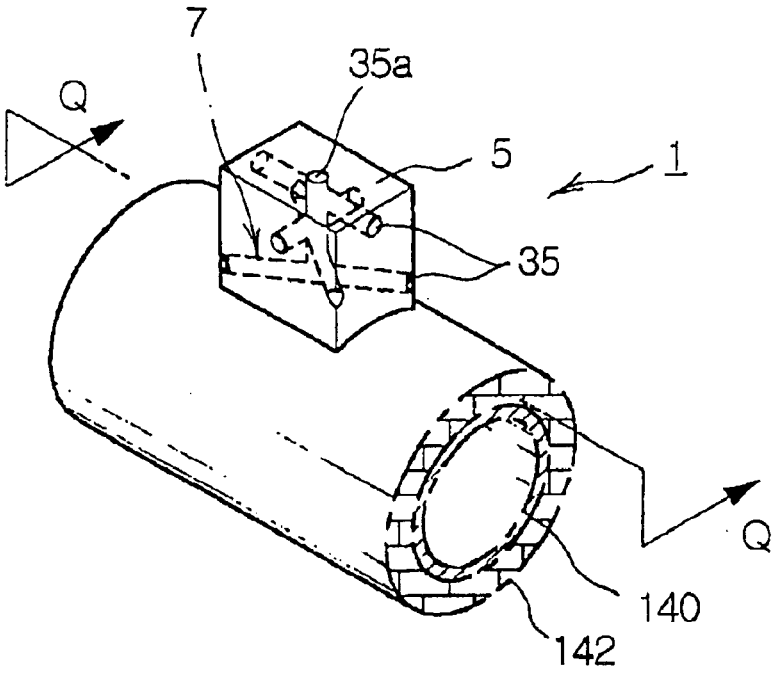
Figure 29B:
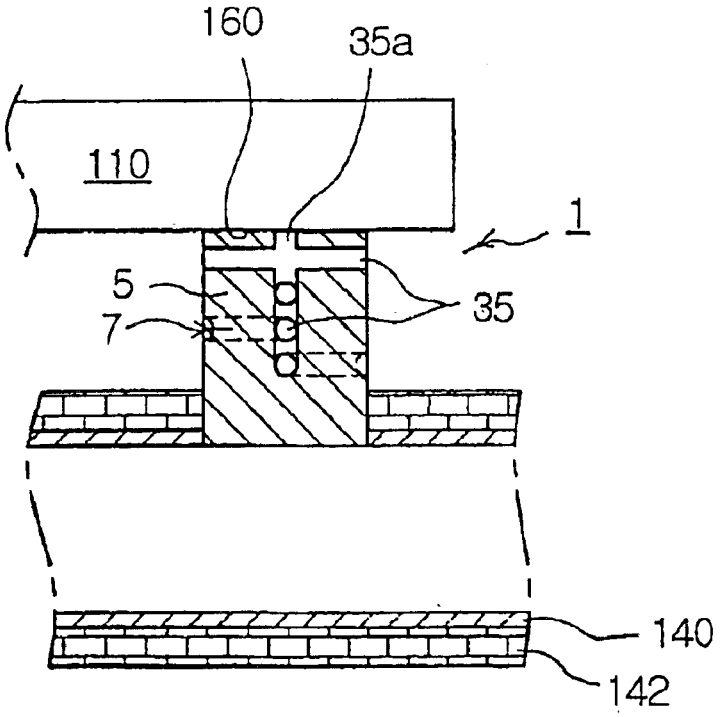

FIG. 29 is an detailed view of an another alternative to the skid apparatus shown in FIG. 18 according to the invention. This skid apparatus comprises a first set of lateral vent holes 35 which are arranged diagonally one above the other alternating with each other, a second set of upper lateral vent holes 35 which are arranged diagonally one above the other alternating with each other and a vertical vent hole 35*a* extended from the lateral vent holes 35 to a top face of the skid member 5 to form a ventilation channel 7. This embodiment has an excellent heating ability over the embodiment shown in FIG. 18.

Figure 30A:
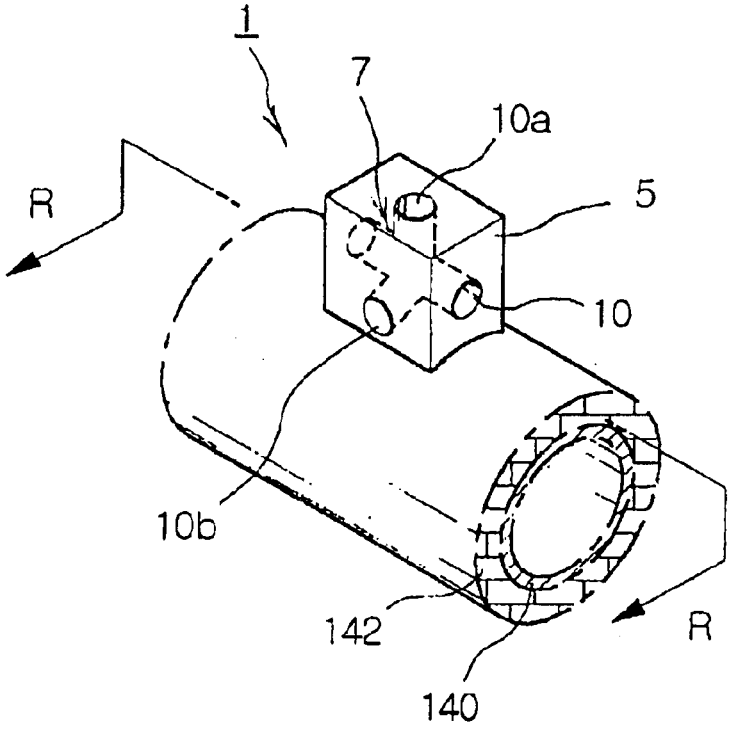
Figure 30B:
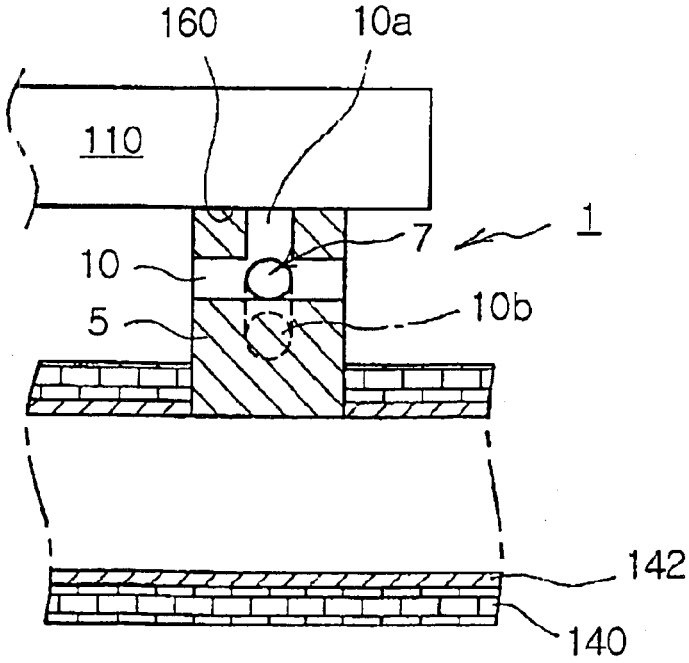

FIG. 30 illustrates another alternative to the skid apparatus shown in FIG. 22 according to the invention. This skid apparatus comprises a horizontal lateral vent hole 10 extended through a skid member 5, a vertical vent hole 10*a* extended from the horizontal vent hole 10 to a top face of the skid member 5 and a scale exit hole 10*b* which is extended downward from the holes 10 and 10*a* to a side of the skid member 5 to form a ventilation channel 7. This embodiment can effectively remove foreign materials such as scale through the scale exit hole 10*b* out of the ventilation channel 7 and achieve more effective circulation of hot air while realizing an excellent heating effect toward the skid upper portion 161 as in FIG. 22.

Figure 31A:
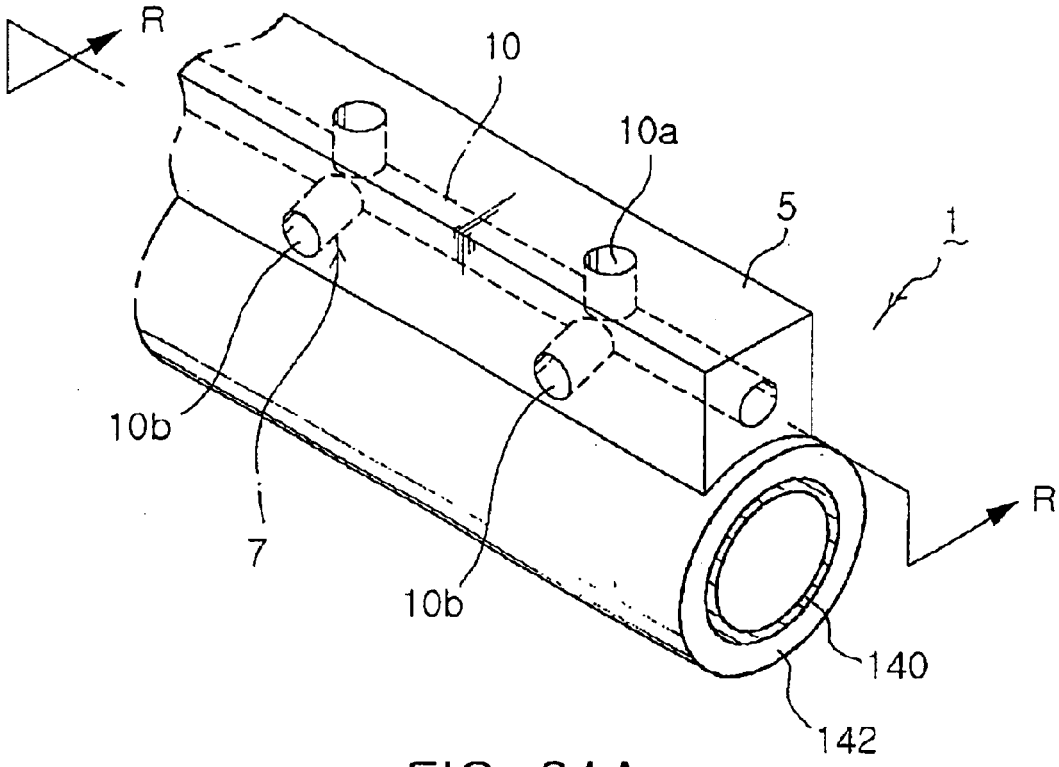
Figure 31B:
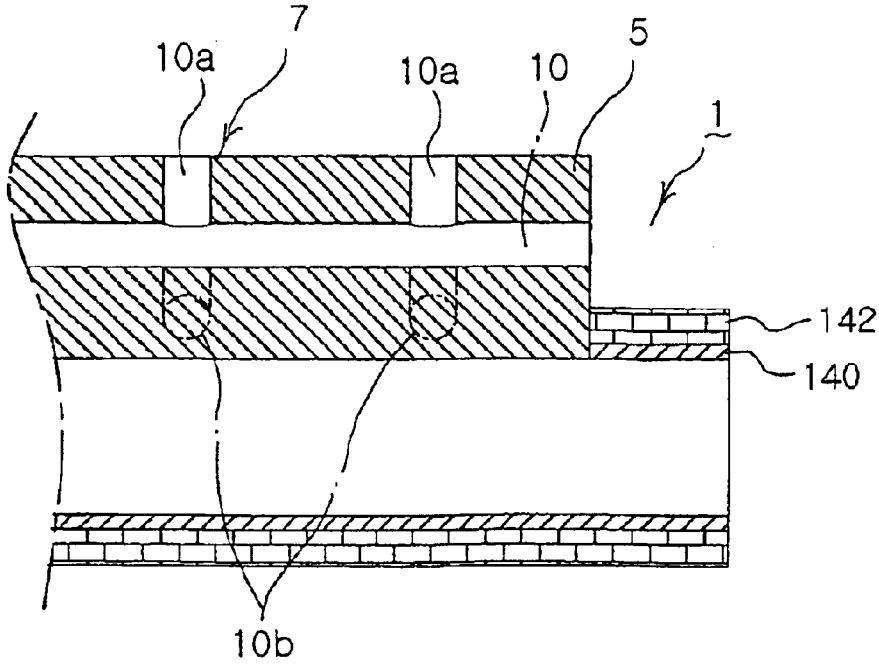

FIG. 31 illustrates a stationary rail-type skid apparatus as an alternative to the structure in FIG. 30. This skid apparatus comprises a vent hole 10 extended longitudinally through a skid member 5, a plurality of vertical vent holes 10*a* extended from the longitudinal vent hole 10 to a top face of the skid member 5 and scale exit holes 10*b* which are extended downward from the holes 10 and 10*a* to a side of the skid member 5. This embodiment is also excellent in heat transfer ability as well as structural stability as described in conjunction with FIG. 30.

Figure 32A:
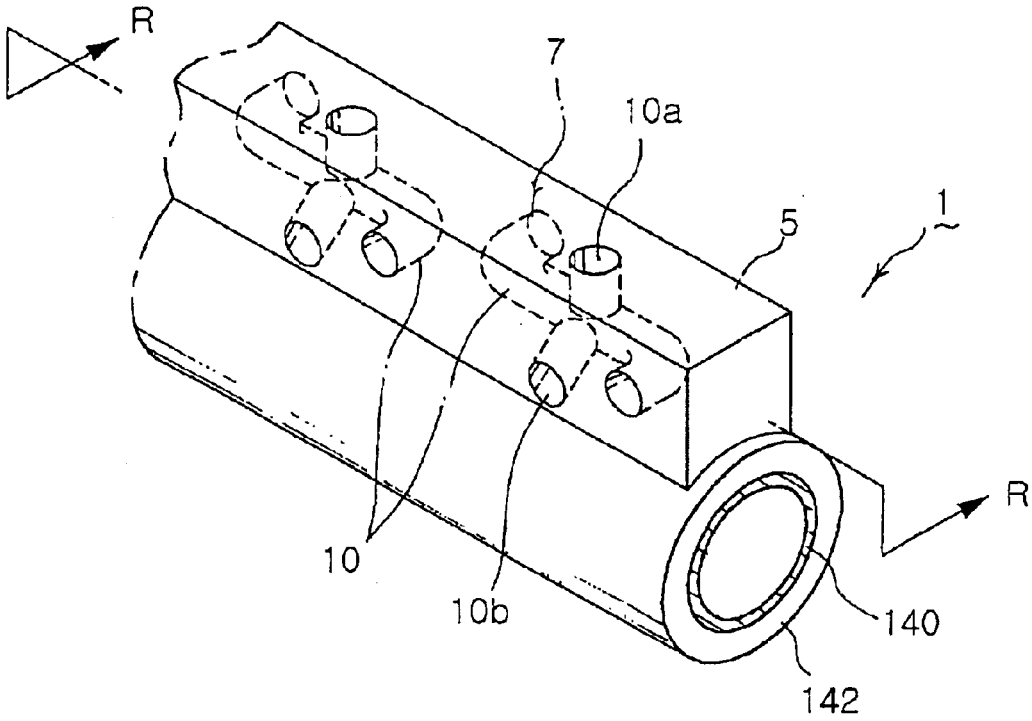
Figure 32B:
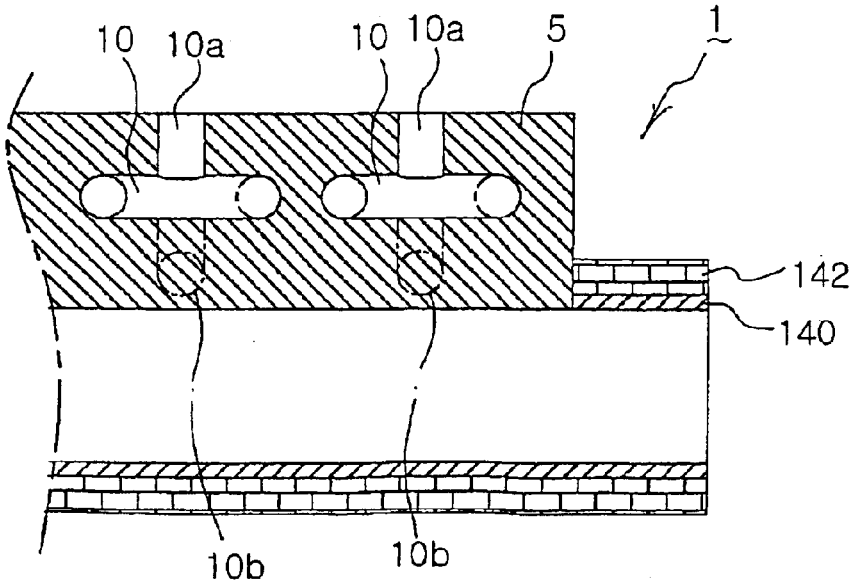

FIG. 32 illustrates another alternative to the structure in FIG. 30 according to the invention. This skid apparatus comprises a plurality of vent holes 10 formed longitudinally in a skid member 5 and opened at both ends laterally, vertical vent holes 10*a* extended from the longitudinal vent holes 10 to a top face of the skid member 5 and scale exit holes 10*b* which are extended downward from the holes 10 and 10*a* to a side of the skid member 5. This embodiment has an excellent heating ability over the embodiment shown in FIG. 30.

Figure 33A:
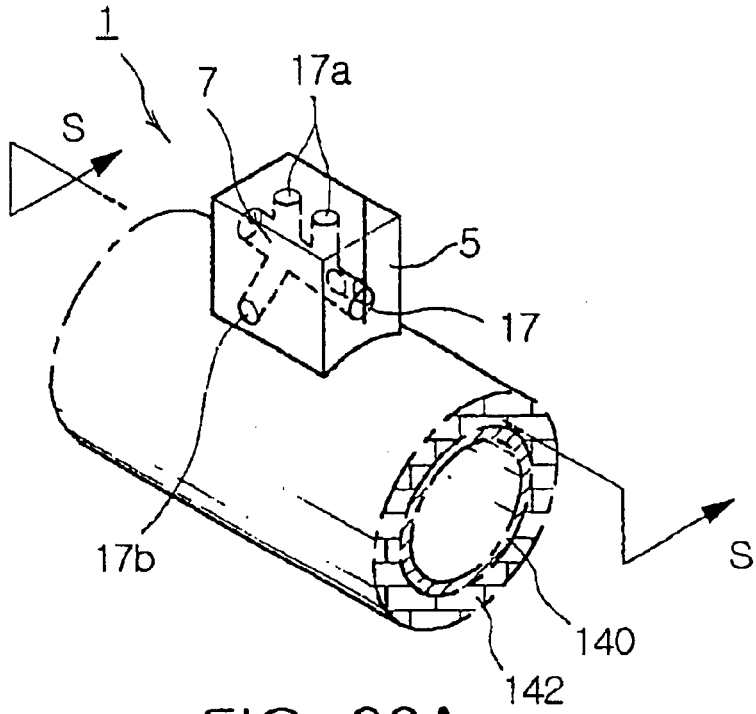
Figure 33B:
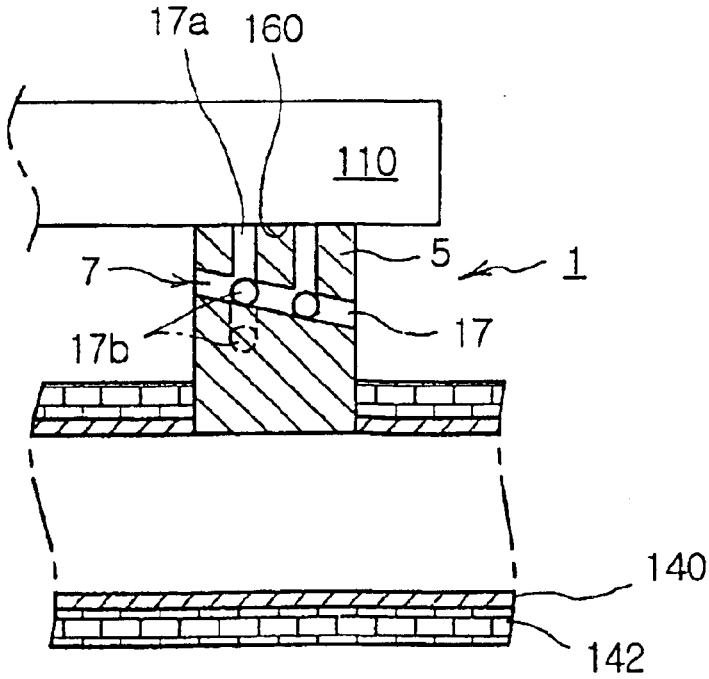

FIG. 33 illustrates an another alternative to the skid apparatus shown in FIG. 25 according to the invention. This skid apparatus comprises an inclined lateral vent hole 17 formed in a skid member 5, a plurality of vertical vent holes 17*a* extended from the lateral vent hole 17 to a top face of the skid member 5 and a plurality scale exit holes 17*b* extended downward from the vent holes 17 and 17*a* to sides of the skid member to form a ventilation channel 7. This embodiment can effectively remove foreign materials such as scale through the scale exit hole 10*b* out of the ventilation channel 7 while realizing an excellent heating effect toward the skid upper portion 161 as in FIG. 25.

Figure 34A:
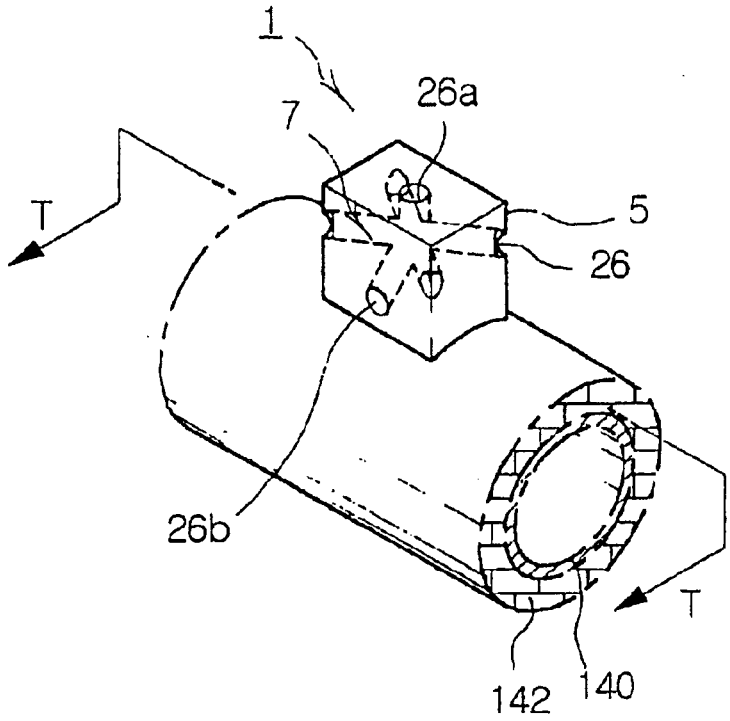
Figure 34B:
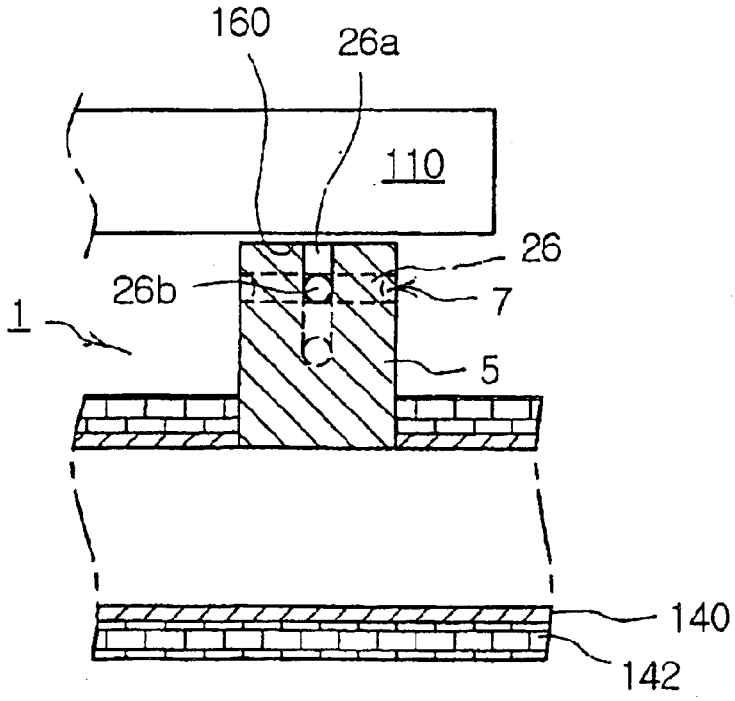

FIG. 34 illustrates an another alternative to the skid apparatus shown in FIG. 26 according to the invention. This skid apparatus comprises a plurality of lateral vent holes 26 which are formed diagonally at same heights in a skid member 5 and intersected with each other, a vertical vent hole 26*a* extended from the lateral vent holes 26 to a top face of the skid member 5 and a scale exit hole 26*b* extended downward from the vent holes 26 and 26*a* to a side of the skid member 5 to form a ventilation channel 7. This embodiment can effectively remove foreign materials out of the ventilation channel 7 while realizing an excellent heating effect.

Figure 35A:
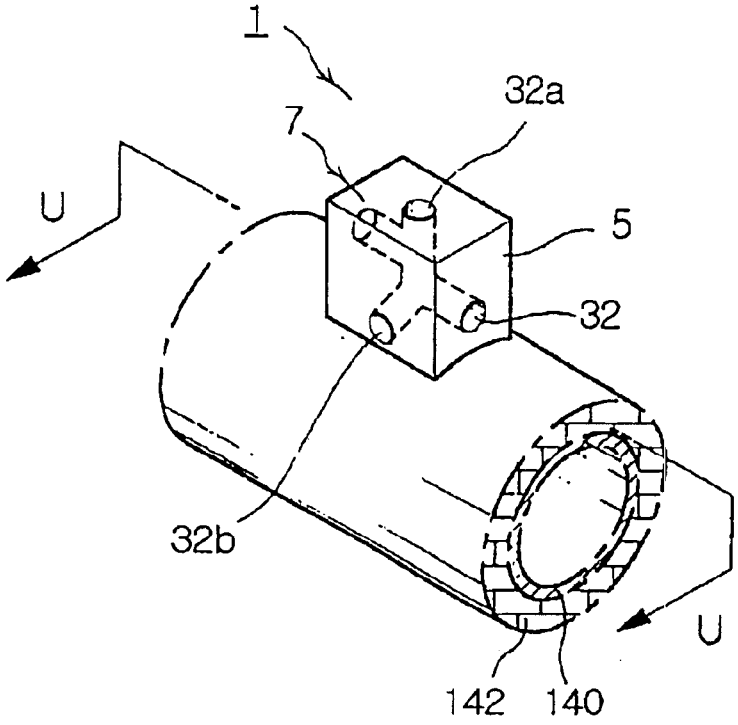
Figure 35B:
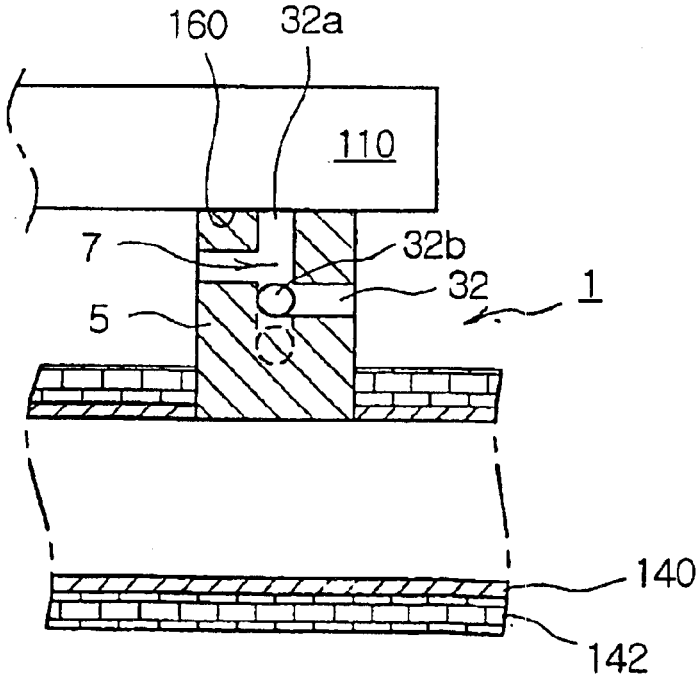

FIG. 35 illustrates an alternative to the skid apparatus shown in FIG. 28 according to the invention. This skid apparatus comprises a plurality of lateral vent holes 32 formed at different heights in a skid member 5, a vertical vent hole 32*a* extended from the lateral vent holes 32 to a top face of the skid member and a scale exit hole 32*b* extended downward from the vent holes 32 and 32*a* to a side of the skid member communicating with each other. This skid apparatus 1 can effectively remove foreign materials out of the ventilation channel 7 while realizing an excellent heating effect as in FIG. 28.

Figure 36A:
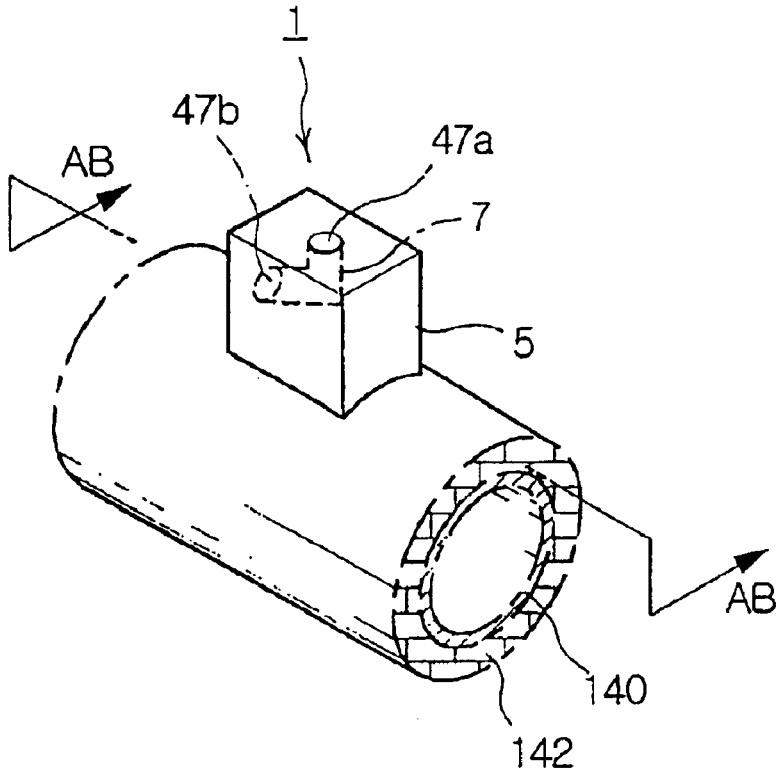
Figure 36B:
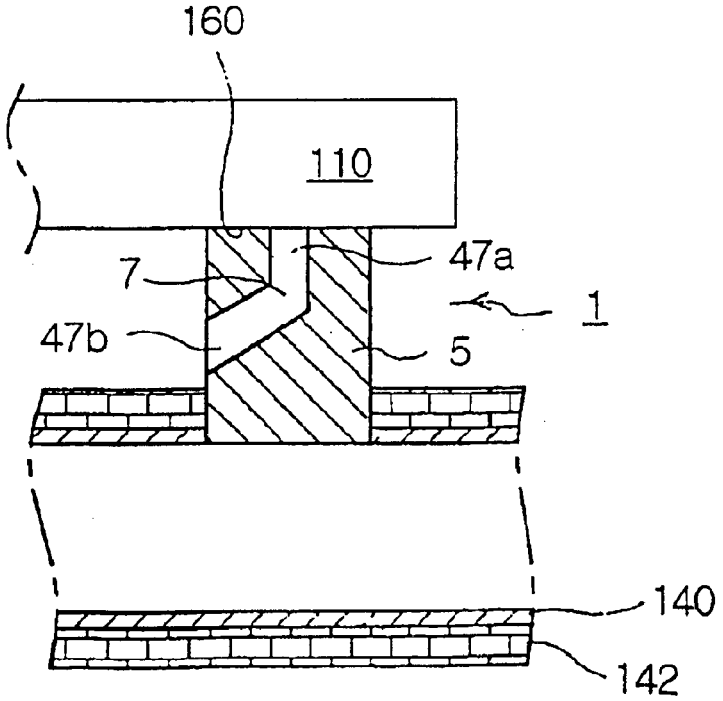

FIGS. 36*a* and 36*b* illustrate another alternative embodiment of the invention which comprises a vertical vent hole 47*a* formed in a central portion of a skid member 5 and a scale exit hole 47*b* extended downward from the vent hole 47*a* in a communicating type to a side of the skid member 5 to form a ventilation channel 7.

In this structure, hot gas heats a skid upper portion 161 of the hot material overlying the skid member through the vertical vent hole 47*a* and foreign materials are discharged through the scale exit hole 47*b*.

Figure 37A:
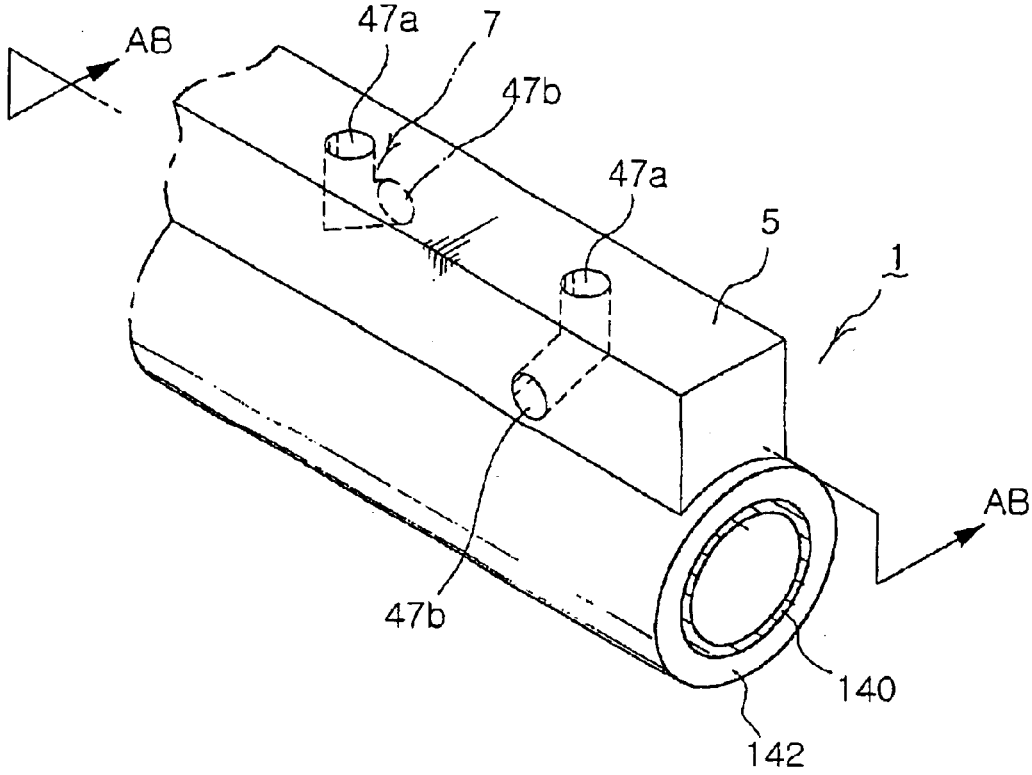
Figure 37B:
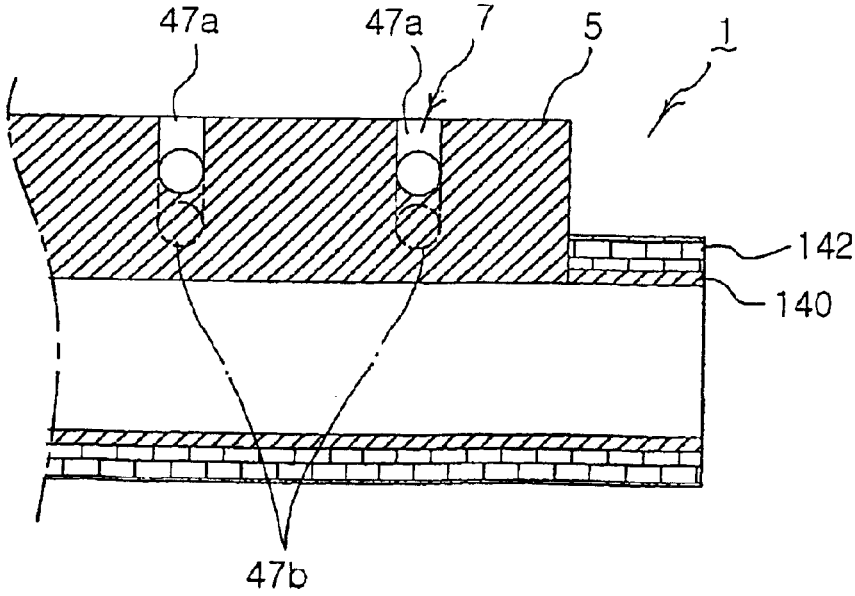

FIGS. 37*a* and 37*b* illustrate an alternative to the skid apparatus shown in FIG. 36 according to the invention. This skid apparatus comprises a plurality of vertical vent holes 47*a* formed in central portions of a stationary rail-type skid member 5 and scale exit holes 47*b* extended downward respectively from the vertical vent holes 47*a* in a communicating type to both sides of the skid member 5. As in FIG. 36, this skid apparatus allows hot gas to heat a contact region of a hot material 110 via the vertical vent hole 47*a*, and effectively removes foreign materials through the scale exit hole 47*b*.

Figure 38A:
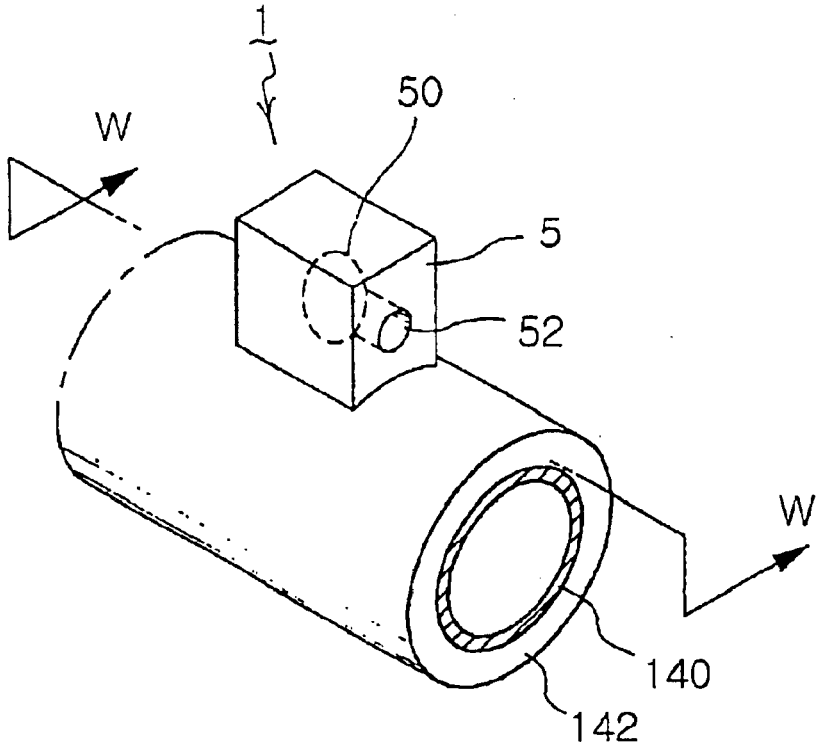
Figure 38B:
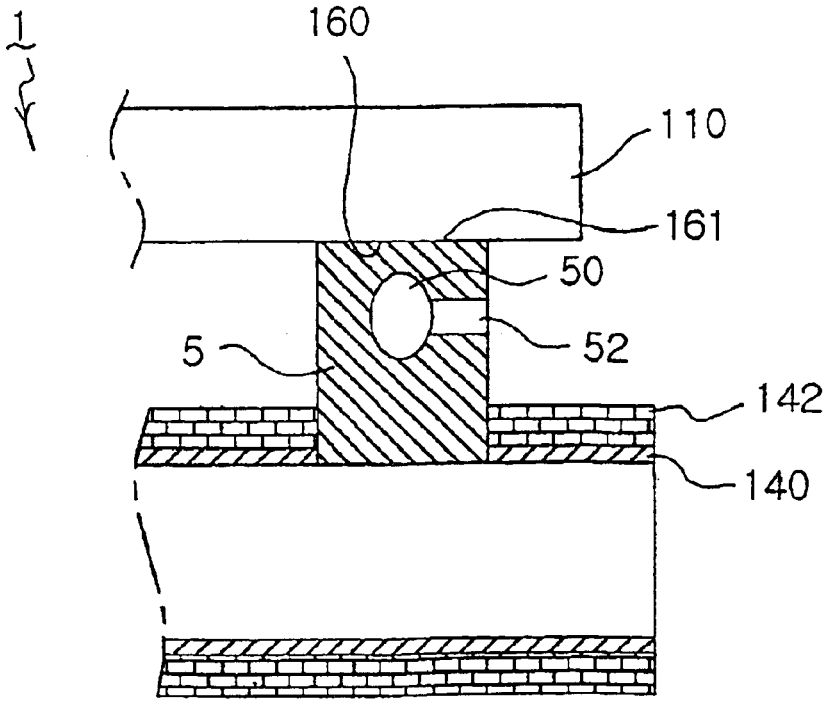

FIG. 38 illustrates another alternative embodiment of the invention which comprises a skid member 5, an oval space 50 formed inside the skid member 5 and a lateral vent hole 52 extended from the oval space 50 to a side of the skid member 5.

In this structure, the oval space 50 reduces the quantity of heat transferred from a hot material 110 to a coolant pipe 140 and the lateral vent hole 52 allows efficient passage of hot gas through the same so that the skid member 5 can compensate heat loss therein.

The oval space 50 and the lateral vent hole 52 increase the quantity of heat introduced from hot gas and effectively act to decrease heat transfer from the hot material 110 to the coolant pipe 140.

Figure 39A:
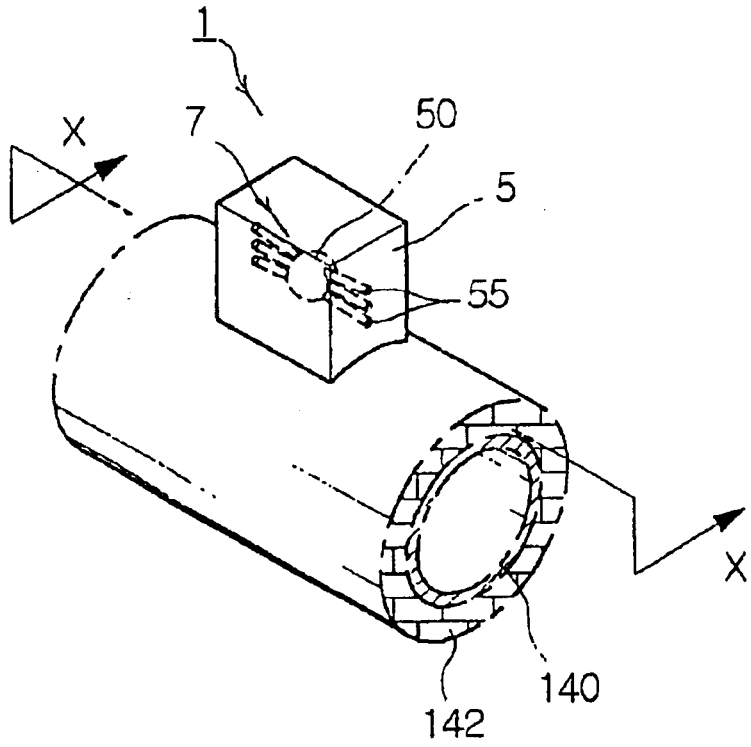
Figure 39B:
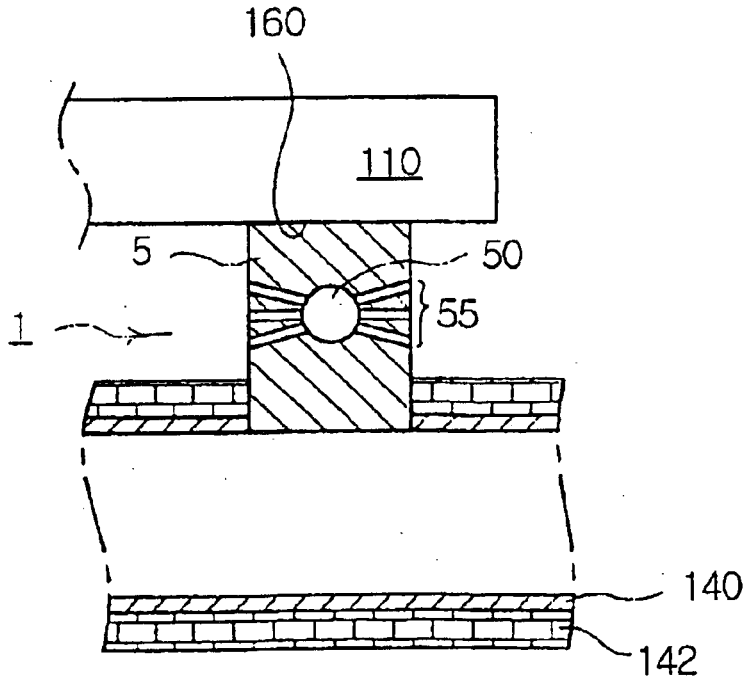

FIG. 39 illustrates an alternative to the skid apparatus shown in FIG. 38 according to the invention. This skid apparatus comprises inclined vent holes 55 extended from a hollow space 50 within a skid member 5 to front and rear faces of the skid member 5.

In this structure, the hollow space 50 reduces the quantity of heat transferred from a hot material 110 to coolant in a coolant pipe 140 while the vent holes 55 allows efficient passage of hot gas so as to internally compensate heat loss to the skid member 5 as well as to reduce heat quantity discharged from the hot material to the coolant pipe 140.

Figure 40A:
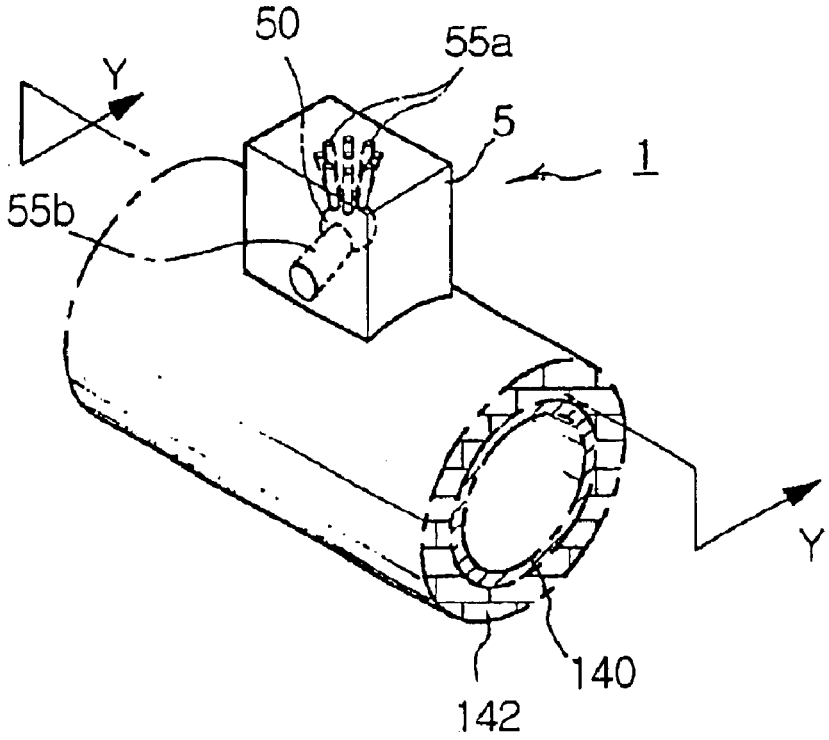
Figure 40B:
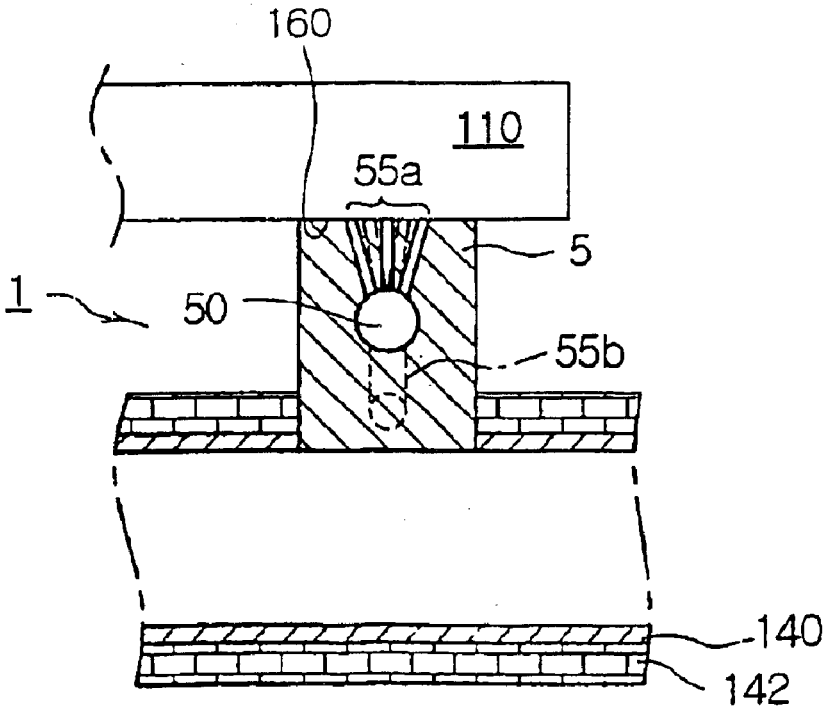

FIG. 40 illustrates an alternative to the skid apparatus shown in FIG. 39 according to the invention which comprises a plurality of vent holes 55*a* extended from a hollow space 50 within a skid member 5 to a top face of the skid member 5 and a scale exit hole 55*b* formed at an inclination from the hollow space 50 to a side of the skid member 5.

In this structure, the hollow space 50 reduces the quantity of heat transferred from a hot material 110 to coolant in a coolant pipe 140, the vent holes 55 allows efficient passage of hot gas, and hot gas directly contacts a skid upper portion 162 and a contact region of the hot material via the vent holes 55*a* so as to further improve heating ability.

Figure 41A:
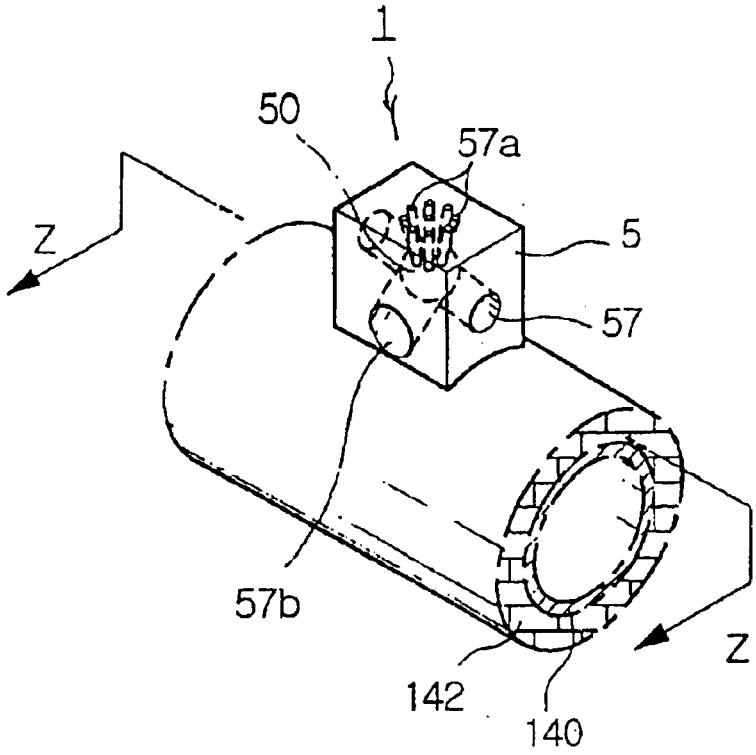
Figure 41B:
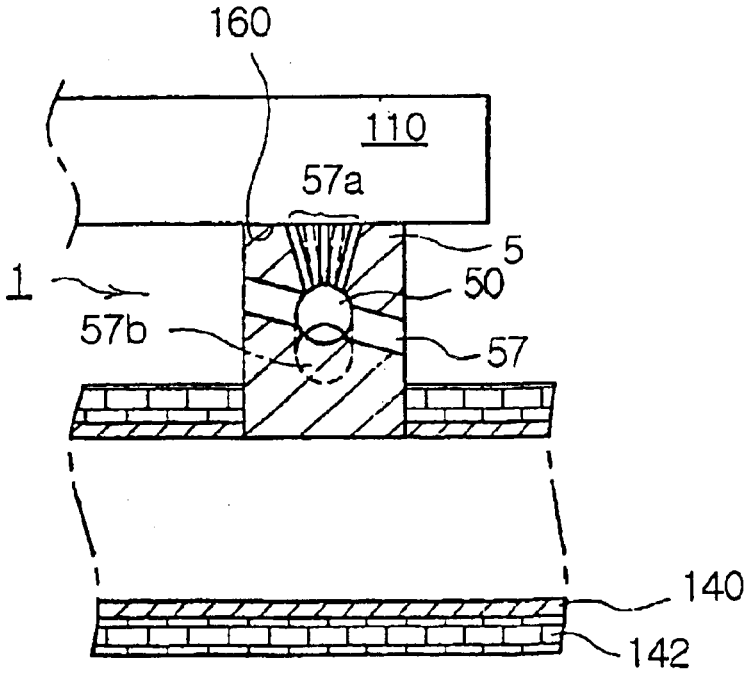

FIG. 41 illustrates an alternative to the skid apparatus shown in FIG. 40 according to the invention which comprises through holes 57 extended from a hollow space 50 within a skid member 5 to front and rear faces of the skid member 5, a plurality of vent holes 57*a* extended from a hollow space 50 within the skid member 5 at an inclination to a top face of the skid member 5 and a scale exit hole 57*b* extended downward from the hollow space 50 to a side of the skid member 5.

This structure allows foreign materials to be efficiently discharged through the scale exit hole 57*a* out of the hollow space 50 so that hot gas can be more efficiently introduced through the vent holes 57 in addition to the operation and effect in FIG. 40.

Figure 42A:
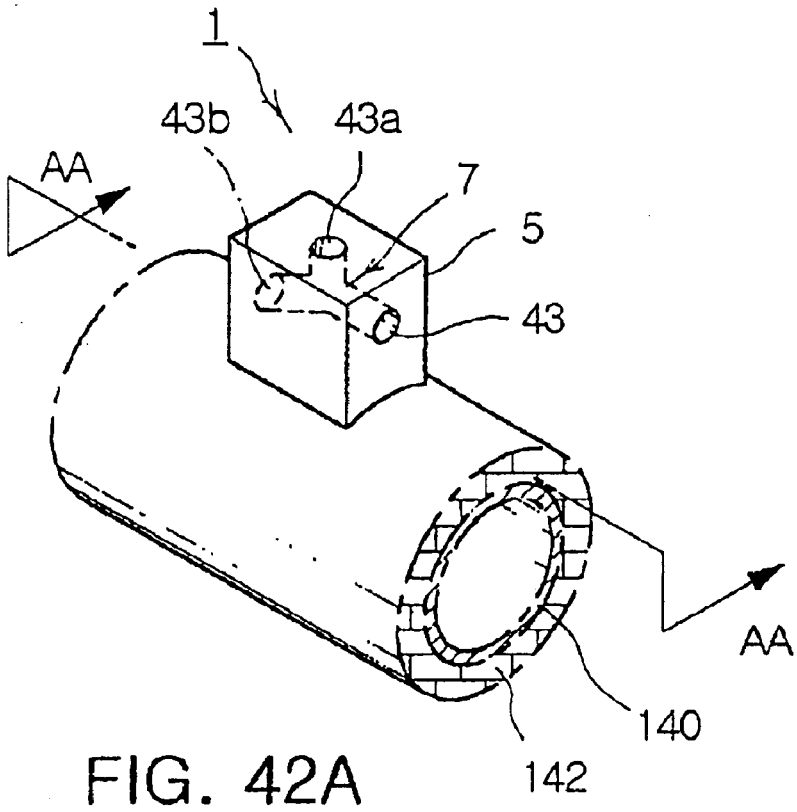
Figure 42B:
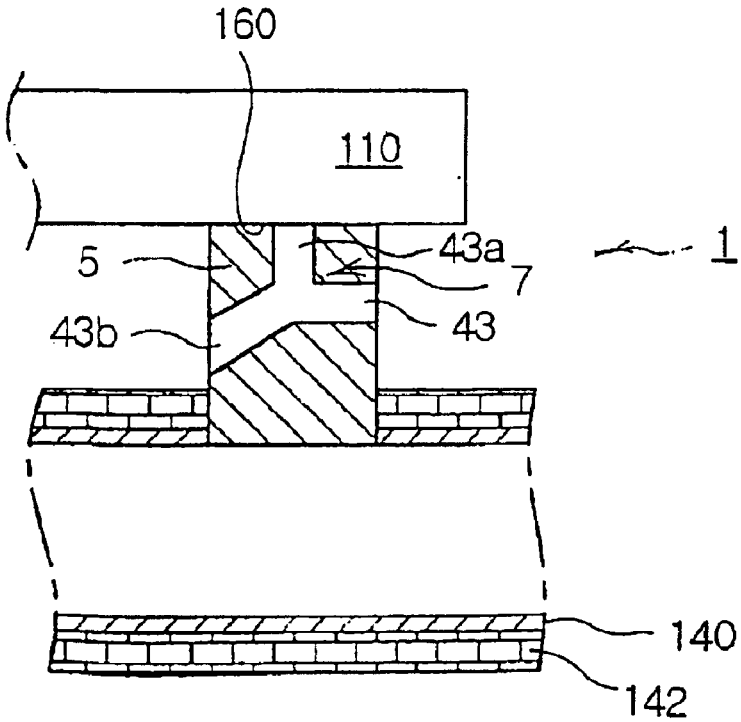

FIG. 42 illustrates a skid apparatus according to another alternative embodiment of the invention. The skid apparatus of this embodiment comprises a lateral vent hole 43 extended from an inner portion of a skid member 5 to a face thereof, a vertical vent hole 43*a* extended from the lateral vent hole 43 to a top face of the skid member 5 and a scale exit hole 43*b* extended downward from the vent holes 43 and 43*a* communicating with the vent holes 43 and 43*a* to a side of the skid member 5 to form a ventilation channel 7.

The holes are sized in the order of the scale exit hole 43*b*, the lateral vent hole 43 and the vertical vent hole 43*a*. Preferably, the scale vent hole 43*b* may be flared downward in diameter.

This skid apparatus allows hot gas to efficiently circulate through the vent holes 43 and 43*a* and the scale exit hole 43*b* as well as to directly heat skit marks 160 of a hot material 110 seated on the skid member 5.

When the hot material is carried with the skid apparatus, vibration is created assisting foreign materials introduced into the holes 43, 43*a* and 43*b* to be smoothly discharged through the scale exit hole 43*b*.

Figure 43A:
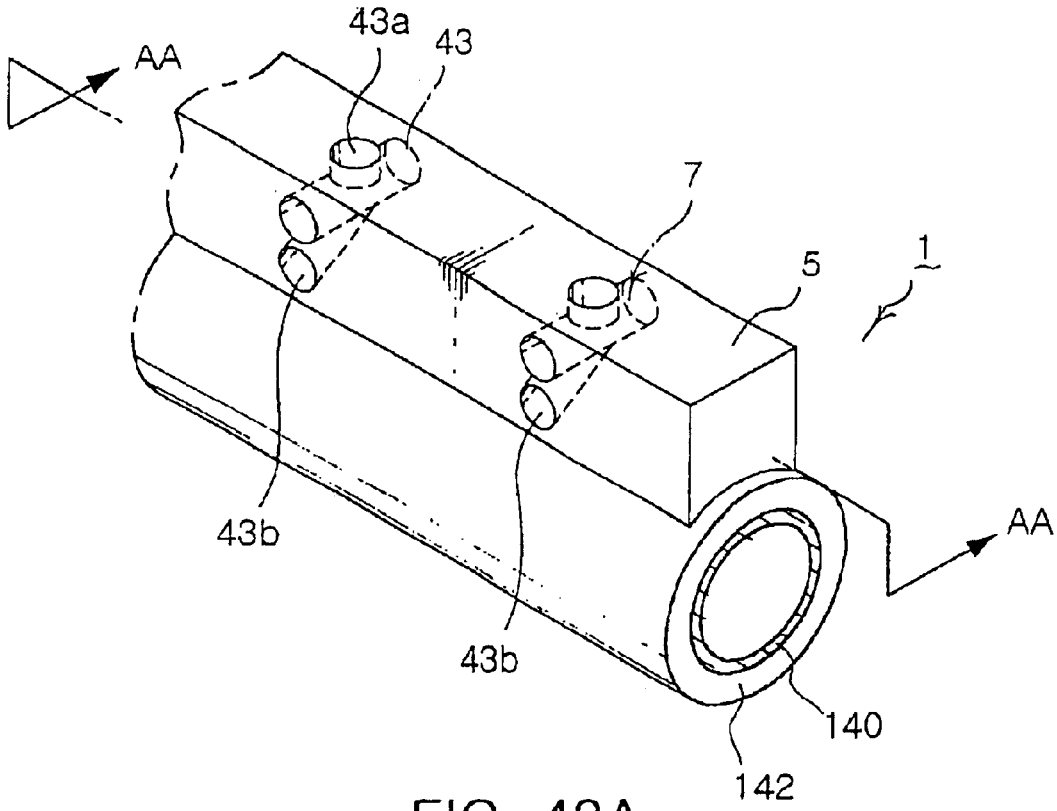
Figure 43B:
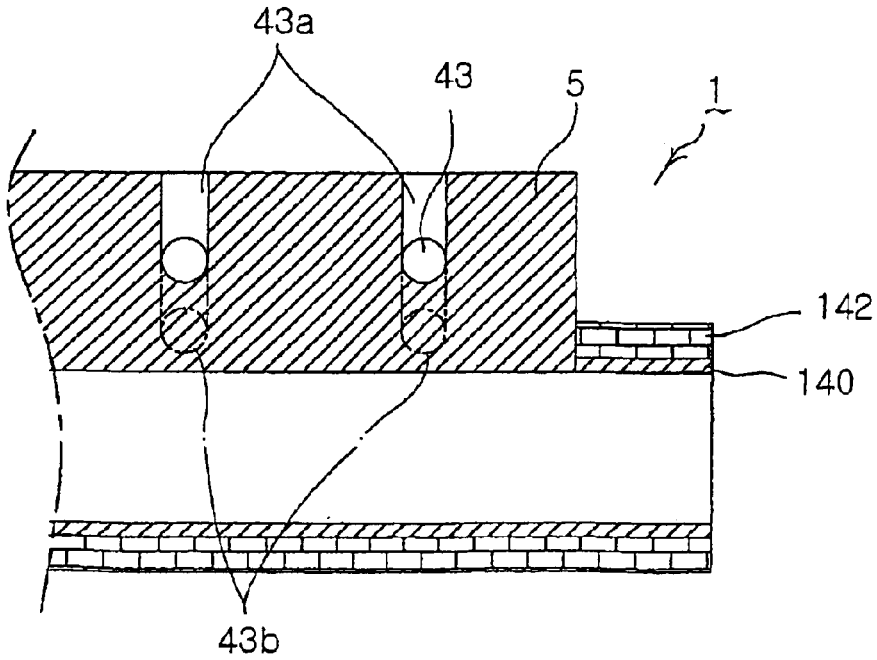

FIG. 43 illustrates an alternative to the skid apparatus shown in FIG. 42 according to the invention. The skid apparatus of this embodiment comprises a plurality of lateral vent holes 43 formed in a stationary rail-type skid member 5, vertical vent holes 43*a* extended from the lateral vent holes 43 to a top face of the skid member 5 and inclined scale exit holes 43*b* communicating with corresponding lateral and vertical vent holes 43 and 43*a*.

This skid apparatus allows foreign materials introduced into the holes 43, 43*a* and 43*b* to be smoothly discharged through the scale exit hole 43*b*.

Figure 44A:
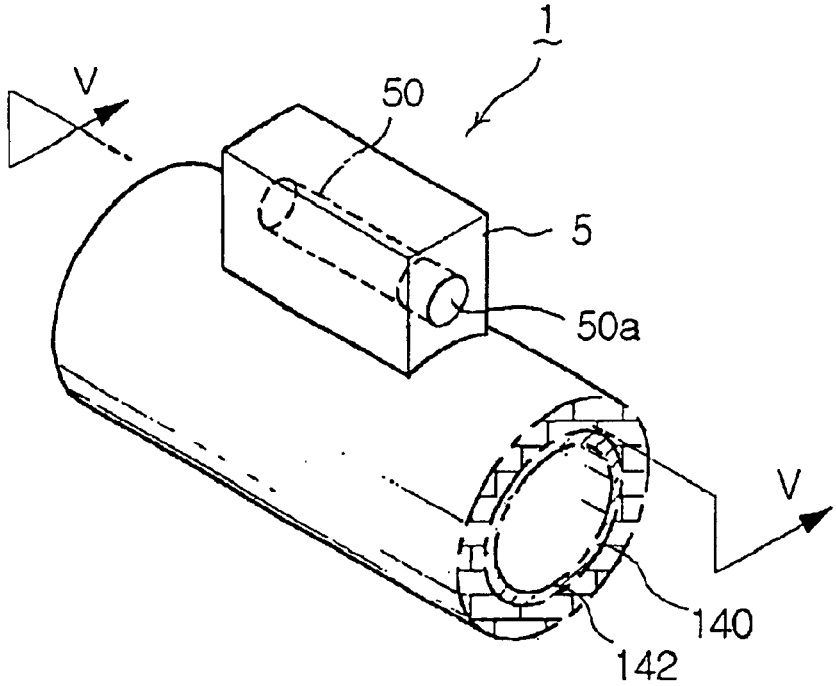
Figure 44B:
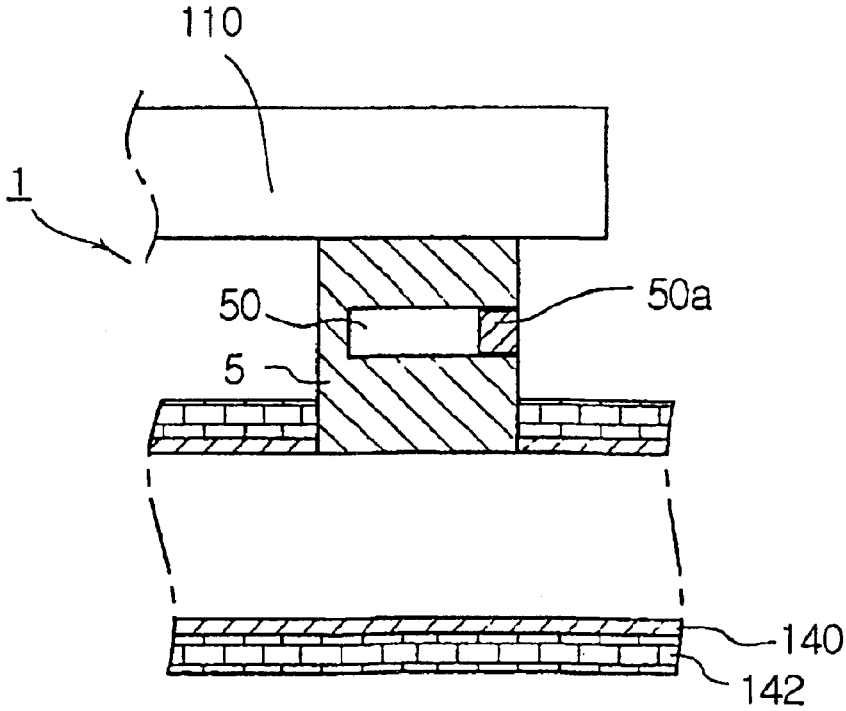

FIG. 44 illustrates a skid apparatus according to another alternative embodiment of the invention. The skid apparatus comprises a skid member 5 with an upper face for supporting a hot material 110, a blind vent hole formed within the skid member 5 at a predetermined size and a stopper 50*a* blocking an opening of the vent hole to define a hollow space 50 within the skid member 5. This structure decreases the quantity of heat transferred from a hot material 110 to a coolant pipe 140 to reduce the temperature difference between a region of the hot material 110 contacting the top portion of the skid member 5 and other regions thereof which are not in contact with the skid member 5.

The hollow space 50 is defined within the skid member 5 of a uniform material by forming the blind vent hole horizontally within the skid member 5 and blocking the opening of the blind vent hole with the stopper 50*a*.

The stopper 50*a* is preferably of a cowl for example made of insulation material. This structure having the space in a central portion of the skid member 5 reduces the section modulus of the skid member 5 only to a small value thereby minimizing strength degradation compared to a conventional solid structure without the hollow space 50.

FIG. 45 illustrates another alternative embodiment of the invention having a discrete ventilation channel 7. That is, as shown in FIGS. 45*a* and 45*b*, the vent holes 10 are extended into a skid member 5 from front and rear faces thereof but stopped in middle portions of the skid member 5 to form the discrete ventilation channel 7. However, this structure can also prevent temperature difference in a hot material 110 since the vent holes 10 effectively keep the heat of the skid member 5.

Figure 45C:
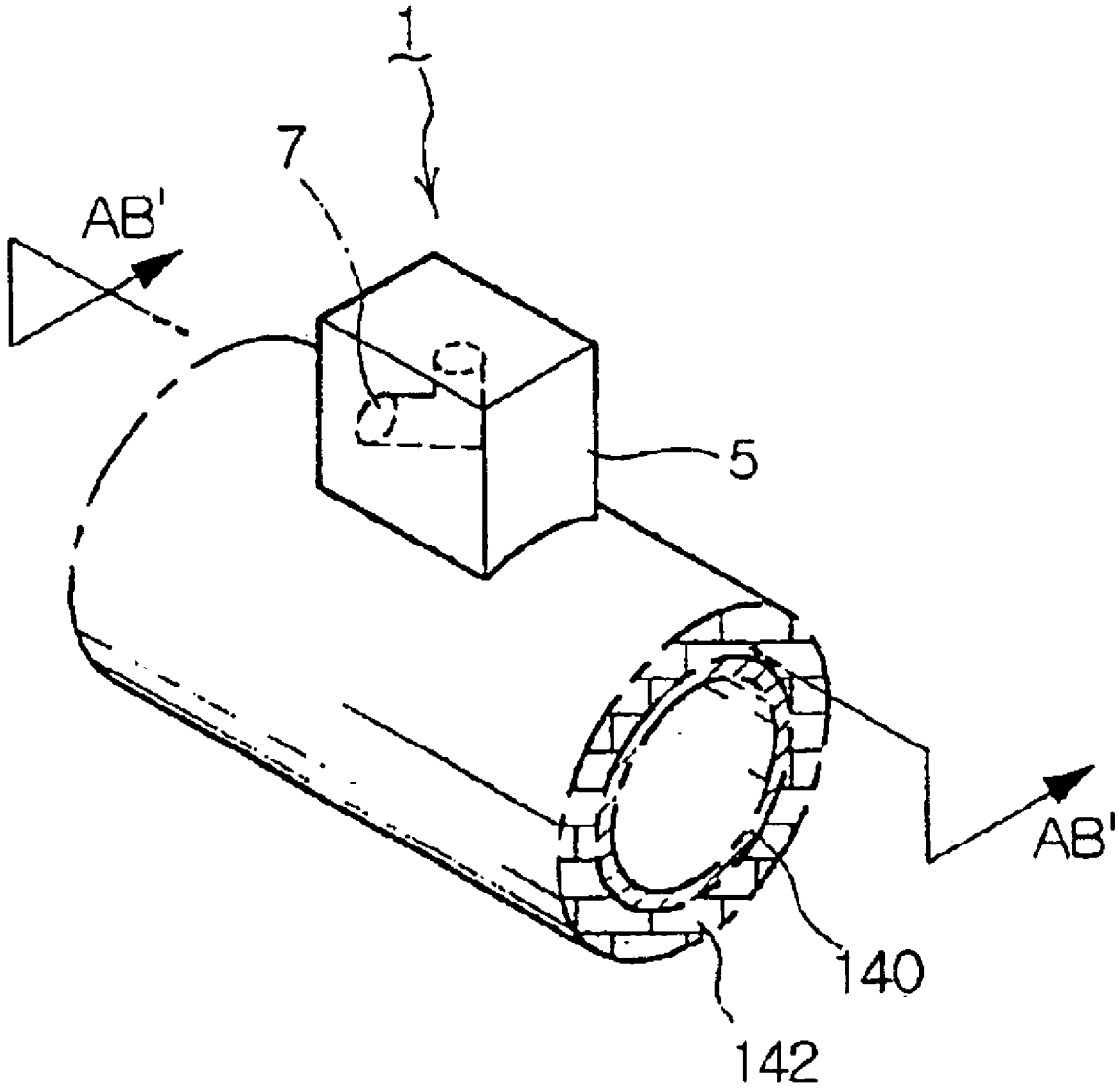
Figure 45D:
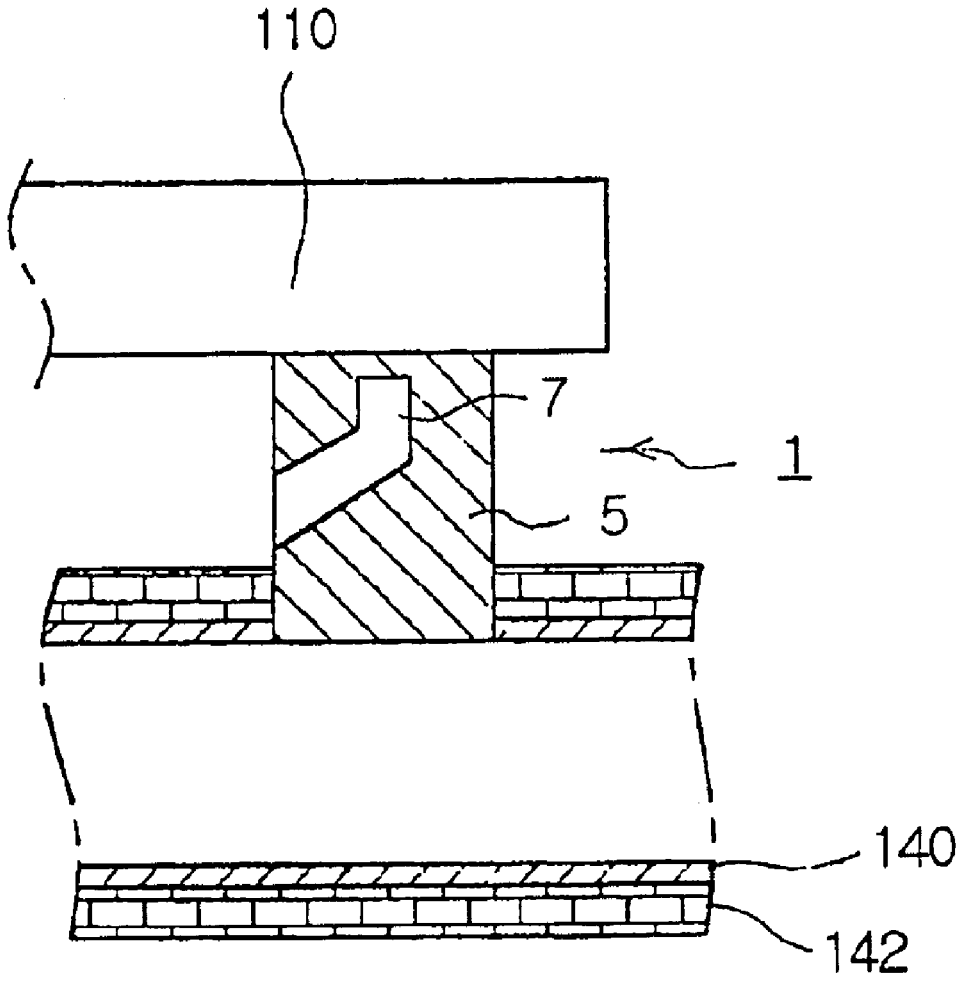

Furthermore, as shown in FIGS. 45*c* and 45*d*, a ventilation channel 7 having a blind upper end is formed in a central portion of the skid member 5. The ventilation channel 7 has an downward portion which is extended downward at an inclination from a lateral portion of the ventilation channel 7.

This structure also effectively acts to reduce the quantity of heat transferred to a coolant pipe 140 from the hot material 110 since hot gas circulates into the skid member through the ventilation channel 7.

Figure 46A:
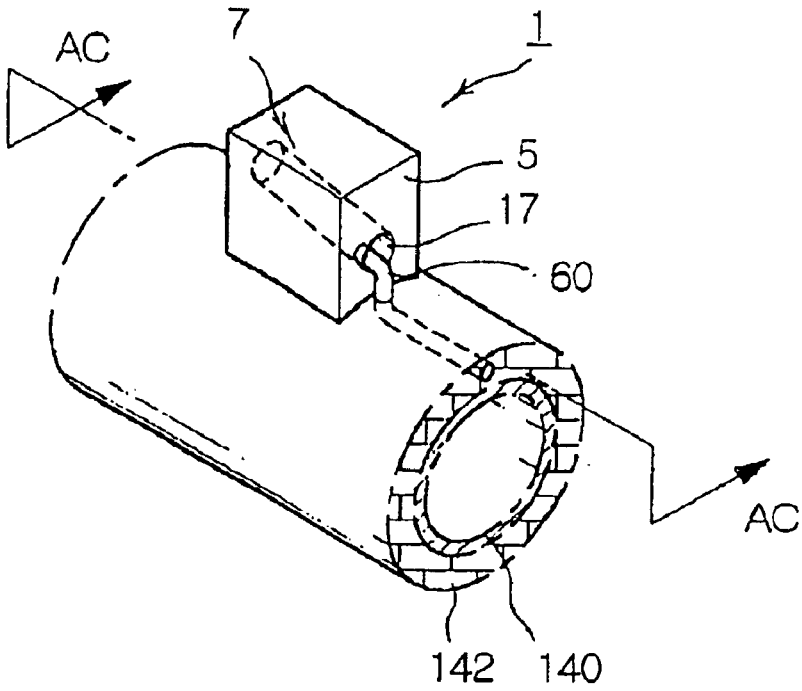
Figure 46B:
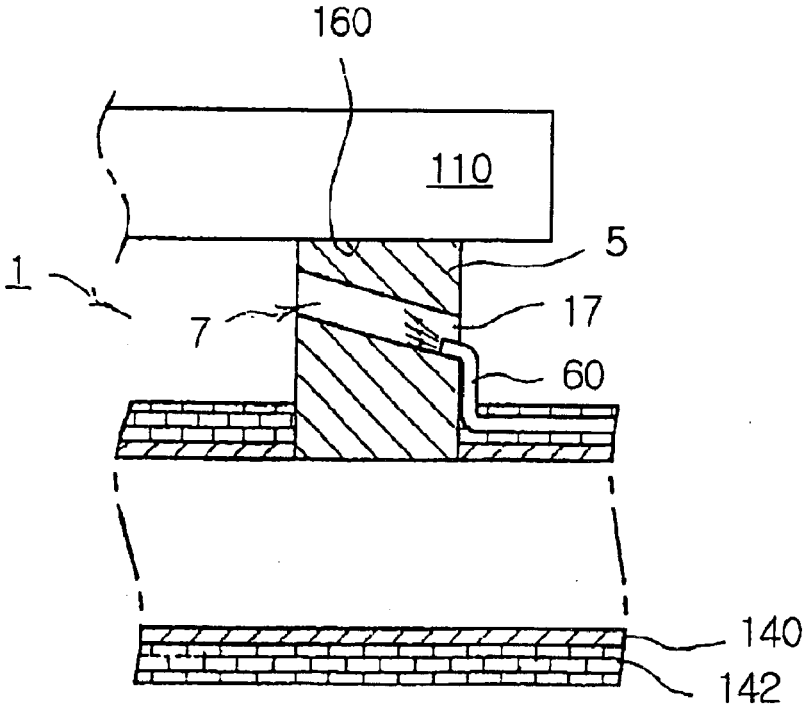

FIG. 46 illustrates another alternative to the skid apparatus shown in FIG. 10 according to the invention. This skid apparatus comprises a lateral vent hole 17 extended through a skid member 5 and a combustion gas pipe 60 with a leading end extended into the lateral vent hole 17.

This structure feeds a small quantity of combustion gas through the combustion gas pipe 60 into the lateral vent hole 17 so that flame heats the skid member 5 through the lateral vent hole 17 to enable indirect heating of a hot material 110 via the skid member 5.

That is, the leading end of the combustion gas pipe 60 is extended into an end of the lateral vent hole 17 so that combustion gas is fed into the lateral vent hole 17 to perform direct and indirect heating through the skid member 5 to a portion of the hot material in contact with the skid member 5 while enhancing heating effect to above the skid member 5 via the vent hole.

Figure 47A:
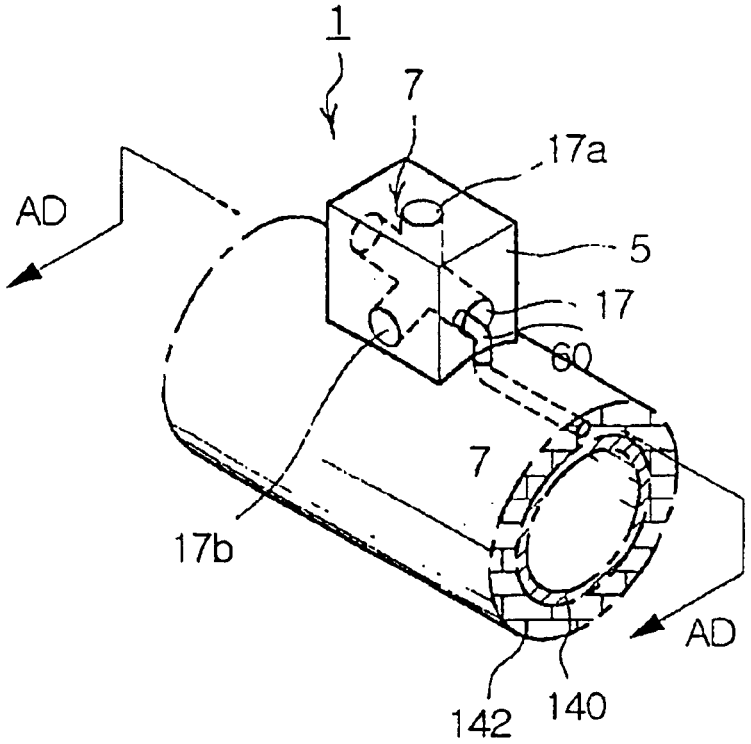
Figure 47B:
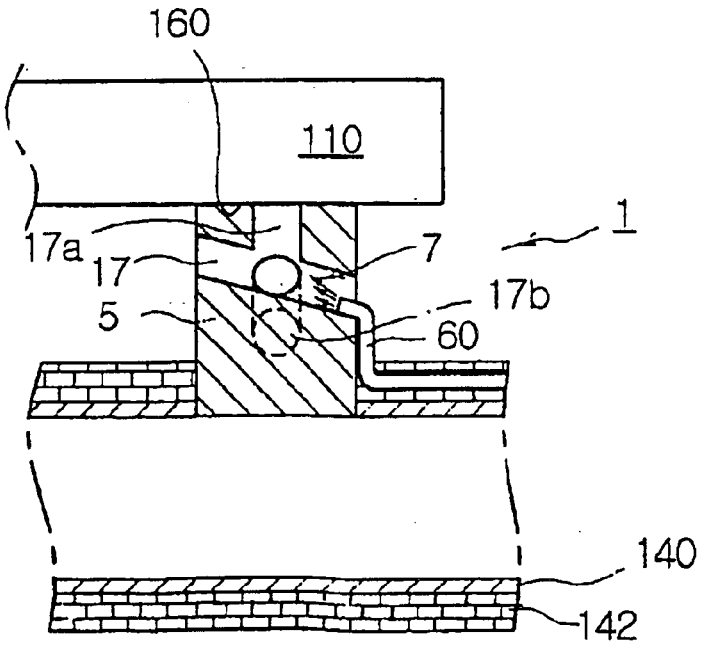

FIG. 47 illustrates another alternative to the skid apparatus shown in FIG. 30 according to the invention. This skid apparatus comprises a horizontal lateral vent hole 17 extended through a skid member 5, a vertical vent hole 17*a* extended from the horizontal vent hole 17 to a top face of the skid member 5, a scale exit hole 17*b* which is extended downward from the lateral vent hole 17 to a side of the skid member 5 and a combustion gas pipe 60 with a leading end extended into the lateral vent hole 17.

This embodiment can effectively remove foreign materials such as scale through the scale exit hole 17*b* out of the vertical vent hole 17*a* while realizing an excellent heating effect toward a skid mark 160 through the vertical vent hole 17*a* as in FIG. 30. Also a small quantity of combustion gas is fed through the combustion gas pipe 60 into the vertical vent hole 17*a* so that the skid mark 160 can be heated directly with flame through the vertical vent hole 17*a* or indirectly through the skid member 5.

The combustion gas pipe 60 may be extended into the scale exit hole 17*b* instead of the lateral vent hole 17 to obtain substantially equal effect.

Figure 48A:
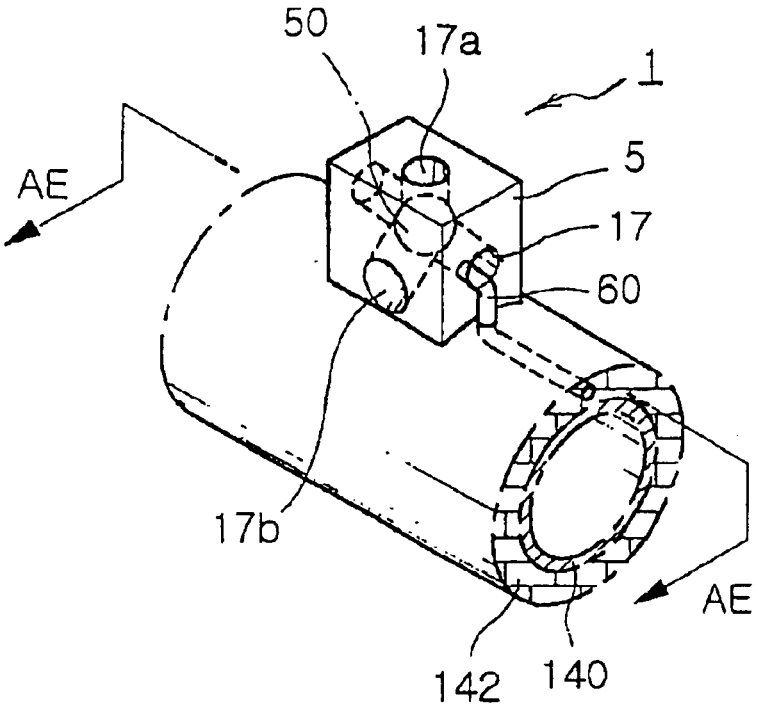
Figure 48B:
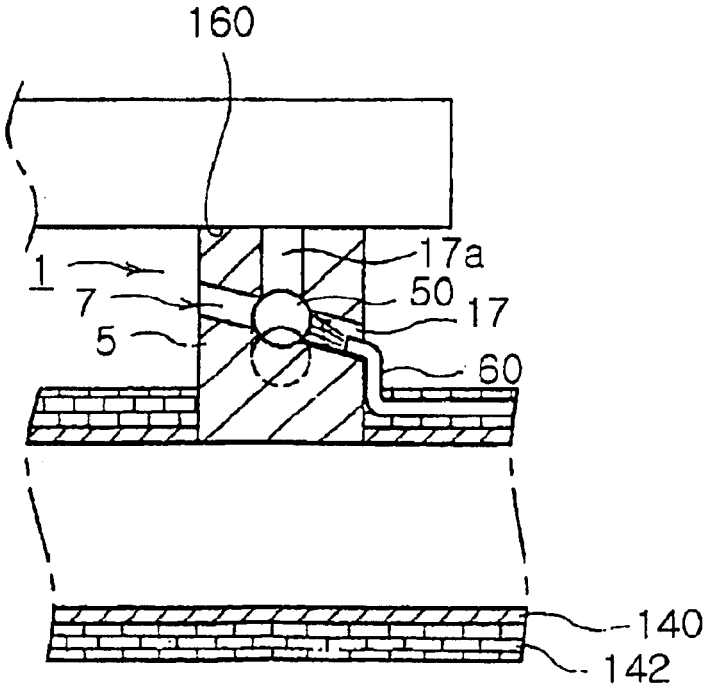

FIG. 48 illustrates another alternative embodiment to the skid apparatus of the invention. This skid apparatus comprises a skid member 5, a hollow space 50 within the skid member 5, a lateral vent hole 17 extended from the hollow space 50 to front and rear faces of the skid member 5, a vertical vent hole 17*a* extended from the hollow space 50 to a top face of the skid member 5, a scale exit hole 17*b* extended from the hollow space 50 to a side of the skid member 5 and a combustion gas pipe 60 with a leading end extended into the lateral vent hole 17.

According to this structure, the hollow space 50 minimizes heat transfer from a hot material 110 toward a coolant pipe 140. This embodiment can effectively remove foreign materials such as scale through the scale exit hole 17*b* out of the vertical vent hole 17*a* while realizing an excellent heating effect toward a skid mark 160 through the vertical vent hole 17*a* as in FIG. 30. Also a small quantity of combustion gas is fed through the combustion gas pipe 60 into the vertical vent hole 17*a* so that the skid mark 160 can be heated directly with flame through the vertical vent hole 17*a* or indirectly through the skid member 5.

Figure 49A:
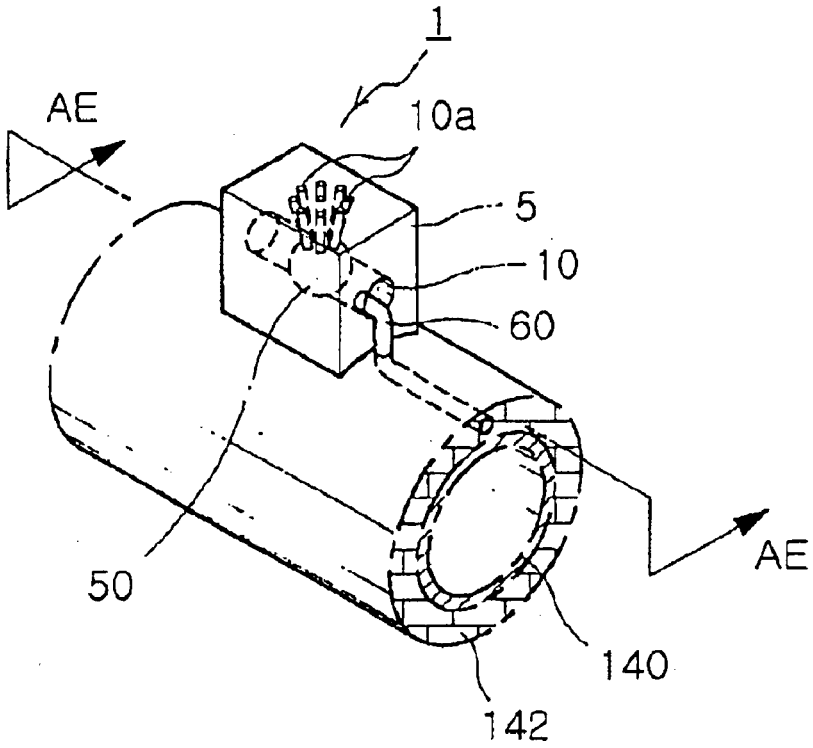
Figure 49B:
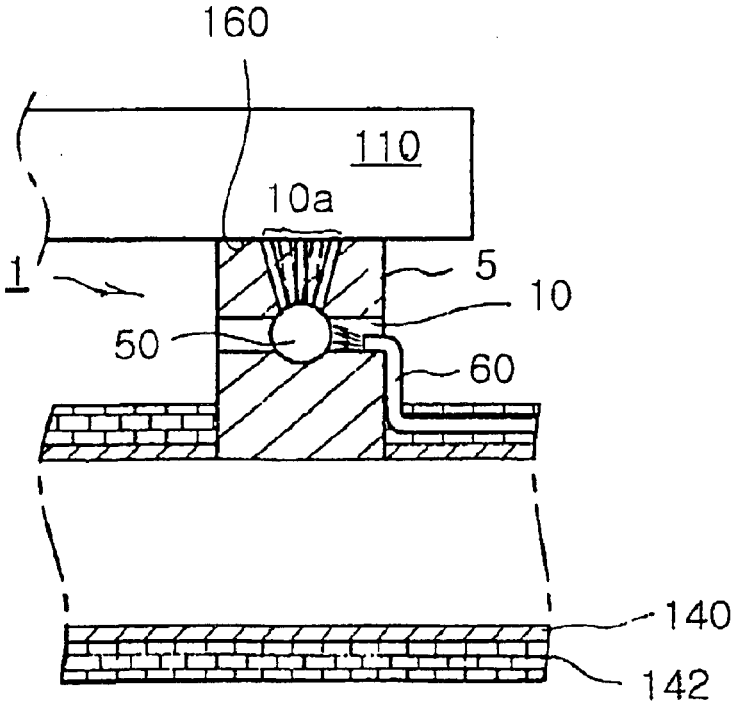

FIG. 49 illustrates another alternative embodiment to the skid apparatus of the invention. This skid apparatus comprises a skid member 5, a hollow space 50 within the skid member 5, a lateral vent hole 10 extended from the hollow space 50 to front and rear faces of the skid member 5, at least one vent hole 10*a* extended from the hollow space 50 to a top face of the skid member 5 and a combustion gas pipe 60 with a leading end extended into the lateral vent hole 10.

According to this structure, the hollow space 50 minimizes heat transfer from a hot material 110 toward a coolant pipe 140. The vent holes 10*a* enhance heating effect toward a skid upper portion 161 and allow direct heating of an underside contact region of the hot material 110 or indirect heating via the skid member 5.

EXAMPLE 1

Figure 3:
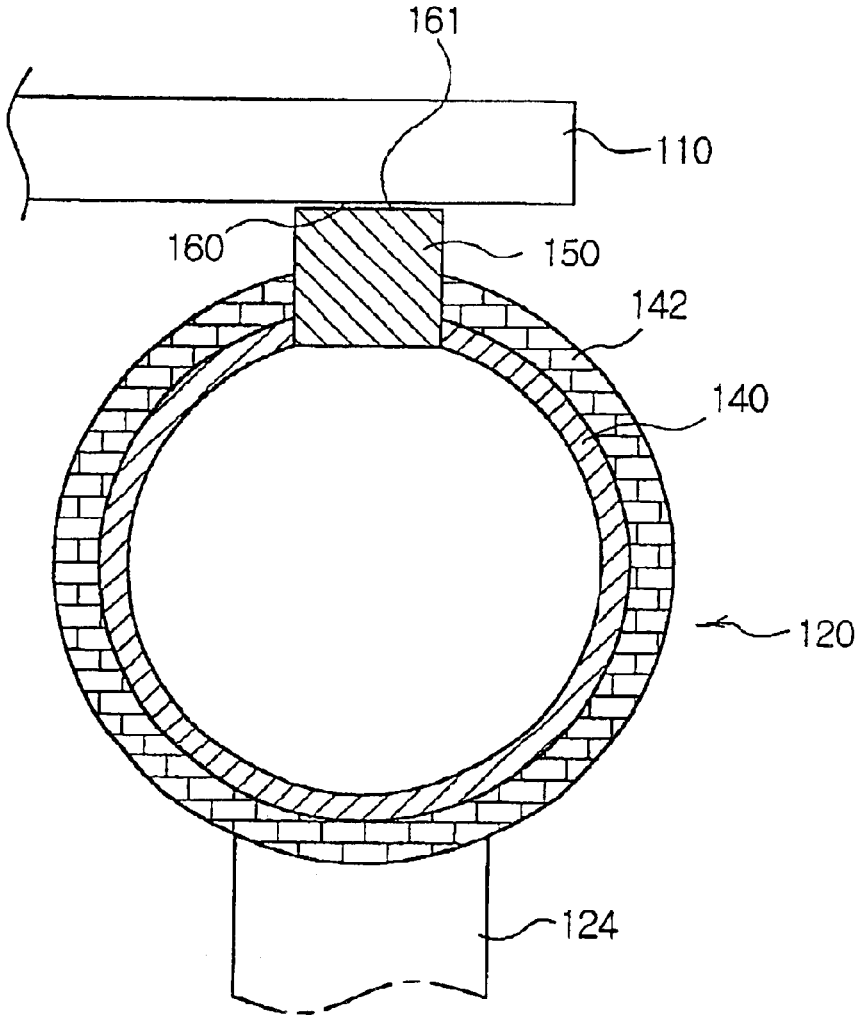
FIG. 3 Prior Art
FIG. 3 is a sectional view of a skid apparatus of the prior art.
Figures 4A, 4B, 4C, 4D:
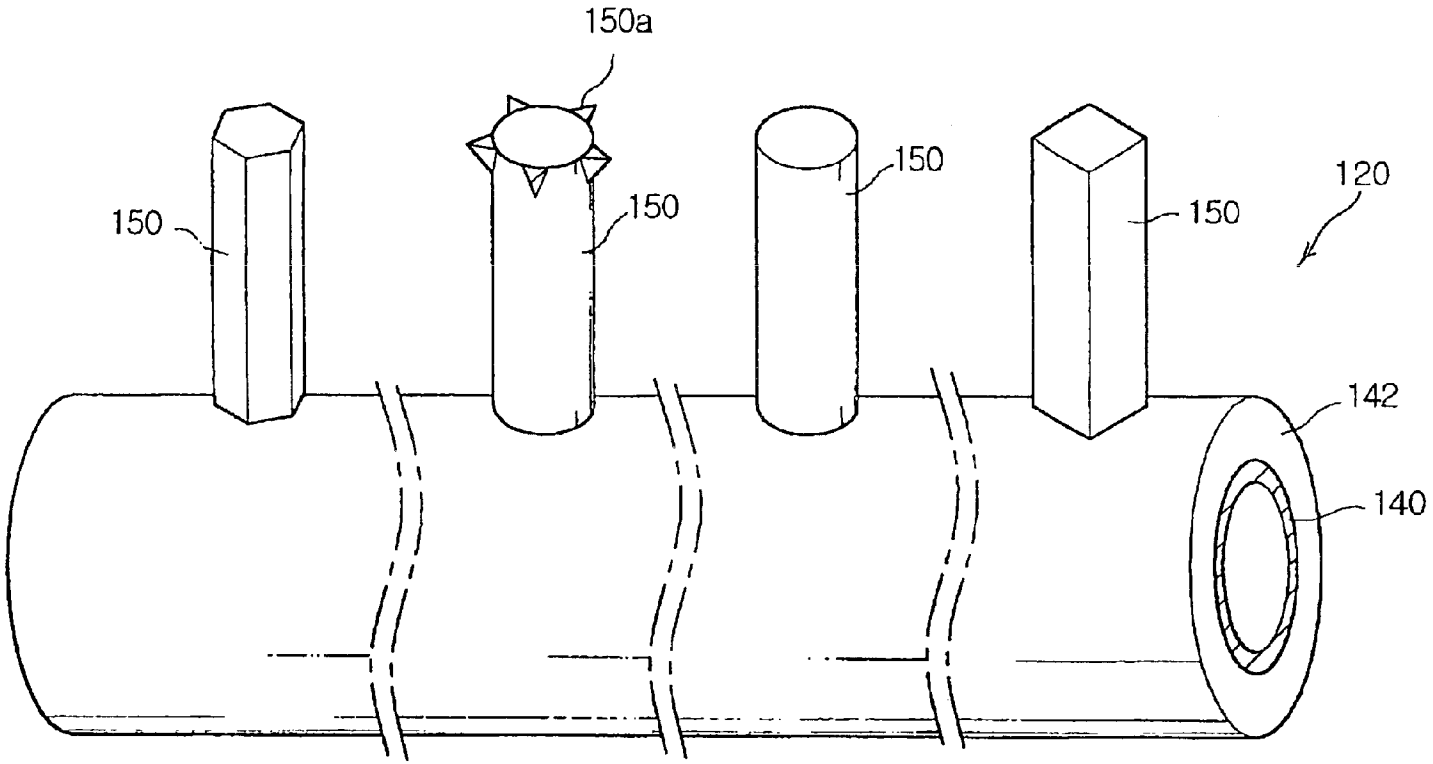
FIG. 4A FIG. 4B FIG. 4C FIG. 4D Prior Art
Figure 5A:
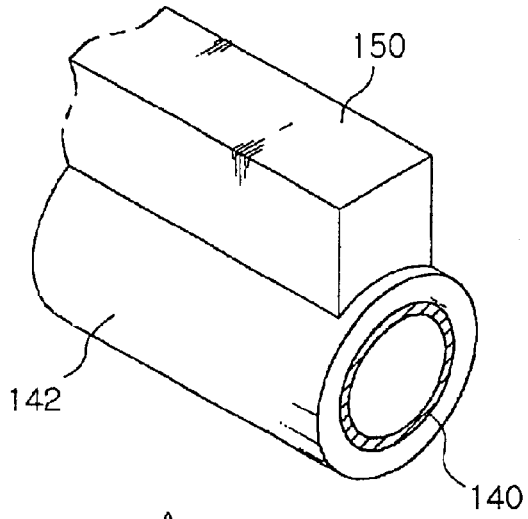
FIG. 5A Prior Art
Figure 5B:
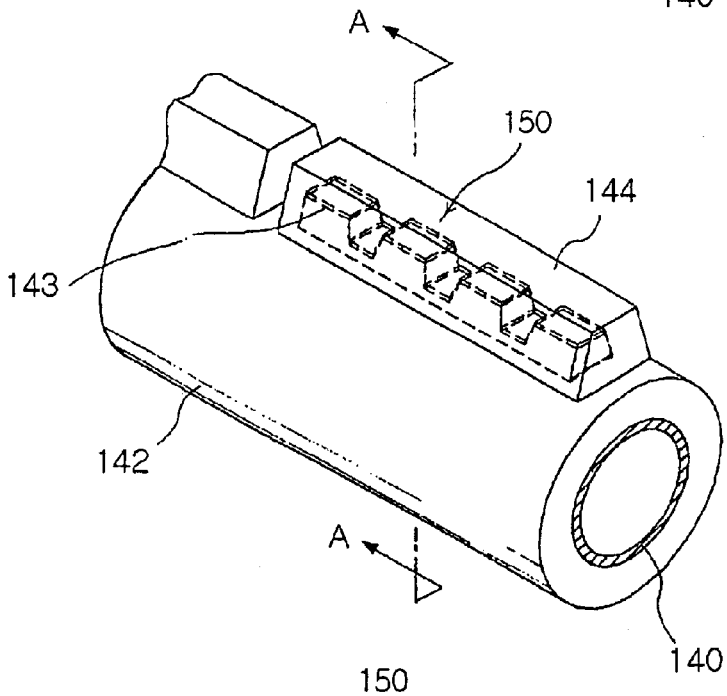
FIG. 5B Prior Art
Figure 5C:
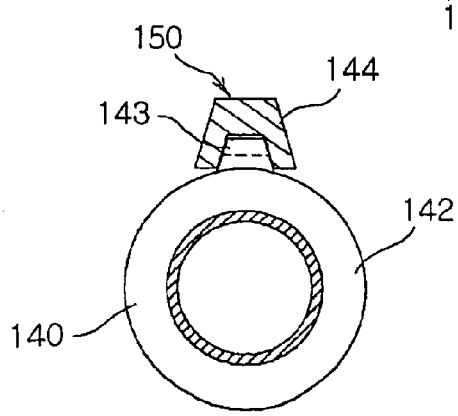
FIG. 5C Prior Art

A conventional skid apparatus shown in FIG. 3 and a skid apparatus having a lateral vent hole 10 of the invention as shown in FIG. 6 were prepared in order to examine actual effects of the invention in association with temperature difference reduction in skid marks, and results were measured with a Solid Model analysis system.

In Example 1, an experimental reheating furnace was maintained at a temperature of about 1250° C. Temperatures were measured at regions of a hot material, i.e., slab 110 on the skid apparatus of the invention and the conventional skid apparatus for every 30 minutes to measure temperature differences between underside regions of the slab 110 in contact with the skid members and central regions thereof not in contact with the same. Experiments were performed twice in the same manner to obtain results as reported in Table 1 below.

TABLE 1

| | Temperature Difference in Skid Marks | | | | | |
|---|---|---|---|---|---|---|
| | Experiment 1 (Temp. difference: ° C.) | | | Experiment 2 (Temp. difference: ° C.) | | |
| Classification | Conv. | Inv. | Improvement | Conv. | Inv. | Improvement |
| 30 min | 16 | 23 | +7 | 12 | 20 | +8 |
| 60 min | 71 | 67 | −4 | 63 | 56 | −6 |
| 90 min | 90 | 82 | −8 | 55 | 46 | −9 |
| 120 min | 52 | 43 | −9 | 36 | 26 | −10 |
| 150 min | 33 | 16 | −17 | 32 | 17 | −15 |
| 180 min | 30 | 14 | −16 | 30 | 13 | −17 |

Figure 50:
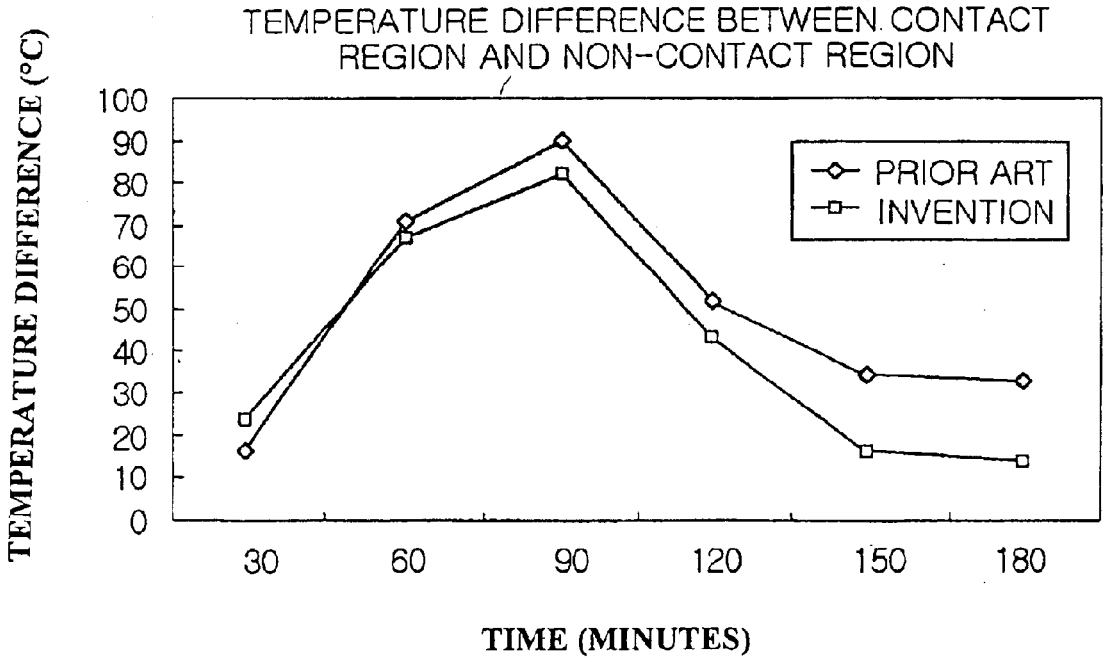
FIG. 50 is a graph illustrating results of Example 1 according to a structure of the invention and a conventional structure, in which temperature differences between a skid members contact region and a non-contact region of a hot material are plotted against time in minutes.

According to Table 1 above, the invention shows an improvement of about 15 to 17° C. in the temperature difference between the contact region and the non-contact central region of the slab compared with the prior art after a lapse of 150 minutes in heating time because the slab 110 of a typical type requires a heating time for about at least 150 minutes. The distribution of the temperatures measured in Example 1 is shown in a graph of FIG. 50.

As can be seen from above, the temperature difference between the contact regions of the slab, i.e., a region of the slab overlying the skid member 5 and the non-contact central region of the slab were maintained within about 20° C., preferably within about 18° C. Thus, the invention can prevent quality defects for example in the rolling thickness and width of the slab 110, which were observed in the prior art where the temperature difference was beyond the above range.

Table 2 below quantitatively reports a percentile thickness and width within tolerances and deviations of rolling thickness and width of the hot rolled strip, which was produced with improvement in temperature difference according to the invention as above in comparison to those of the prior art.

TABLE 2 the percentile thickness and width within tolerances and Deviation of Rolling Thickness and Width Owing to Temperature Deviation of Skid Contact Regions

| | Percentile thickness and width within tolerances (%) | | Deviation (μm, mm) | |
|---|---|---|---|---|
| Classification | Conv. | Inv. | Conv. | Inv. |
| Thickness (±50 μm) | 99.7 | 100.0 | 8.9 | 5.0 |
| Width (0~10 mm) | 85.7 | 100.0 | 7.5 | 2.0 |

As afore described, the invention prevents excessive temperature difference associated with the skid upper portion 161, thereby improving the percentile thickness and width within tolerances and reducing their deviations.

Furthermore, the invention can drop the operating temperature of the reheating furnace which was raised in the prior art in order to prevent temperature difference at the skid mark 160 on the underside of the slab 110, thereby saving the cost of fuel consumed in the reheating furnace. The invention also can restrict creation of scales to improve the yield of rolled products.

EXAMPLE 2

Figure 51:
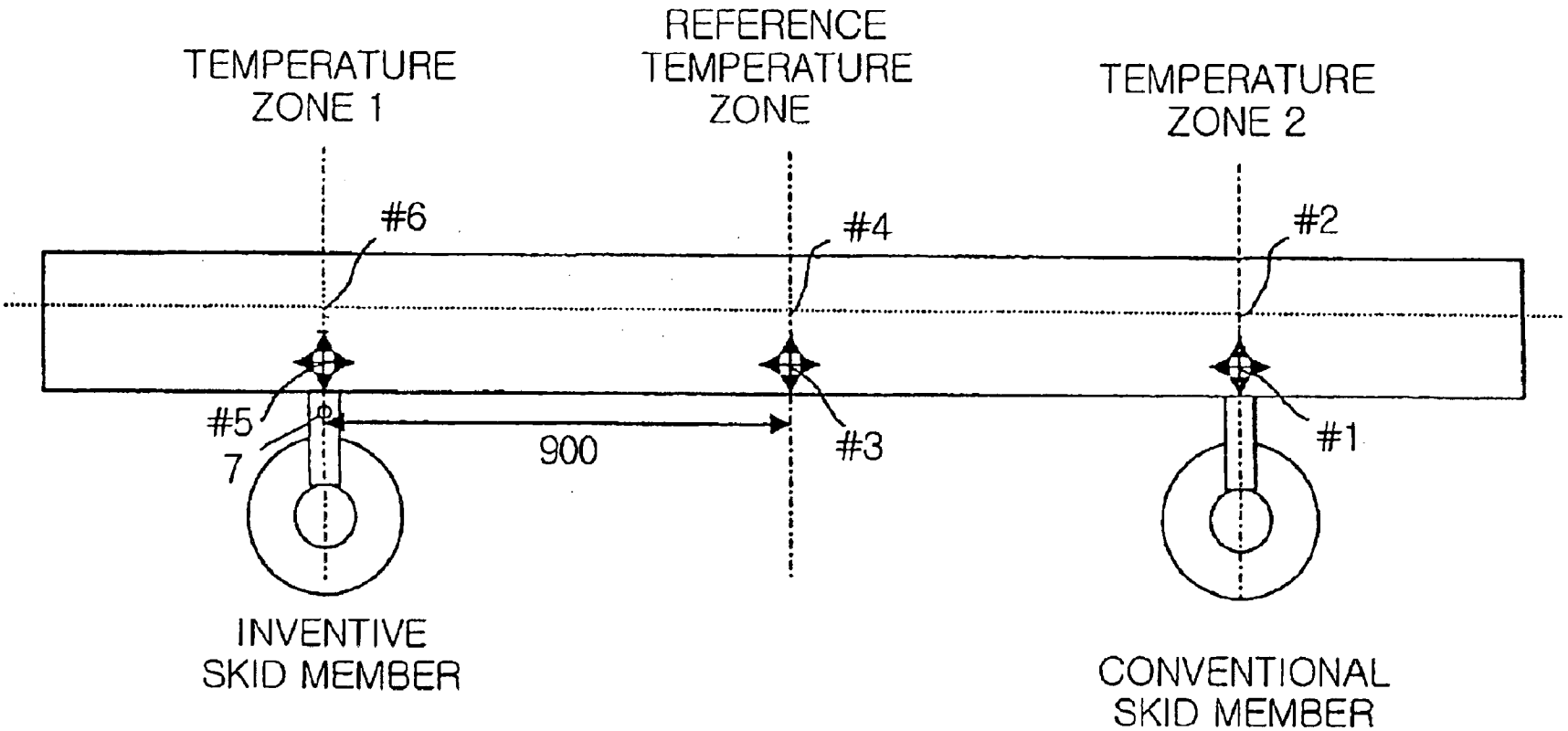
FIG. 51 illustrates an arrangement of the hot material, skid members and thermometers used in Examples 2 and 3 according to the invention.

In Example 2, a burner was used to feed flame having a temperature of about 1450° C. into an experimental reheating furnace to maintain the temperature within the experimental reheating furnace at a temperature of about 1230° C. As shown in FIG. 51, a skid member of the invention was loaded into the reheating furnace together with a skid member of the prior art under same conditions. Then, temperatures were measured at regions of a slab (sample) on the skid member of the invention and the conventional skid member to obtain temperature differences between skid marks and other regions of the slab. That is, after the skid member of the invention was mounted on one side of a skid pipe and the conventional skid member was mounted on the other side of the skid pipe, the slab was placed on both the skid member of the invention and the conventional skid member. Then, the slab was heated with the burner without moving the slab.

The slab used in Example 2 had dimensions of 115T×400W×900L, the skid members of the invention and the prior art had dimensions of 55W×140L×135H. The skid member of the invention had a laterally inclined channel structure as shown in FIG. 10, in which the circular ventilation channel had a diameter of about 20 mm. That is, the ventilation channel 7 had the single lateral vent hole 17 extended at an inclination to front and rear faces of the skid member 5.

The skid pipe mounted with the skid members in Example 2 had outside diameter of about 170 mm, inside diameter of about 130 mm, thickness of about 20 mm and castable thickness of about 75 mm. Coolant of a room temperature was fed into the skid pipe.

Thermocuples T/C were mounted on points #1 through #6, as shown in FIG. 51, to detect temperatures of these points. The points #1, #3 and #5 designate three points distanced for 10 mm from the underside of the slab.The points #2, #4 and #6 designate three points distanced for 60 mm from the underside of the slab, that is, for 50 mm from the top portion of the slab.

Also, the points #1 and #2 are placed right above the skid member of the prior art, the points #5 and #6 are placed right above the skid member of the invention, and the points #3 and #4 are in central sections (non-contact sections) which are not supported by any of the skid members.

Figure 52:
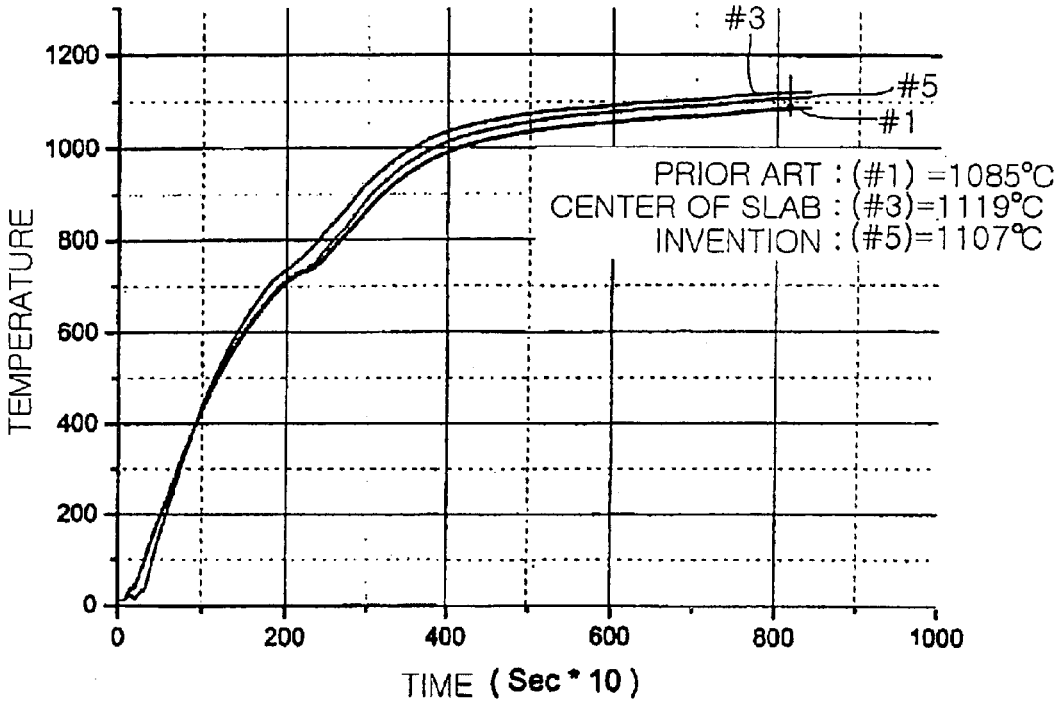
FIG. 52 is a graph illustrating temperature profiles at points #1, #3 and #5 in FIG. 51 according to results of Example 2.
Figure 53:
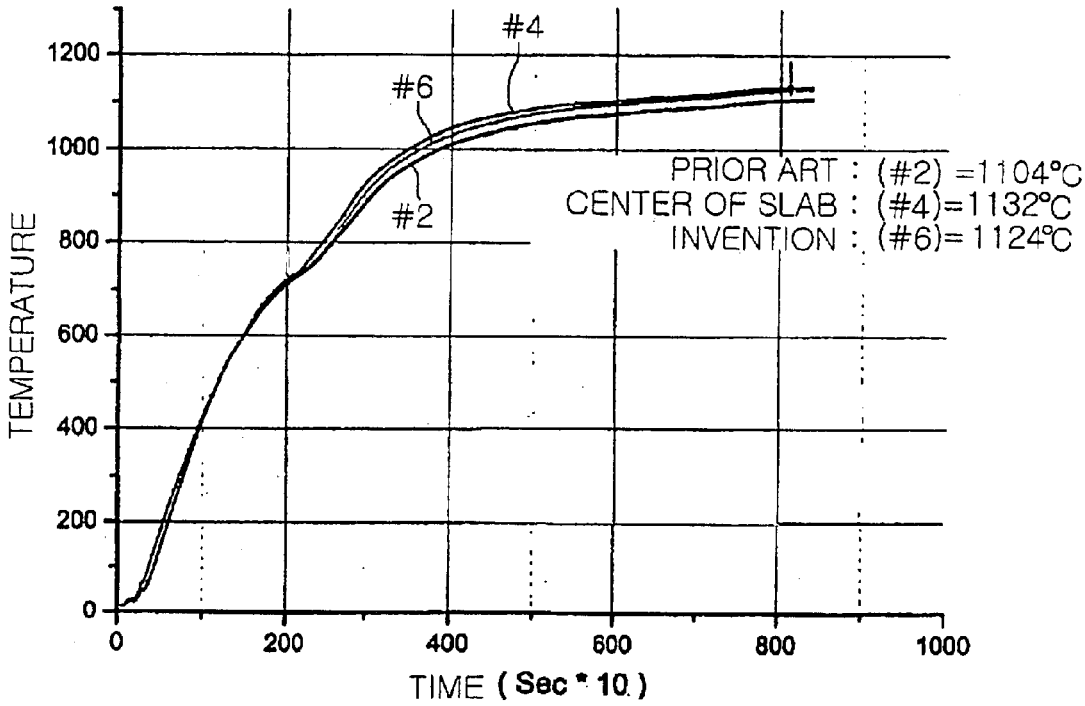
FIG. 53 is a graph illustrating temperature profiles at points #2, #4 and #6 in FIG. 51 according to results of Example 2.

FIG. 52 is a graph illustrating temperatures at the points #1, #3 and #5 with respect to time, and FIG. 53 is a graph illustrating temperatures at the points #2, #4 and #6 with respect to time.

Referring to FIG. 52, after a lapse of 8000 seconds, the point #1 at 10 mm from the underside of the slab supported by the conventional skid member had a measured temperature of 1085° C., the point #3 at 10 mm from the underside of the slab in the central section which was not supported by any of the skid members had a measured temperature of 1119° C., and the point #5 at 10 mm from the underside of the slab supported by the skid member of the invention had a measured temperature of 1107° C.

This shows that the region of the slab supported by the skid member of the invention had a temperature difference of only 12° C. from the central region of the slab, whereas the region of the slab supported by the conventional skid member had a temperature difference of 34° C. from the central region of the slab. This result is similar to the effect of the skid member of the invention which was observed in Example 1.

Further, referring to FIG. 53, after a lapse of 8000 seconds, the point #2 at 60 mm from the underside of the slab supported by the conventional skid member had a measured temperature of 1104° C., the point #4 at 60 mm from the underside of the slab in the central section which was not supported by any of the skid members had a measured temperature of 1132° C., and the point #6 at 60 mm from the underside of the slab supported by the skid member of the invention had a measured temperature of 1124° C.

This shows that the contact region of the slab supported by the skid member of the invention had a temperature difference of only 8° C. from the central region of the slab, whereas the region of the slab supported by the conventional skid member had a temperature difference of 28° C. from the central region of the slab. This result shows that the invention can allow remarkably uniform heating to the slab over the prior art.

Figure 54:
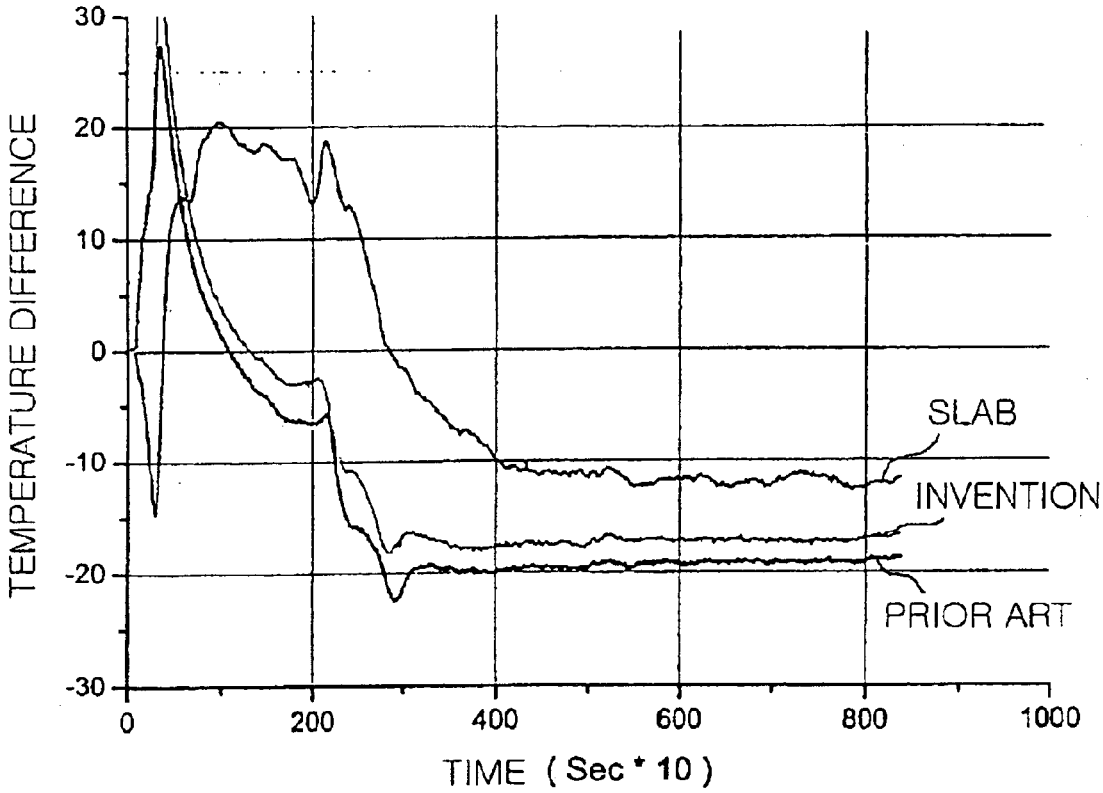
FIG. 54 is a graph illustrating temperature difference profiles produced by deducting temperatures at 60 mm from an underside of a hot material from temperatures at 10 mm from the underside of the hot material according to results of Example 2.

FIG. 54 illustrates temperature difference profiles produced by deducting temperatures at the three points 60 mm above the underside of the slab from the temperatures at the three points 10 mm above the underside of the slab right under the first three points when the slab was heated as above.

The profiles were obtained on basis of FIGS. 52 and 53. The temperature differences were large owing to heat transfer through contact between the skid members and the slab before a time lapse of about 1 hour (3600 seconds), whereas the temperature differences were steady after about 1 hour. Measured values were obtained between 3600 to 8000 seconds.

The central section of the slab which was not supported by any of the skid members had temperature differences of only about 12 to 13° C. between the points #3 and #4, the slab supported by the conventional skid member had temperature differences of about 19 to 20° C. between the points #1 and #2, and the slab supported by the skid member of the invention had temperature differences of about 16 to 18° C. between the points #5 and #6.

The points #2, #4 and #6 had temperatures higher than those of the points #1, #3 and #5 because the burner is placed in an upper portion of the experimental reheating furnace, the slab (sample) is relatively thin, and heat is transferred from the top portion to the bottom of the slab. However, in an actual reheating furnace, the points #3 and #4 in the slab which were not supported by any of the skid members have substantially equal temperatures (e.g., temperature differences of about 2 to 5° C.).

As can be seen from Example 2, the temperature differences between the points #5 and #6 in the slab section supported by the skid member of the invention further approach the temperature differences between points #3 and #4 in the slab section without any of the skid members compared with the temperature differences between the points #1 and #2 in the slab section supported by the conventional skid member. As a result, the invention achieves an effect of reducing the temperature differences for about 2 to 3° C.

Reduction in the temperature differences as above means that the slab was heated uniformly so that the skid member of the invention has an excellent effect of heating the slab more uniformly than the skid member of the prior art.

Figure 55:
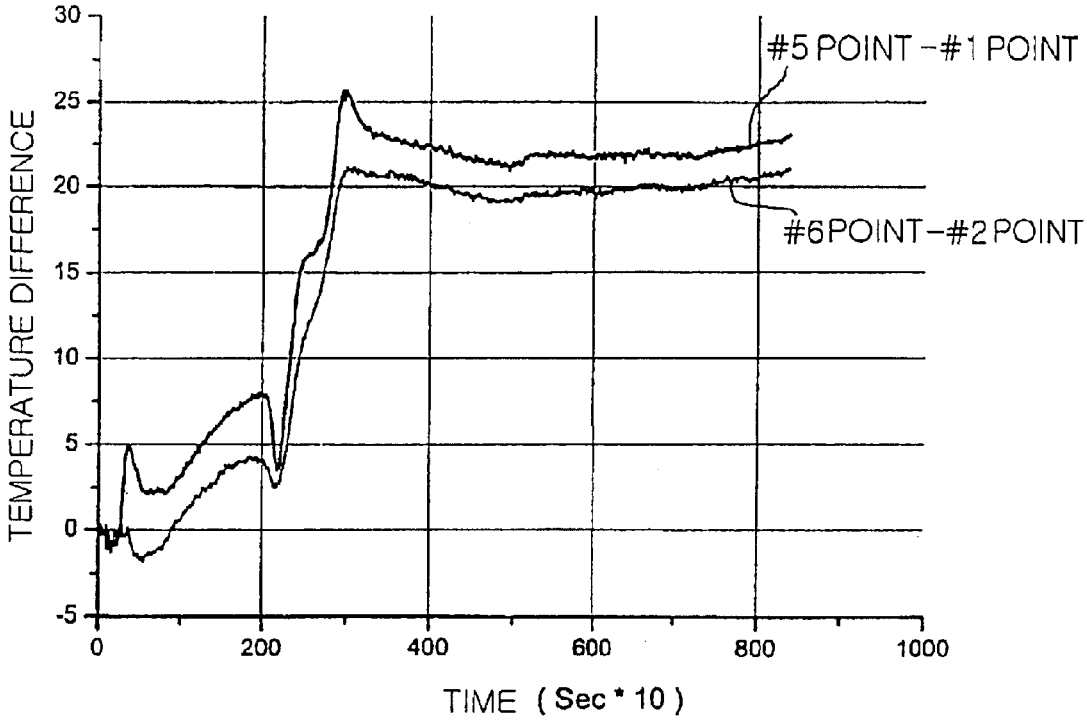
FIG. 55 is a graph according to results of Example 2, illustrating temperature differences between the points #5 and #1 at 10 mm above the underside of the hot material and between the points #6 and #2 at 60 mm above the underside of the hot material, in which the points #5 and #6 were supported by the skid member of the invention and the points #1 and #2 were supported by the skid member of the prior art.

FIG. 55 illustrates temperature differences between the points #5 and #1 at 10 mm above the underside of the slab and between the points #6 and #2 at 60 mm above the underside of the slab, in which the points #5 and #6 were supported by the skid member of the invention and the points #1 and #2 were supported by the skid member of the prior art.

The temperature differences were large owing to heat transfer through contact between the skid members 5 and the slab before a time lapse of about 1 hour (3600 seconds), whereas the temperature differences were steady after about 1 hour. Measured values were obtained between 3600 to 8000 seconds, and resultant values were obtained from the temperature differences.

As can be seen from the above results, the temperatures at the points #5 and #6 supported by the skid member of the invention were higher than the temperatures at the points #1 and #2 supported by the conventional skid member so that the skid member of the invention can support the slab at more uniform temperatures. In particular, the effect of uniformly regulating the temperature was more prominent in the points #5 and #1 at 10 mm above the underside of the slab than in the points #6 and #2 at 60 mm above the underside of the slab.

Figure 56:
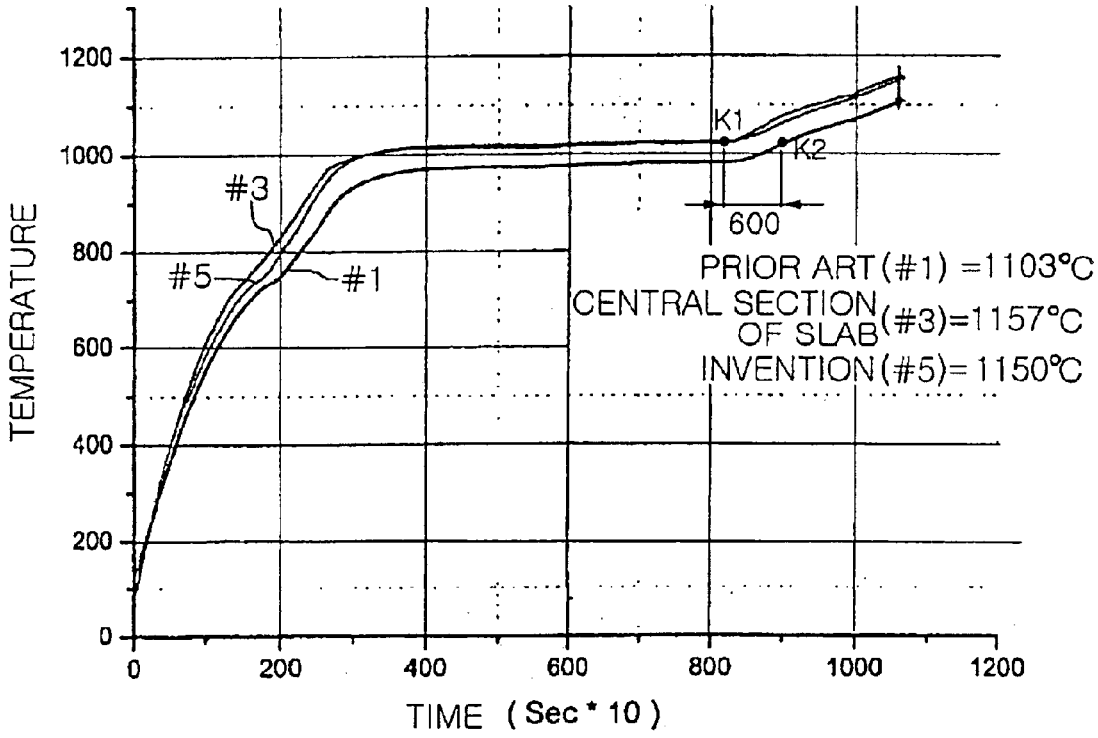
FIG. 56 is a graph illustrating temperature profiles based on time at points #1, #3 and #5 in FIG. 51 according to results, of Example 3.
Figure 57:
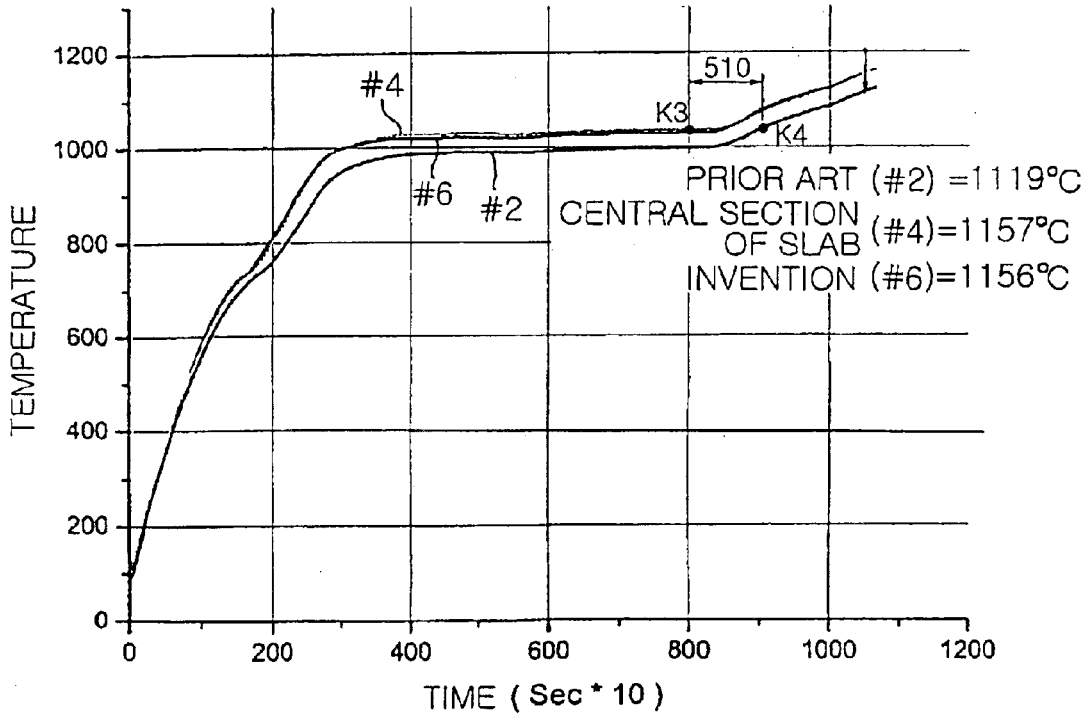
FIG. 57 is a graph illustrating temperature profiles based on time at points #2, #4 and #6 in FIG. 51 according to results of Example 3.
Figure 58:
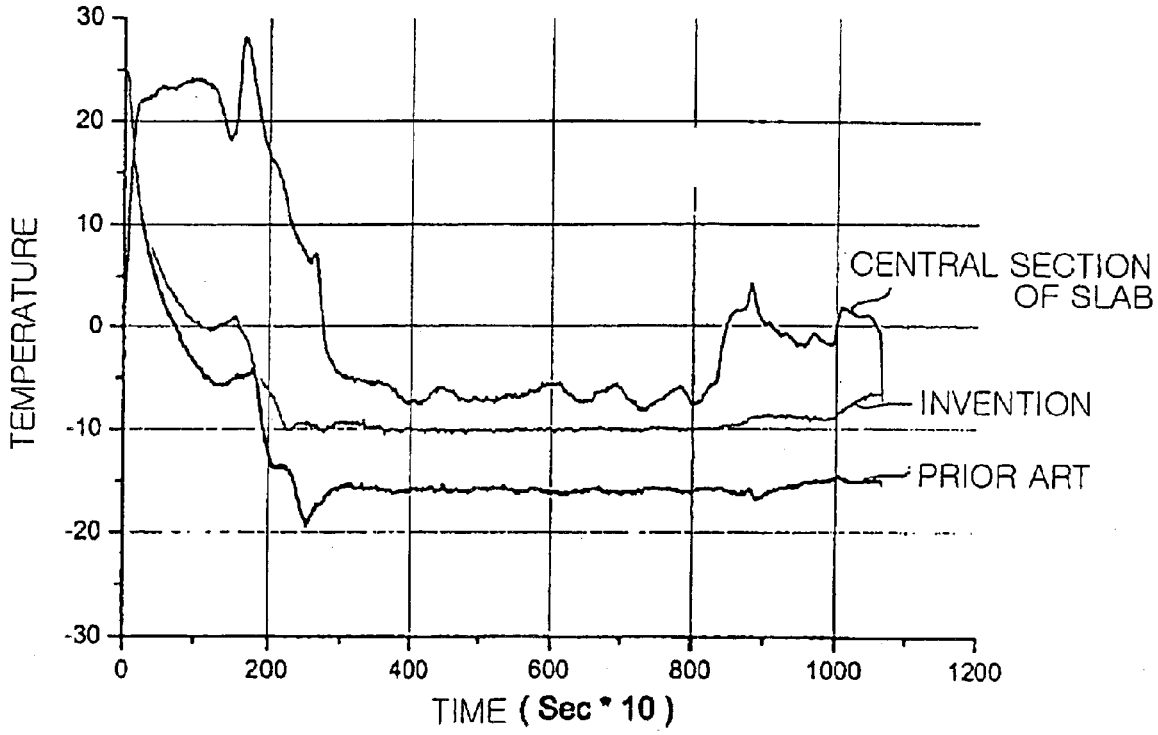
FIG. 58 is a graph illustrating temperature difference profiles produced by deducting temperatures at 60 mm above an underside of a hot material from temperatures at 10 mm above the underside of the hot material according to results of Example 3.

FIGS. 56 through 58 illustrate experimental results achieved with the alternative structures to the skid member of the invention.

EXAMPLE 3

In Example 3, an experimental reheating furnace same as that used in Example 2 was prepared. To carry out a series of experiments, the experimental reheating furnace was maintained at a temperature of about 1170° C. and then raised to a temperature of about 1285° C. at a point K1 in FIG. 56. The skid member shown in FIG. 10 used in Example 2, was replaced by the skid member shown in FIG. 30. That is, the skid member comprises a vent hole 10 extended longitudinally through the skid member 5, a vertical vent hole 10*a* extended from the longitudinal vent hole 10 to a top face of the skid member 5 and a scale exit hole 10*b* extended downward from the holes 10 and 10*a* to a side of the skid member 5.

Temperatures of the slab (sample) in Example 3 are illustrated as a graph of temperature profiles at the points #1, #3 and #5 with respect to time in FIG. 56, and a graph of temperature profiles at the points #2, #4 and #6 with respect to time in FIG. 57.

Referring to FIG. 56, after a lapse of about 10500 seconds, the point #1 at 10 mm from the underside of the slab supported by the conventional skid member had a measured temperature of 1103° C., the point #3 at 10 mm from the underside of the slab in the central section which was not supported by any of the skid members had a measured temperature of 1157° C., and the point #5 at 10 mm from the underside of the slab supported by the skid member of the invention had a measured temperature of 1150° C.

Regarding the above graphs, it can be seen that the temperature difference between a non-contact region and the point of the slab supported by the skid member 5 of the invention (i.e., the temperature at the point #3—the temperature at the point #5) was only 7° C.

The skid member of the invention used in Example 3 can further reduce the temperature difference for about 5° C. over the skid member of the invention used in Example 2 (i.e., shown in FIG. 10) because atmospheric gas within the reheating furnace can directly heat the underside of the slab through the vertical vent hole 10*a* extended from the horizontal lateral vent hole 10 to the top face of the skid member.

Furthermore, in FIG. 56, in order to reach a temperature corresponding to the point K1 on the temperature profile of the point #5, the slab section supported by the conventional skid member is further heated for about 10 minutes (600 seconds) in order to reach a point K2 on the temperature profile of point #1 which has same temperature at point K1.

According to the skid member 5 of the invention as above, the slab can reach a desired temperature at a relatively small heat quantity compared with the conventional skid member.

Thus, the skid member 5 of the invention can lower a slab-heating temperature within a reheating furnace than the prior art thereby saving the fuel cost of the reheating furnace as well as to shorten a slab heating process for at least about 10 minutes thereby imparting a higher flexibility thereto.

Further, as in FIG. 57, after a lapse of about 10500 seconds, the point #2 at 60 mm from the underside of the slab supported by the conventional skid member had a measured temperature of 1119° C., the point #4 at 60 mm from the underside of the slab in the central section which was not supported by any of the skid members had a measured temperature of 1157° C., and the point #6 at 10 mm from the underside of the slab supported by the skid member of the invention had a measured temperature of 1156° C.

This shows the temperature difference between the point #6 in the slab supported by the skid member 5 of the invention and the point #4 in the slab is only 1° C., whereas the temperature difference between the point #2 in the slab supported by the conventional skid member and the point #4 in the slab reaches 38° C. This result shows that the invention allows remarkably uniform heating to the slab over the prior art.

The skid member of the invention used in Example 3 can further reduce the temperature difference for about 7° C. over the skid member of the invention used in Example 2 because the vertical vent hole 10*a* functions very effectively to directly heat the underside of the slab.

Furthermore, in FIG. 57, in order to reach a temperature corresponding to the point K3 on the temperature profile of the point #6, the slab section supported by the conventional skid member is further heated for about 8.5 minutes (510 seconds) in order to reach a point K4 on the temperature profile of point #2.

FIG. 58 illustrates temperature difference profiles produced by deducting temperatures at the three points 60 mm above the underside of the slab from the temperatures at the three points 10 mm above the underside of the slab right under the first three points when the slab was heated as above.

The profiles were obtained on basis of FIGS. 56 and 57 in a fashion similar to FIG. 54. The temperature differences were large owing to heat transfer through contact between the skid members and the slab before a time lapse of about 1 hour (3600 seconds), whereas the temperature differences were steady between 3600 to 8000 seconds after a lapse of about 1 hour.

Referring FIG. 58, at a time point of elapsing 10000 seconds, the central section of the slab without contacting any of the skid members had a small value of temperature difference between the points #3 and #4, the slab supported by the conventional skid member had a temperature difference of about 16° C. between the points #1 and #2, and the slab supported by the skid member of the invention had temperature differences of about 6° C. between the points #5 and #6.

As a result, the skid member used in Example 3 of the invention can reduce the temperature difference in a vertical direction with respect to the skid member for about 5° C. compared with the skid member used in Example 2, and for about 7° C. compared with the conventional skid member. Therefore, the skid member in Example 3 can reduce the vertical temperature difference of the slab thereby to improve rolling threading ability and steel plate configuration.

Figure 59:
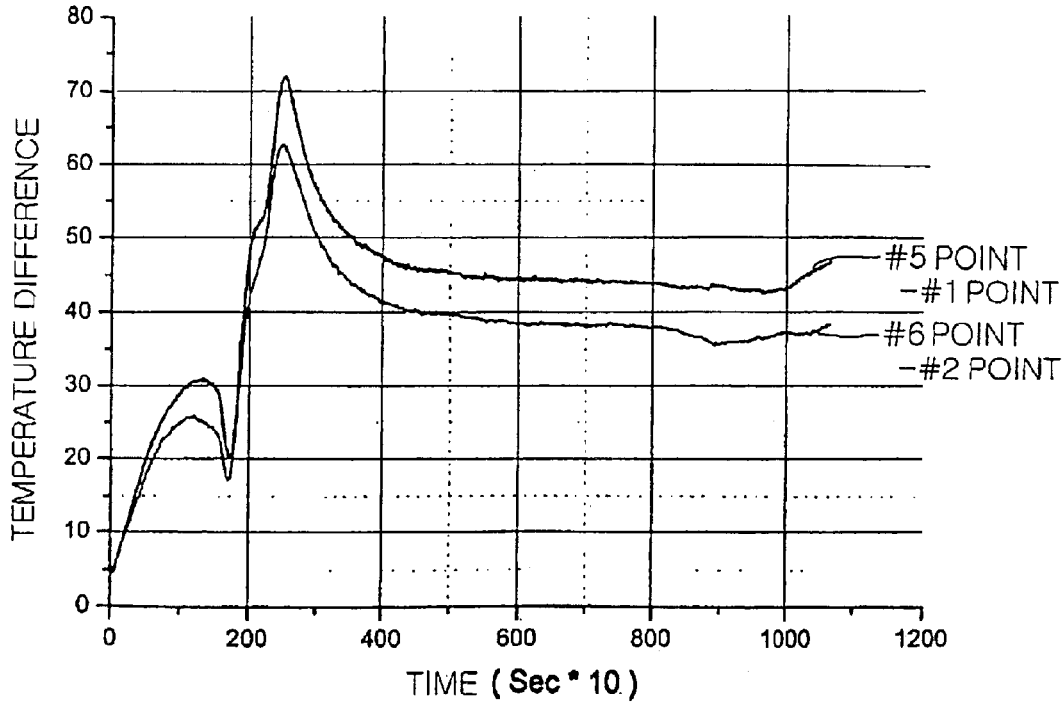
FIG. 59 is a graph according to results of Example 3, illustrating temperature differences between the points #5 and #1 at 10 mm above the underside of the hot material and between the points #6 and #2 at 60 mm above the underside of the hot material, in which the points #5 and #6 were supported by the skid member of the invention and the points #1 and #2 were supported by the skid member of the prior art.

FIG. 59 illustrates temperature differences between the points #5 and #1 at 10 mm above the underside of the slab and between the points #6 and #2 at 60 mm above the underside of the slab, in which the points #5 and #6 were supported by the skid member of the invention and the points #1 and #2 were supported by the skid member of the prior art.

The temperature differences were large owing to heat transfer through contact between the skid members and the slab before a time lapse of about 1 hour (3600 seconds), whereas the temperature differences were steady after about 1 hour. Measured values were obtained between 3600 to 10000 seconds, and resultant values were obtained from the temperature differences.

As can be seen from the above results, the temperatures at the points #5 and #6 supported by the skid member of the invention were higher than the temperatures at the points #1 and #2 supported by the conventional skid member so that the skid member of the invention can support the slab at more uniform temperatures. In particular, the effect of uniformly regulating the heating temperature of the slab was more prominent in the points #5 and #1 at 10 mm above the underside of the slab than in the points #6 and #2 at 60 mm above the underside of the slab.

The skid member of the invention used in Example 3 is proved more excellent over the conventional skid member since the skid member of Example 3 regulates the heating temperature of the slab more uniformly. Furthermore, the skid member of Example 3 can achieve an effect of further raising the temperature in the contact region between the slab and the top portion of the skid member over the skid member of Example 2.

According to Examples 1 through 3 above, when applied to the actual reheating furnace, the invention had effects of reducing the temperature difference for about at least 50% compared with the conventional skid member while raising the temperature of the skid mark for about at least 10° C.

EXAMPLE 4

Figure 60A:
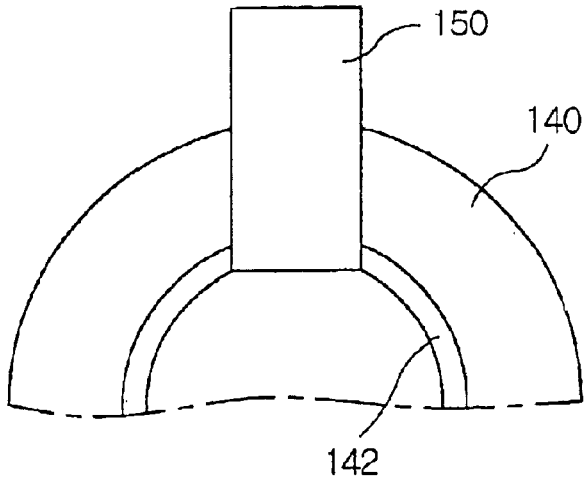
FIGS. 60*a* through 60*c* are detailed views of a conventional skid member as a comparative example and skid members of the invention, illustrating positions for measuring stress point temperatures.
Figure 60B:
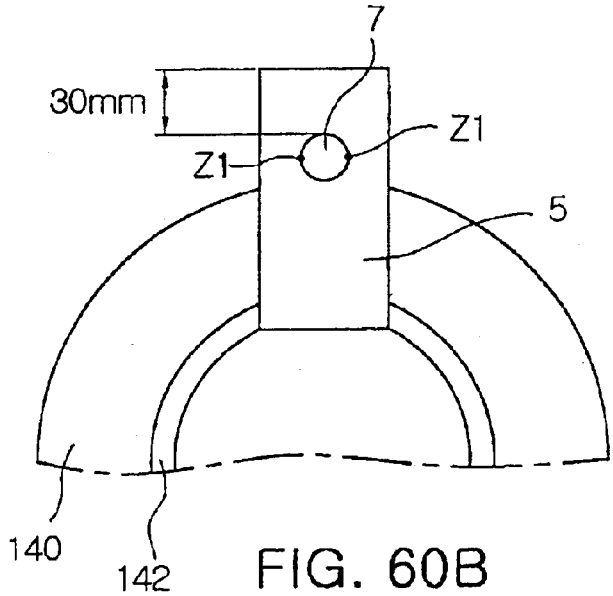
Figure 60C:
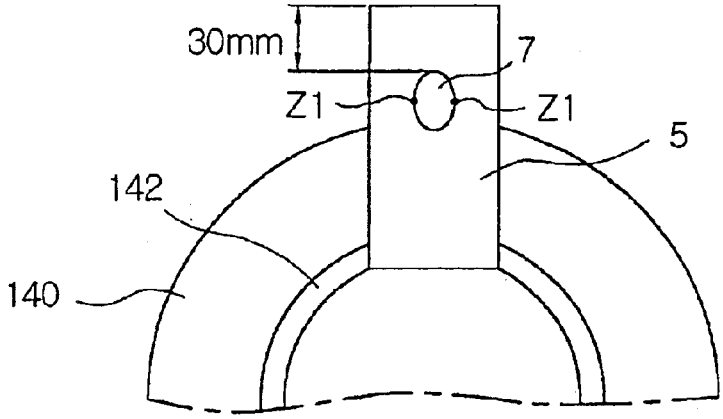

In Example 4, computer simulation was performed to skid members 5 of the invention having a circular ventilation channel 7 and an elliptic ventilation channel 7 as shown in FIGS. 60*a* through 60*c*, and results were reported in Table 3 below.

FIG. 60*a* illustrates a conventional skid member 150 as a comparative example, and FIGS. 60*b* and 60*c* illustrate the skid members of the invention.

Both the skid members 5 had dimensions of 60W×140L×135H. The highest temperature of the conventional skid member 150, that is, the temperature at a top portion thereof was set 1,100° C. as a reference value. The same force of 0.29 kg/mm$^2$ as that of the prior art was applied to top portions of the skid members 5 of the invention.

The ventilation channels 7 were formed at 30 mm from the top faces of the skid members 5 in FIGS. 60*b* and 60*c*. The elliptic section was formed longitudinally, with a short diameter in a lateral direction and a long diameter in a vertical direction.

As a result of simulating stress distribution in the circular or elliptic ventilation channel, it was observed that stress was concentrated on the horizontal maximum diameter Z1. Therefore, regarding the result in Example 2, simulation was performed to the temperature at the top portion of the skid member 5 of the invention, the maximum stress thereof and the temperature at the stress concentration point on the maximum diameter Z1 in reference to the set temperature of 1,100° C. at the top portion of the conventional skid member, in which heat quantity introduced into the skid member shown in FIG. 10 and heat quantity discharged to the coolant pipe were fixed and the sectional area of the vent hole 7 was varied. Results in Table 3 below were obtained as relative temperature rise at the top portion of the skid member with respect to the variation of sectional area of the ventilation channel.

The computer simulation was performed according to following Equations 8 and 9, disclosed in "*FORMULAS FOR STRESS, STRAIN, AND STRUCTURAL MATRICES*", by Walter D. Pilkey, published by JOHN WILEY & SONS, INC., in which Equation 8 is described in page 272, and Equation 9 was described in page 278:

$$\sigma_{max}=\sigma_A=K_t\sigma_{nom}'\sigma_{nom}=P/[t(D-d)]$$

$$K_t=3.000-3.140(d/D)+3.667(d/D)^2-1.527(d/D)^3 \text{ for } 0\leqq d/D\leqq 1 \qquad \text{Equation 8, and}$$

Equation 9

$$\sigma_{max} = \sigma_A = K_t \sigma_{nom}, \quad \sigma_{nom} = \sigma/(1 - 2b/D)$$

$$K_t = C_1 + C_2\left(\frac{2b}{D}\right) + C_3\left(\frac{2b}{D}\right)^2 + C_4\left(\frac{2b}{D}\right)^3,$$

$$1.0 \leqq b/a \leqq 8.0$$

| | |
|---|---|
| C1 | $1.109 - 0.188\sqrt{b/a} + 2.086b/a$ |
| C2 | $-0.486 + 0.213\sqrt{b/a} - 2.588b/a$ |
| C3 | $3.816 - 5.510\sqrt{b/a} + 4.638b/a$ |
| C4 | $-2.438 + 5.485\sqrt{b/a} - 4.126b/a.$ |

TABLE 3

| Circle Diam. | Upper portion temp. ° C. | Stress kg/mm² | Stress point temp. ° C. | Ellipse Ratio* | Upper portion temp. ° C. | Stress kg/mm² | Stress point temp. ° C. |
|---|---|---|---|---|---|---|---|
| 4 | 1100 | 0.87 | 854 | 4/8 | 1110 | 0.60 | 840 |
| 6 | 1110 | 0.88 | 849 | 6/12 | 1110 | 0.61 | 827 |
| 8 | 1110 | 0.88 | 844 | 8/16 | 1120 | 0.62 | 816 |
| 10 | 1120 | 0.89 | 840 | 10/20 | 1130 | 0.63 | 806 |
| 12 | 1130 | 0.91 | 837 | 12/24 | 1150 | 0.64 | 798 |
| 14 | 1140 | 0.93 | 835 | 14/28 | 1160 | 0.66 | 791 |
| 16 | 1160 | 0.95 | 833 | 16/32 | 1190 | 0.68 | 786 |
| 18 | 1170 | 0.97 | 833 | 18/36 | 1210 | 0.71 | 783 |
| 20 | 1190 | 1.00 | 835 | 20/40 | 1240 | 0.74 | 782 |
| 22 | 1210 | 1.04 | 837 | 22/44 | 1270 | 0.77 | 783 |
| 24 | 1230 | 1.08 | 841 | 24/48 | 1310 | 0.81 | 787 |
| 26 | 1260 | 1.13 | 847 | 26/52 | 1360 | 0.86 | 794 |
| 28 | 1290 | 1.18 | 854 | 28/56 | 1410 | 0.92 | 804 |

Note:
*means ratio of short diameter to long diameter

Figure 61:
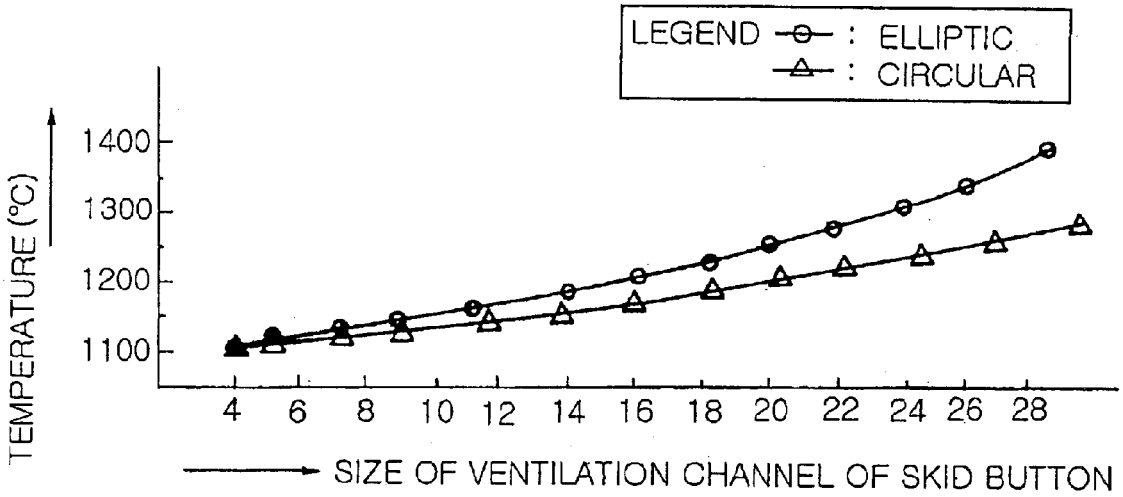
FIG. 61 is a graph for illustrating a temperature profile of a skid member of the invention with respect to the sectional area of circular and elliptic ventilation channels when a conventional skid member reaches a predetermined temperature 1100° C.

FIG. 61 is a graph for illustrating a temperature profile at the top portion of the skid member 5 of the invention with respect to the sectional area of the ventilation channel among values obtained as in Table 3.

It can be understood that highest temperatures of the skid members 5 rise in proportion to the increase of diameters of both the circular and elliptic ventilation channels 7. Further, the elliptic ventilation channel 7 can more readily raise the temperature of the skid member than the circular ventilation channel 7, thereby preventing local temperature drop of the slab.

This means that the temperature at the top portion of the skid member 5 can be adjusted via the ventilation channel 7 of the invention.

In Table 3 above, the temperature variation at the stress concentration point on diameter Z1 of the ventilation channel is not proportional to the size of the ventilation channel. Heat transfer from the slab to the coolant pipe is performed mainly through the width of the skid member excluding the sectional area of the ventilation channel. At a small diameter of the ventilation channel, the quantity of heat transfer tends to increase to raise the temperature at the stress concentration point on diameter Z1. At a large diameter of the ventilation channel, the quantity of heat transfer decreases. Also, since the quantity of heat discharged from the lower portion of the skid member to the coolant pipe is substantially equal, the quantity of heat possessed by the lower portion of the skid member decreases. Thus, this influences the lower portion 164 of the skid member under the ventilation channel to lower the temperature at the stress concentration point on diameter Z1.

That is, since the ventilation channel 7 formed in the skid member blocks (or restrains) heat transfer from the upper portion 162 of the skid member to the coolant pipe, heat loss at the lower portion of the skid member is not sufficiently compensated.

However, where the diameter of the ventilation channel 7 reaches at least a predetermined value increasing the internal sectional area, a large quantity of heat introduction is made from hot gas introduced into the ventilation channel 7 to sufficiently compensate the heat loss of the lower portion 164 of the skid member. A residual quantity of introduced heat raises the temperature at the stress concentration point on diameter Z1 and compensates the heat loss of the upper portion 162 of the skid member to raise the temperature thereof.

Since the elliptic ventilation channel has an internal sectional area larger than that of the circular ventilation channel and is formed vertically, it can be understood that the elliptic ventilation channel more effectively contributes to dispersion of stress and smooth temperature distribution in a vertical direction of the skid member.

Since all the maximum stresses corresponding to the temperatures at the stress points exist in a tolerable stress range of general material for skid member, the skid member 5 of the invention is structurally stable. It is also known that the maximum stress is varied according to variation in width of the skid member.

EXAMPLE 5

In Example 5, computer simulation was performed to temperature variation in the regions of a slab contacting with skid members with respect to the position of ventilation channels in skid members.

Figure 62A:
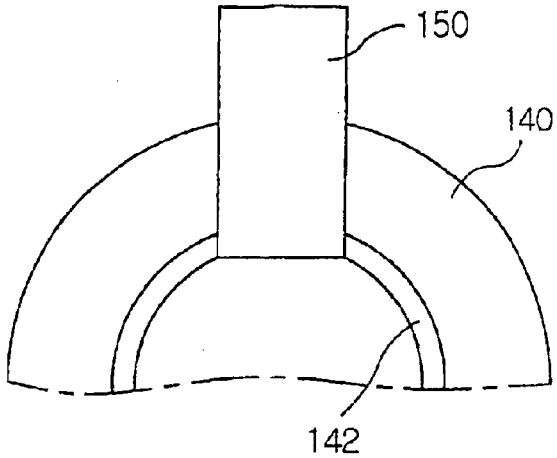
FIGS. 62*a* through 62*c* are detailed views of a conventional skid member as a comparative example and skid members of the invention used in Example 5.
Figure 62B:
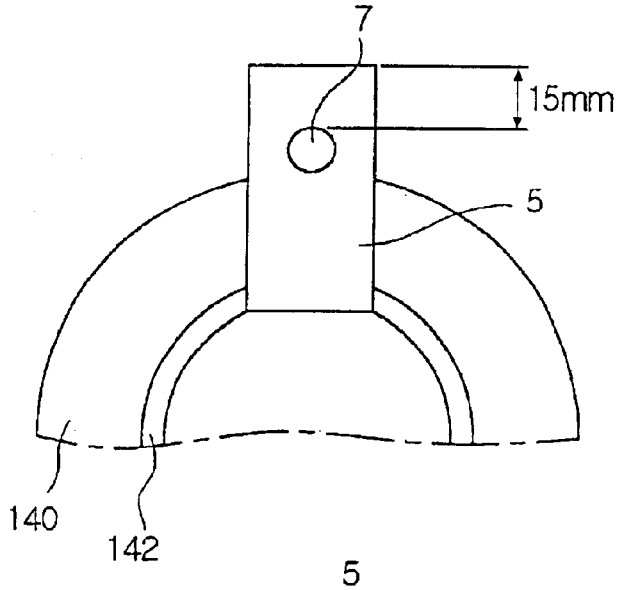
Figure 62C:
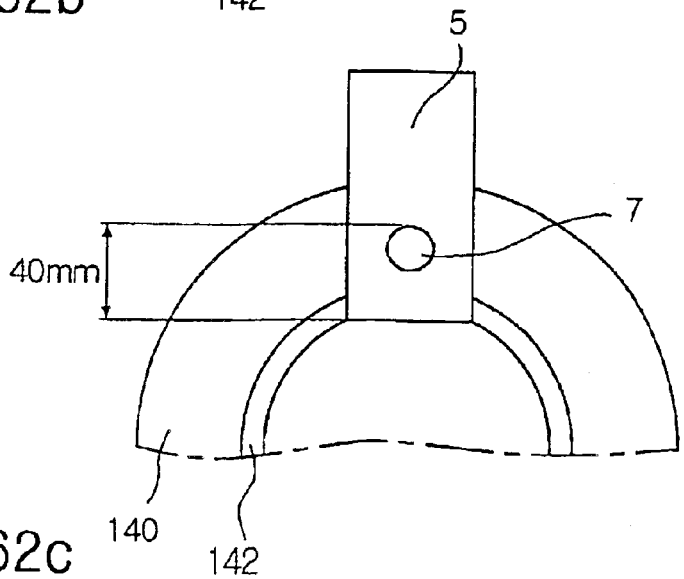

FIG. 62*a* illustrates a conventional skid member as a comparative example, and FIGS. 62*b* and 62*c* illustrate skid members of the invention.

Temperature differences were measured at skid marks and the slab (sample) in an arrangement as shown in FIG. 51 under equal conditions to the skid members of the invention and the conventional skid member. That is, each of the skid members of the invention was mounted on one of the skid pipes and the conventional skid member was mounted on another one of the skid pipes, and then the slab was seated on the skid members without movement, in which only radiant heat transfer was considered.

In Example 5, the reheating furnace had an atmospheric temperature of about 1250° C., and the slab had a temperature of about 1150° C. The slab was sized of 200T×400W×900L. The skid member of the invention in FIG. 62*b* was sized of 55W×140L×135H, in which a circular ventilation channel having a diameter of 25 mm was formed at 15 mm from the top face of the skid member.

In Example 5, the skid pipes mounted with the skid members had outside diameter of 170 mm, inside diameter of 130 mm, thickness of 20 mm and castable thickness of 75 mm. Coolant of a room temperature was fed into the skid pipe.

Thermometers T/C were mounted on points #1 through #6, as shown in FIG. 51, to detect temperatures of these points. The points #1, #3 and #5 designate three points distanced for 40 mm from the underside of the slab. The points #2, #4 and #6 designate three points distanced for 100 mm from the underside of the slab, that is, for 110 mm from the top face of the slab.

Also, the points #1 and #2 are placed right above the skid member of the prior art (refer to FIG. 62*a*), the points #5 and #6 are placed right above the skid member of the invention (refer to FIG. 62*b*), and the points #3 and #4 are in central sections (non-contact sections) which are not supported by any of the skid members.

Figure 63:
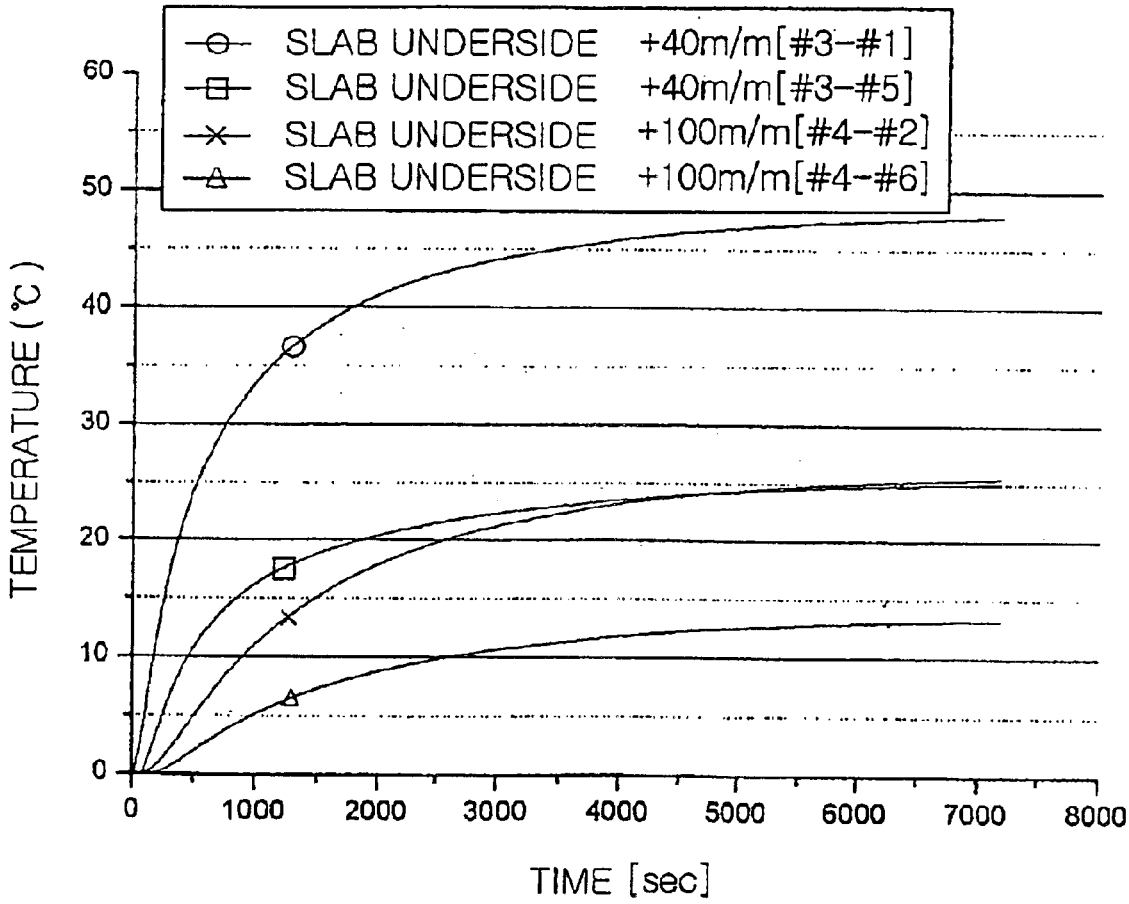
FIG. 63 is a graph of temperature difference profiles according to results of Example 5 in a structure having a ventilation channel formed in an upper portion, illustrating temperature differences between the points #3 and #1, the points #3 and #5, the points #4 and #2 and the points #4 and #6 at 40 mm and 100 mm positions, in which the points #5 and #6 are supported by the skid member of the invention, the points #3 and #4 are in central non-contact section of a hot material, and the points #1 and #2 are supported by the conventional skid member.

FIG. 63 is a graph of temperature profiles illustrating temperature differences between the points #3 and #1, the points #3 and #5, the points #4 and #2 and the points #4 and #6 with respect to time.

This shows that the temperature differences between the points #3 and #5 and between the points #4 and #6 are remarkably smaller than those between the points #3 and #1 and between the points #4 and #2, in which the points #5 and #6 are supported by the skid member of the invention, the points #3 and #4 are not supported by any of the skid members and the points #1 and #2 are supported the conventional skid member. It can be understood that the skid member of the invention has an effect of reducing the temperature difference more excellent than that of the conventional skid member.

Further, the ventilation channel shown in FIG. 62*c* was arranged in a lower portion of the skid member, in particular, the cylindrical ventilation channel having a diameter of 25 mm was formed at 40 mm from the bottom of the skid member.

Figure 64:
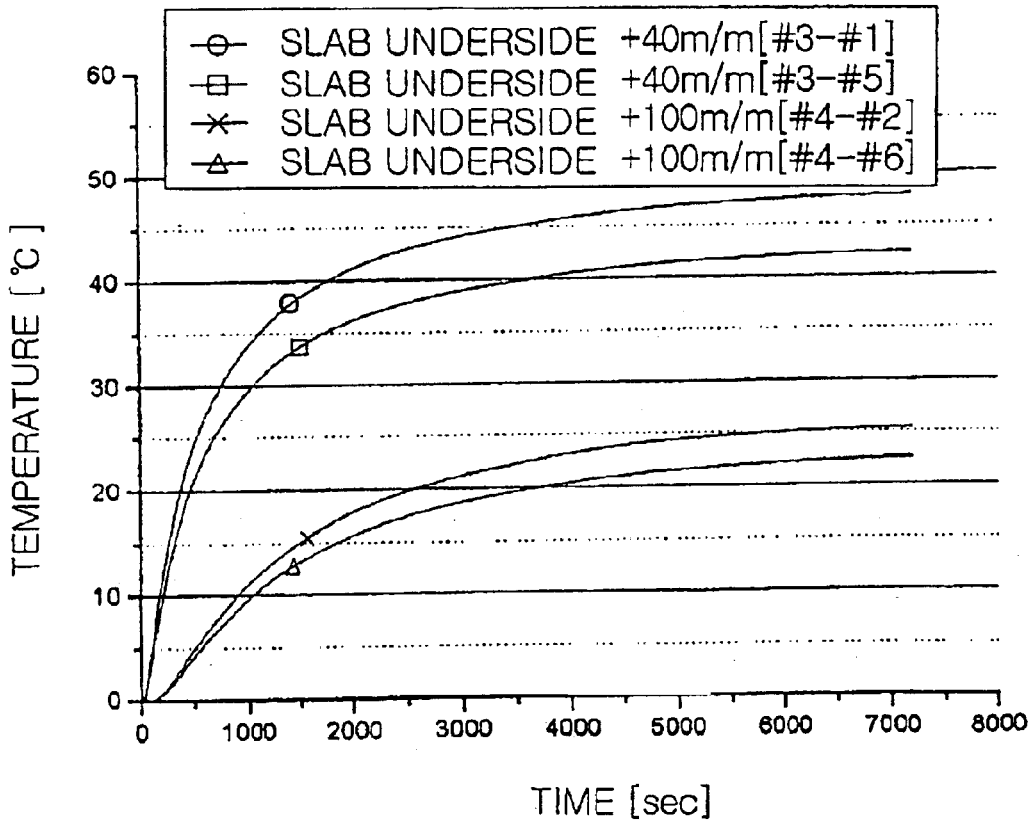
FIG. 64 is a graph of temperature profiles according to results of Example 5 in a structure having a ventilation channel formed in a lower portion, illustrating temperature differences between the points #3 and #1, the points #3 and #5, the points #4 and #2 and the points #4 and #6 at 40 mm and 100 mm positions, in which the points #5 and #6 are supported by the skid member of the invention, the points #3 and #4 are in central non-contact section of a hot material, and the points #1 and #2 are supported by the conventional skid member.

In FIG. 64, a graph of temperature profiles illustrates temperature differences between the points #3 and #1, the points #3 and #5, the points #4 and #2 and the points #4 and #6 with respect to time.

This shows that the temperature differences between the points #3 and #5 and between the points #4 and #6 are remarkably smaller than those between the points #3 and #1 and between the points #4 and #2, in which the points #5 and #6 are supported by the skid member of the invention, the points #3 and #4 are not supported by any of the skid members and the points #1 and #2 are supported the conventional skid member. It can be understood that the skid member of the invention has an effect of reducing the temperature difference more excellent than that of the conventional skid member.

As shown in FIG. 64, where the top portion of the ventilation channel was formed at 40 mm from the bottom of the skid member, the temperature difference between the points #3 and #1 obtained with the conventional skid member was about 48° C., but the temperature difference between the points #3 and #5 obtained with the skid member of the invention was about 42° C. This shows that the invention achieved improvement in temperature for about 6° C.

Even though this skid member achieved an effect of temperature improvement for about 6° C., it can be seen that this skid member was degraded in heat compensation compared with the structure as shown in FIG. 63, that the ventilation channel was formed in the upper portion of the skid member.

From results of FIGS. 63 and 64, it can be understood that the skid member achieves more excellent heating effect as the ventilation channel is formed higher in the skid member.

Further, it is preferred that the top portion of the ventilation channel is placed at 40 mm or higher from the top portion of the skid cooling means.

While this invention has been described in connection with the various embodiments in the specification of the invention, the invention is not limited or restricted to the foregoing vent hole structures. It is also understood that the foregoing structures are disclosed for illustrative purposes only for describing the invention in detail but various modifications and variations can be made without departing from the scope of the invention. For example, the vent holes may be in the form of triangle, quadrangle, hexagon, octagon, polygon and ellipse, or varied in numbers. Also, radiator fins can be formed in inner peripheries of the vent holes in order to increase the surface area of the vent holes.

While the skid members 5 are illustrated to have the ventilation channels 7 extended from the front face to the rear face, to the top face or diagonally, the invention is not limited thereto. The vent hole may have an L-shaped section extended to an adjacent side of the skid member. Furthermore, the vent hole may be curved rather than linear. Such variations may be made readily from the spirit of the invention.

Therefore, these various modifications and variations can be apparently made from the disclosure of the invention without departing from the spirit and scope of the invention.

According to the invention as set forth above, the temperature difference associated with the skid mark can be reduced through simple improvement to the structure of the skid member 5 so that hot material 110 can be heated at a uniform temperature so as to save excessive cost consumed for improving the skid apparatus or eliminate necessity for additional maintenance. Furthermore, the invention achieves an effect, which allows the rolling quality of the hot material such as the hot rolling threading ability, size and configuration of the hot rolled strip or plate to be improved in subsequent processes.

The invention forms the ventilation channel 7 while maintaining the contour of the skid member 5 so that the skid member 5 can receive heat from hot gas within the reheating furnace during introduction of hot gas into the same to reduce the quantity of heat transfer toward the coolant pipe 140 as well as compensate heat, thereby effectively preventing the temperature difference associated with the skid upper portion 161.

Since the reheating furnace is not heated excessively and thus the slab or hot material is not overheated, creation of excessive scale is restricted to minimize descaling, thereby raising the yield of rolling while saving production cost.

Moreover, the invention may feed a small quantity of combustion gas through the combustion gas pipe 60 arranged adjacent to the vent hole or the scale exit hole of the skid member so that flame directly heats the skid mark 160 of the hot material 110 through the vertical vent hole or indirectly heats the hot material 110 through the skid member 5 so as to minimize the temperature difference between the hot material and the skid mark.

What is claimed is:

1. A method for reducing temperature difference in a hot material to be heated which is supported and carried by a skid member within a reheating furnace, the method comprising the following steps of:

circulating hot gas for heating the hot material into a space formed within the skid member; and compensating heat loss of an upper portion of the skid member with a portion of heat transferred from the hot gas which is introduced into the space and transferring a residual of the transferred heat to a coolant pipe, whereby the temperature of the upper portion of the skid member is maintained higher than a temperature inevitably creating a skid mark in the hot material.

2. The method as set forth in claim 1, further comprising the step of circulating the hot gas through the space which is extended from inside the skid member toward a top face thereof to directly heat an underside region of the hot material in contact with the skid member before or after the transferring step.

3. The method as set forth in claim 2, further comprising the step of reducing heat transfer toward a lower portion of the skid member via the space formed within the skid member before or after any of the preceding steps.

4. The method as set forth in claim 1, further comprising the step of reducing heat transfer toward a lower portion of the skid member via the space formed within the skid member before or after any of the preceding steps.

5. A skid member for supporting and/or carrying a hot material to be heated within a reheating furnace, comprising:

a top face contacting an underside region of the hot material; and at least one ventilation channel formed in the skid member for introducing hot gas through the same to reduce temperature difference between the underside region of the hot material in contact with the top face of the skid member and a non-contact region of the hot material, wherein the ventilation channel comprises a lateral vent hole, which is extended from one side of the skid member to one of the other sides thereof.

6. The skid member as set forth in claim 5, wherein the ventilation channel has an uppermost point, which is place above at least 40 mm from an uppermost point of a coolant pipe within the reheating furnace.

7. The skid member as set forth in claim 5, wherein the ventilation channel comprises a vertical vent hole, which is extended from the lateral vent hole within the skid member to the top face thereof so that hot gas directly contacts an underside of the hot material.

8. The skid member as set fort in claim 7, wherein the ventilation channel comprises a vertical vent hole which is extended from the vent hole within the skid member to the top face thereof and a scale exit hole which is extended from the vent hole within the skid member downward to a side of the skid member.

9. The skid member as set forth in claim 8, further comprising a combustion gas pipe with a leading end extended into a portion of the lateral vent hole, wherein the combustion gas pipe feeds combustion gas to enhance heating effect toward an upper portion of the skid member through the vertical vent hole, foreign materials such as scales introduced into the vent hole are dropped and cleared via the scale exit hole, and direct and indirect heating via the skid member are applied the underside region of the hot material in contact with the skid member.

10. The skid member as set forth in claim 8, further comprising a combustion gas pipe with a leading end extended into a portion of the scale exit hole, wherein the combustion gas pipe feeds combustion gas to enhance heating effect toward an upper portion of the skid member through the vertical vent hole and direct and indirect heating via the skid member are applied to the underside region of the hot material in contact with the skid member.

11. The skid member as set forth in claim 7, further comprising a combustion gas pipe with a leading end extended into a portion of the lateral vent hole, wherein the combustion gas pipe feeds combustion gas to enhance heating effect toward an upper portion of the skid member through the vertical vent hole and allow direct and indirect heating via the skid member to the underside region of the hot material in contact with the skid member.

12. The skid member as set forth in claim 5, wherein the ventilation channel has an elliptic or polygonal cross section.

13. The skid member as set forth in claim 5, wherein the lateral vent holes have heat-absorbing fins formed in inner peripheries for enlarging heat transfer areas.

14. The skid member as set forth in claim 5, wherein the lateral vent hole is mounted with a combustion gas pipe for feeding combustion gas into the same to heat the skid member through lateral vent hole and indirectly heat the hot material.

15. The skid member as set forth in claim 5, wherein the ventilation channel comprises a vertical vent hole which is extended from the lateral vent hole within the skid member toward a top face thereof so that hot gas directly contacts an underside of the hot material, and is formed in length along a coolant pipe.

16. The skid member as set forth in claim 15, wherein the ventilation channel comprises a vertical vent hole which is extended from the vent hole within the skid member toward a top face thereof and a scale exit hole extended at inclination to a side of the skid member, and is formed in length along the coolant pipe.

17. The skid member as set forth in claim 5, wherein the ventilation channel comprises a lateral vent hole formed in one or more riders which are extended along at least one assembling structure seated on a coolant pipe and coupled with the assembling structure.

18. The skid member as set forth in claim 5, wherein the ventilation channel comprises a lateral vent hole formed in at least one rider which is extended along an assembling structure seated on a coolant pipe and coupled with the assembling structure and a vertical vent hole extended from the lateral vent hole toward a top face of the skid member so that hot gas directly contacts an underside of the hot material.

19. The skid member as set forth in claim 18, wherein the ventilation channel comprises a vertical vent hole which is extended from the vent hole within the skid member toward a top face thereof, a scale exit hole extended at inclination to a side of the skid member, and a lateral vent hole formed in one or more riders which are extended along an assembling structure seated on a coolant pipe and coupled with the assembling structure.

20. A skid member for supporting and/or carrying a hot material to be heated within a reheating furnace, comprising:

a top face contacting an underside region of the hot material; and at least one ventilation channel formed in the skid member for introducing hot gas through the same to reduce temperature difference between the underside region of the hot material in contact with the top face of the skid member and a non-contact region of the hot material, wherein the ventilation channel comprises a lateral vent hole, which is extended at an inclination from a side of the skid member to an opposite side thereof.

21. A skid member for supporting and/or carrying a hot material to be heated within a reheating furnace, comprising:

a top face contacting an underside region of the hot material; and at least one ventilation channel formed in the skid member for introducing hot gas through the same to reduce temperature difference between the underside region of the hot material in contact with the top face of the skid member and a non-contact region of the hot material, wherein the ventilation channel comprises a plurality of lateral vent holes which are extended parallel with one another from a side of the skid member to an opposite side thereof.

22. A skid member for supporting and/or carrying a hot material to be heated within a reheating furnace, comprising:

a top face contacting an underside region of the hot material; and at least one ventilation channel formed in the skid member for introducing hot gas through the same to reduce temperature difference between the underside region of the hot material in contact with the top face of the skid member and a non-contact region of the hot material, wherein the ventilation channel comprises a plurality of lateral vent holes, which are extended at an inclination from a side of the skid member to an opposite side thereof.

23. A skid member for supporting and/or carrying a hot material to be heated with a reheating furnace, comprising:

a top face contacting an underside region of the hot material; and at least one ventilation channel formed in the skid member for introducing hot gas through the same to reduce temperature difference between the underside region of the hot material in contact with the top face of the skid member and a non-contact region of the hot material, wherein the ventilation channel comprises at least one vent hole, which is formed diagonally.

24. A skid member for supporting and/or carrying a hot material to be heated within in a reheating furnace, comprising:

a top face contacting an underside region of the hot material; and at least one ventilation channel formed in the skid member for introducing hot gas through the same to reduce temperature difference between the underside region of the hot material in contact with the top face of the skid member and a non-contact region of the hot material, wherein the ventilation channel comprises a plurality of lateral vent holes, which are extended diagonally at an inclination, the vent holes arranged one above another and alternating with one another.

25. A skid member for supporting and/or carrying a hot material to be heated within a reheating furnace, comprising:

a top face contacting an underside region of the hot material; and at least one ventilation channel formed in the skid member for introducing hot gas through the same to reduce temperature difference between the underside region of the hot material in contact with the top face of the skid member and a non-contact region of the hot material, wherein the ventilation channel comprises a plurality of lateral vent holes which are formed at different heights in front and rear faces of the skid member, the lateral vent holes communicating together inside the skid member.

26. A skid member for supporting and/or carrying a hot material to be heated within a reheating furnace, comprising:

a top face contacting an underside region of the hot material; and at least one ventilation channel formed in the skid member for introducing hot gas through the same to reduce temperature difference between the underside region of the hot material in contact with the top face of the skid member and a non-contact region of the hot material, wherein the ventilation channel comprises a first set of lateral vent holes which are arranged diagonally one above another alternating with one another and a second set of lateral vent holes which are formed above the first set of lateral vent holes and extended to lateral faces of the skid member.

27. A skid member for supporting and/or carrying a hot material to be heated within a reheating furnace, comprising:

a top face contacting an underside region of the hot material; and at least one ventilation channel formed in the skid member for introducing hot gas through the same to reduce temperature difference between the underside region of the hot material in contact with the top face of the skid member and a non-contact region of the hot material, wherein the ventilation channel comprises a plurality of lateral vent holes which are extended to sides of the skid member at a same height and cross one another.

28. A skid member for supporting and/or carrying a hot material to be heated within a reheating furnace, comprising:

a top face contacting an underside region of the hot material; and at least one ventilation channel formed in the skid member for introducing hot gas through the same to reduce temperature difference between the underside region of the hot material in contact with the top face of the skid member and a non-contact region of the hot material, wherein the ventilation channel comprises a plurality of lateral vent holes which are extended to sides of the skid member at an inclination and cross one another.

29. A skid member for supporting and/or carrying a hot material to be heated within a reheating furnace, comprising:

a top face contacting an underside region of the hot material; and at least one ventilation channel formed in the skid member for introducing hot gas through the same to reduce temperature difference between the underside region of the hot material in contact with the top face of the skid member and a non-contact region of the hot material, wherein the ventilation channel comprises a vertical vent hole that is formed in a central portion of the skid member and a scale exit hole extended downward from the vent hole to a side of the skid member.

30. A skid member for supporting and/or carrying a hot material to be heated within a reheating furnace, comprising;

a top face contacting an underside region of the hot material; and at least one ventilation channel formed in the skid member for introducing hot gas through the same to reduce temperature difference between the underside region of the hot material in contact with the top face of the skid member and a non-contact region of the hot material, wherein the ventilation channel comprises a lateral vent hole extended to a side of the skid member, a vertical vent hole extended from the lateral vent hole toward a top face of the skid member and a scale exit hole extended downward from the vent holes to another side of the skid member.

31. The skid member as set fort in claim 30, wherein the holes are sized in the order of the scale exit hole, the lateral vent hole and the vertical vent hole, and the scale vent hole is flared downward in diameter.

32. A skid member for supporting and/or carrying a hot material to be heated with in a reheating furnace, comprising:

a top face contacting an underside region of the hot material; and at least one ventilation channel formed in the skid member for introducing hot gas through the same to reduce temperature difference between the underside region of the hot material in contact with the top face of the skid member and a non-contact region of the hot material, wherein the ventilation channel comprises at least one vent hole having one open end and the other closed end.

33. A skid member for supporting and/or carrying a hot material to be heated within a reheating furnace comprising:

a top face for supporting the hot material;

a lateral hollow space of a predetermined size formed within the skid member; and a lateral vent hole formed in the skid member, whereby the quantity of heat transferred from the hot material to a coolant pipe is reduced and the quantity of heat introduced from hot gas is increased to reduce temperature difference between an underside region of the hot material in contact with the top face of the skid member and a non-contact region thereof.

34. The skid member as set forth in claim 33, wherein the hollow space comprises at least one vent hole, which is extended at an inclination to front and rear sides of the skid member.

35. The skid member as set fort in claim 33, wherein the hollow space comprises at least one vent hole extended toward top face of the skid member and a scale exit hole extended at an inclination from the hollow space to a side of the skid member so that hot gas directly contacts an underside of the hot material.

36. The skid member as set fort in claim 33, wherein the hollow space comprises at least one of vent holes extended at an inclination to front and rear faces and a top face of the skid member to reduce the quantity of heat transferred from the hot material to coolant in a coolant pipe and allow direct contact of hot gas to a skid mark through the vent hole thereby further improving heating ability.

37. The skid member as set fort in claim 33, wherein the hollow space has a scale exit hole extended downward to a side of the skid member.

38. The skid member as set fort in claim 33, further comprising a combustion gas pipe for feeding combustion gas to directly heat a skid mark with flame via the vent hole or indirectly heat the same via the skid member.

39. A skid member for supporting and/or carrying a hot material to be heated within a reheating furnace comprising:

a top face for supporting the hot material;

a blind lateral vent hole formed within the skid member at predetermined size; and a stopper blocking an opening of the vent hole to define a hollow space within the skid member, whereby the quantity of heat transferred from the hot material to a coolant pipe is reduced to decrease temperature difference between an underside region of the hot material in contact with the top face of the skid member and a non-contact region thereof.

40. A skid apparatus for supporting and/or carrying a hot material to be heated within a reheating furnace in order to reduce temperature difference between an underside region of the hot material in contact with a skid member and a non-contact region of the hot material, comprising:

a coolant pipe for allowing passage of coolant through the same;

a heat insulation layer surrounding an exterior of the coolant pipe; and at least one skid member having a bottom connected with the coolant pipe, a top face for supporting the hot material and at least one ventilation channel for allowing passage of hot gas within the reheating furnace into the skid member;

wherein the ventilation channel comprises a lateral vent hole, which is extended from one side of the skid member to one of the other sides thereof.

* * * * *

UNITED STATES PATENT AND TRADEMARK OFFICE

CERTIFICATE OF CORRECTION

PATENT NO. : 6,945,776 B2
DATED : September 20, 2005
INVENTOR(S) : Choi et al.

It is certified that error appears in the above-identified patent and that said Letters Patent is hereby corrected as shown below:

Column 35,
Line 25, “which is a place” should read -- which is placed --.

Column 35,
Line 33, “as set fort” should read -- as set forth --.
Line 47, “applied the underside” should read -- applied to the underside --.

Column 37,
Line 27, “within in a”, should read -- within a --.

Column 38,
Line 57, “as set fort”, should read -- as set forth --.

Column 39,
Lines 23, 29 and 36, “as set fort”, should read -- as set forth --.
Line 25, “toward top face”, should read -- toward a top face --.

Column 40,
Line 1, “as set fort” should read -- as set forth --.

Signed and Sealed this

Ninth Day of May, 2006

JON W. DUDAS
*Director of the United States Patent and Trademark Office*